US010657974B2

(12) United States Patent
Kim et al.

(10) Patent No.: US 10,657,974 B2
(45) Date of Patent: May 19, 2020

(54) PRIORITY INFORMATION FOR HIGHER ORDER AMBISONIC AUDIO DATA

(71) Applicant: QUALCOMM Incorporated, San Diego, CA (US)

(72) Inventors: Moo Young Kim, San Diego, CA (US); Nils Günther Peters, San Diego, CA (US); Shankar Thagadur Shivappa, San Diego, CA (US); Dipanjan Sen, San Diego, CA (US)

(73) Assignee: Qualcomm Incorporated, San Diego, CA (US)

( * ) Notice: Subject to any disclaimer, the term of this patent is extended or adjusted under 35 U.S.C. 154(b) by 0 days.

(21) Appl. No.: 16/227,880

(22) Filed: Dec. 20, 2018

(65) Prior Publication Data

US 2019/0198028 A1 Jun. 27, 2019

Related U.S. Application Data

(60) Provisional application No. 62/609,157, filed on Dec. 21, 2017.

(51) Int. Cl.
*G10L 19/008* (2013.01)
*H04S 7/00* (2006.01)
(Continued)

(52) U.S. Cl.
CPC ..... *G10L 19/008* (2013.01); *G10L 19/167* (2013.01); *H04S 7/30* (2013.01);
(Continued)

(58) Field of Classification Search
CPC ..... G10L 19/008; G10L 19/038; G10L 2019/0001; G10L 19/002; G10L 19/08;
(Continued)

(56) References Cited

U.S. PATENT DOCUMENTS 9,847,088 B2 * 12/2017 Peters ..... H04S 3/008
10,020,000 B2 * 7/2018 Najaf-Zadeh ..... G10L 19/0212
(Continued)

FOREIGN PATENT DOCUMENTS

WO 2015146057 A1 10/2015
WO 2016126907 A1 8/2016
(Continued)

OTHER PUBLICATIONS

ETSI TS 101 154 V2.3.1., "Digital Video Broadcasting (DVB); Specification for the use of Video and Audio Coding in Broadcasting Applications based on the MPEG-2 Transport Stream", Feb. 2017, 276 pages.
(Continued)

*Primary Examiner* — Lun-See Lao
(74) *Attorney, Agent, or Firm* — Shumaker & Sieffert, P.A.

(57) ABSTRACT

In general, techniques are described by which to provide priority information for higher order ambisonic (HOA) audio data. A device comprising a memory and a processor may perform the techniques. The memory stores HOA coefficients of the HOA audio data, the HOA coefficients representative of a soundfield. The processor may decompose the HOA coefficients into a sound component and a corresponding spatial component, the corresponding spatial component defining shape, width, and directions of the sound component, and the corresponding spatial component defined in a spherical harmonic domain. The processor may also determine, based on one or more of the sound component and the corresponding spatial component, priority information indicative of a priority of the sound component relative to other sound components of the soundfield, and specify, in a data object representative of a compressed
(Continued)

version of the HOA audio data, the sound component and the priority information.

30 Claims, 19 Drawing Sheets

(51) Int. Cl.
*G10L 19/16* (2013.01)
*H04S 3/00* (2006.01)

(52) U.S. Cl.
CPC ..... *H04S 3/008* (2013.01); *H04S 2400/11* (2013.01); *H04S 2400/15* (2013.01); *H04S 2420/11* (2013.01)

(58) Field of Classification Search
CPC .... G10L 19/20; G10L 19/167; H04S 2420/11; H04S 7/30; H04S 2400/01; H04S 3/002; H04S 2400/15; H04S 3/008; H04S 2400/11; H04R 2499/15; H04R 5/00
USPC ..... 381/17–23, 1; 700/94; 704/200, 201, 704/221, 222
See application file for complete search history.

(56) References Cited

U.S. PATENT DOCUMENTS

| | | | | |
|---|---|---|---|---|
| 2014/0023196 | A1 | 1/2014 | Xiang et al. | |
| 2015/0243292 | A1 | 8/2015 | Morrell et al. | |
| 2015/0264484 | A1* | 9/2015 | Peters | G10L 19/008 381/17 |
| 2015/0332682 | A1* | 11/2015 | Kim | G10L 19/008 381/22 |
| 2016/0241980 | A1* | 8/2016 | Najaf-Zadeh | H04S 7/303 |

FOREIGN PATENT DOCUMENTS

| | | | |
|---|---|---|---|
| WO | 2016172111 | A1 | 10/2016 |
| WO | 2017060412 | A1 | 4/2017 |

OTHER PUBLICATIONS

ETSI TS 103 589 V1.1.1, "Higher Order Ambisonics (HOA) Transport Format", Jun. 2018, 33 pages.

Hellerud E., et al., "Encoding Higher Order Ambisonics with AAC", Audio Engineering Society—124th Audio Engineering Society Convention 2008, AES, 60 East 42nd Street, Room 2520, New York 10165-2520, USA, May 1, 2008, pp. 1-8, XP040508582, abstract, figure 1.

"Information technology—High Efficiency Coding and Media Delivery in Heterogeneous Environments—Part 3: 3D Audio," ISO/IEC JTC 1/SC 29, ISO/IEC DIS 23008-3, Jul. 25, 2014, 433 Pages.

"Information technology—High Efficiency Coding and Media Delivery in Heterogeneous Environments—Part 3: Part 3: 3D Audio," ISO/IEC JTC 1/SC 29/WG11, ISO/IEC 23008-3, 201x(E), Oct. 12, 2016, 797 Pages.

"Information technology—High efficiency coding and media delivery in heterogeneous environments—Part 3: Part 3: 3D Audio, Amendment 3: MPEG-H 3D Audio Phase 2," ISO/IEC JTC 1/SC 29N, ISO/IEC 23008-3:2015/PDAM 3, Jul. 25, 2015, 208 pp.

International Search Report and Written Opinion—PCT/US2018/067286—ISA/EPO—Mar. 26, 2019.

"MDA; Object-Based Audio Immersive Sound Meta data and Bitstream," EBU Operating Eurovision, ETSI TS 103 223 V.1.1.1, Apr. 2015, 75 pp.

Neuendorf M., et al., "Updated to Proposed 2nd Edition of ISO/IEC 23008-3", 117, MPEG Meeting, Jan. 16, 2017- Jan. 20, 2017, Geneva, (Motion Picture Expert Group ISO/IEC JTC1/SC29/WG11), No. m39877, Jan. 12, 2017 (Jan. 12, 2017), XP030068222, cited in the application section 4.2, section 5.3.2, section 5.3.7, section 7.2, sections 12.1-12.4.4.4, sections 17.10.5.1-17.10.5.2, sections C.5.1-C.5.4.10, 3 Pages.

Poletti M., "Three-Dimensional Surround Sound Systems Based on Spherical Harmonics," The Journal of the Audio Engineering Society, vol. 53, No.11, Nov. 2005, pp. 1004-1025.

* cited by examiner

PRIORITY INFORMATION FOR HIGHER ORDER AMBISONIC AUDIO DATA

This application claims the benefit of U.S. Provisional Application No. 62/609,157, filed Dec. 21, 2017, the entire contents of which are hereby incorporated by reference as if set forth in its entirety herein.

TECHNICAL FIELD

This disclosure relates to audio data and, more specifically, compression of audio data.

BACKGROUND

A higher order ambisonic (HOA) signal (often represented by a plurality of spherical harmonic coefficients (SHC) or other hierarchical elements) is a three-dimensional (3D) representation of a soundfield. The HOA or SHC representation may represent this soundfield in a manner that is independent of the local speaker geometry used to playback a multi-channel audio signal rendered from this SHC signal. The SHC signal may also facilitate backwards compatibility as the SHC signal may be rendered to well-known and highly adopted multi-channel formats, such as a 5.1 audio channel format or a 7.1 audio channel format. The SHC representation may therefore enable a better representation of a soundfield that also accommodates backward compatibility.

SUMMARY

In general, techniques are described for a vector-based higher order ambisonic format with priority information to potentially prioritize subsequent processing of higher order ambisonic audio data. Higher order ambisonic audio data may comprise at least one spherical harmonic coefficient corresponding to a spherical harmonic basis function having an order greater than one and, in some examples, a plurality of spherical harmonic coefficients corresponding to multiple spherical harmonic basis functions having an order greater than one.

In one example, various aspects of the techniques described in this disclosure are directed to a device configured to compress higher order ambisonic audio data representative of a soundfield, the device comprising a memory configured to store higher order ambisonic coefficients of the higher order ambisonic audio data, the higher order ambisonic coefficients representative of a soundfield. The device also including one or more processors configured to decompose the higher order ambisonic coefficients into a sound component and a corresponding spatial component, the corresponding spatial component defining shape, width, and directions of the sound component in a spherical harmonic domain, determine, based on one or more of the sound component and the corresponding spatial component, priority information indicative of a priority of the sound component relative to other sound components of the soundfield, and specify, in a data object representative of a compressed version of the higher order ambisonic audio data, the sound component and the priority information.

In another example, various aspects of the techniques described in this disclosure are directed to a method of compressing higher order ambisonic audio data representative of a soundfield, the method comprising decomposing higher order ambisonic coefficients of the ambisonic higher order ambisonic audio data into a sound component and a corresponding spatial component, the higher order ambisonic audio data representative of a soundfield, the corresponding spatial component defining shape, width, and directions of the sound component in a spherical harmonic domain, determining, based on one or more of the sound component and the corresponding spatial component, priority information indicative of a priority of the sound component relative to other sound components of the soundfield, and specifying, in a data object representative of a compressed version of the higher order ambisonic audio data, the sound component and the priority information.

In another example, various aspects of the techniques described in this disclosure are directed to a device configured to compress higher order ambisonic audio data representative of a soundfield, the device comprising means for decomposing higher order ambisonic coefficients of the ambisonic higher order ambisonic audio data into a sound component and a corresponding spatial component, the higher order ambisonic audio data representative of a soundfield, the corresponding spatial component defining shape, width, and directions of the sound component in a spherical harmonic domain, means for determining, based on one or more of the sound component and the corresponding spatial component, priority information indicative of a priority of the sound component relative to other sound components of the soundfield, and means for specifying, in a data object representative of a compressed version of the higher order ambisonic audio data, the sound component and the priority information.

In another example, various aspects of the techniques described in this disclosure are directed to a non-transitory computer-readable storage medium having stored thereon instructions that, when executed, cause one or more processors to decompose higher order ambisonic coefficients of the ambisonic higher order ambisonic audio data into a sound component and a corresponding spatial component, the higher order ambisonic audio data representative of a soundfield, the corresponding spatial component defining shape, width, and directions of the sound component in a spherical harmonic domain, determine, based on one or more of the sound component and the corresponding spatial component, priority information indicative of a priority of the sound component relative to other sound components of the soundfield, and specify, in a data object representative of a compressed version of the higher order ambisonic audio data, the sound component and the priority information.

In another example, various aspects of the techniques described in this disclosure are directed to a device configured to compress higher order ambisonic audio data representative of a soundfield, the device comprising a memory configured to store, at least in part, a first data object representative of a compressed version of higher order ambisonic coefficients, the higher order ambisonic coefficients representative of a soundfield; and one or more processors. The one or more processors are configured to obtain, from the first data object, a plurality of sound components and priority information indicative of a priority of each of the plurality of sound components relative to remaining ones of the sound components, select, based on the priority information, a non-zero subset of the plurality of sound components, and specify, in a second data object different from the first data object, the selected non-zero subset of the plurality of sound components.

In another example, various aspects of the techniques described in this disclosure are directed to a method of compressing higher order ambisonic audio data representative of a soundfield, the method comprising obtaining, from a first data object representative of a compressed version of higher order ambisonic coefficients, a plurality of sound components and priority information indicative of a priority of each of the plurality of sound components relative to remaining ones of the sound components, the higher order ambisonic coefficients representative of a sound field, selecting, based on the priority information, a non-zero subset of the plurality of sound components, and specifying, in a second data object different from the first data object, the selected non-zero subset of the plurality of sound components.

In another example, various aspects of the techniques described in this disclosure are directed to a device configured to compress higher order ambisonic audio data representative of a soundfield, the device comprising means for obtaining, from a first data object representative of a compressed version of higher order ambisonic coefficients, a plurality of sound components and priority information indicative of a priority of each of the plurality of sound components relative to remaining ones of the sound components, the higher order ambisonic coefficients representative of a sound field, means for selecting, based on the priority information, a non-zero subset of the plurality of sound components, and means for specifying, in a second data object different from the first data object, the selected non-zero subset of the plurality of sound components.

In another example, various aspects of the techniques described in this disclosure are directed to a non-transitory computer-readable storage medium having stored thereon instructions that, when executed, cause one or more processors to obtain, from a first data object representative of a compressed version of higher order ambisonic coefficients, a plurality of sound components and priority information indicative of a priority of each of the plurality of sound components relative to remaining ones of the sound components, the higher order ambisonic coefficients representative of a sound field, select, based on the priority information, a non-zero subset of the plurality of sound components, and specify, in a second data object different from the first data object, the selected non-zero subset of the plurality of sound components.

In another example, various aspects of the techniques described in this disclosure are directed to a method of compressing higher order ambisonic audio data representative of a soundfield, the method comprising decomposing higher order ambisonic coefficients into a predominant sound component and a corresponding spatial component, the higher order ambisonic coefficients representative of a soundfield, the corresponding spatial component defining shape, width, and directions of the predominant sound component, and the corresponding spatial component defined in a spherical harmonic domain, and obtaining, from the higher order ambisonic coefficients, an ambient higher order ambisonic coefficient descriptive of an ambient component of the soundfield. The method also comprising obtaining a repurposed spatial component corresponding to the ambient higher order ambisonic coefficient, the repurposed spatial component indicative of one or more of an order and an sub-order of a spherical basis function to which the ambient higher order ambisonic coefficient corresponds, specifying, in a data object representative of a compressed version of the higher order ambisonic audio data and according to a format, the predominant sound component and the corresponding spatial component, and specifying, in the data object and according to the same format, the ambient higher order ambisonic coefficient and the corresponding repurposed spatial component.

In another example, various aspects of the techniques described in this disclosure are directed to a device configured to compress higher order ambisonic audio data representative of a soundfield, the device comprising means for decomposing higher order ambisonic coefficients into a predominant sound component and a corresponding spatial component, the higher order ambisonic coefficients representative of a soundfield, the corresponding spatial component defining shape, width, and directions of the predominant sound component, and the corresponding spatial component defined in a spherical harmonic domain, and means for obtaining, from the higher order ambisonic coefficients, an ambient higher order ambisonic coefficient descriptive of an ambient component of the soundfield. The device also comprising means for obtaining a repurposed spatial component corresponding to the ambient higher order ambisonic coefficient, the repurposed spatial component indicative of one or more of an order and an sub-order of a spherical basis function to which the ambient higher order ambisonic coefficient corresponds, means for specifying, in a data object representative of a compressed version of the higher order ambisonic audio data and according to a format, the predominant sound component and the corresponding spatial component, and means for specifying, in the data object and according to the same format, the ambient higher order ambisonic coefficient and the corresponding repurposed spatial component.

In another example, various aspects of the techniques described in this disclosure are directed to a non-transitory computer-readable storage medium having stored thereon instructions that, when executed, cause one or more processors to decompose higher order ambisonic coefficients into a predominant sound component and a corresponding spatial component, the higher order ambisonic coefficients representative of a soundfield, the corresponding spatial component defining shape, width, and directions of the predominant sound component, and the corresponding spatial component defined in a spherical harmonic domain, obtain, from the higher order ambisonic coefficients, an ambient higher order ambisonic coefficient descriptive of an ambient component of the soundfield, obtain a repurposed spatial component corresponding to the ambient higher order ambisonic coefficient, the repurposed spatial component indicative of one or more of an order and an sub-order of a spherical basis function to which the ambient higher order ambisonic coefficient corresponds, specify, in a data object representative of a compressed version of the higher order ambisonic audio data and according to a format, the predominant sound component and the corresponding spatial component, and specify, in the data object and according to the same format, the ambient higher order ambisonic coefficient and the corresponding repurposed spatial component.

In another example, various aspects of the techniques described in this disclosure are directed to a device configured to decompress higher order ambisonic audio data representative of a soundfield, the device comprising a memory configured to store, at least in part, a data object representative of a compressed version of higher order ambisonic coefficients, the higher order ambisonic coefficients representative of a soundfield, and one or more processors configured to obtain, from the data object and according to a format, an ambient higher order ambisonic coefficient descriptive of an ambient component of the soundfield. The one or more processors further configured to obtain, from the data object, a repurposed spatial component corresponding to the ambient higher order ambisonic coefficient, the repurposed spatial component indicative of one or more of an order and sub-order of a spherical basis function to which the ambient higher order ambisonic coefficient corresponds, obtain, from the data object and according to the same format, the predominant sound component, and obtain, from the data object, a corresponding spatial component defining shape, width, and directions of the predominant sound component, and the corresponding spatial component defined in a spherical harmonic domain. The one or more processors also configured to render, based on the ambient higher order ambisonic coefficient, the repurposed spatial component, the predominant sound component, and the corresponding spatial component, one or more speaker feeds, and output, to one or more speakers, the one or more speaker feeds.

In another example, various aspects of the techniques described in this disclosure are directed to a method of decompressing higher order ambisonic audio data representative of a soundfield, the method comprising obtaining, from a data object representative of a compressed version of higher order ambisonic coefficients and according to a format, an ambient higher order ambisonic coefficient descriptive of an ambient component of a soundfield, the higher order ambisonic coefficients representative of the soundfield, and obtaining, from the data object, a repurposed spatial component corresponding to the ambient higher order ambisonic coefficient, the repurposed spatial component indicative of one or more of an order and sub-order of a spherical basis function to which the ambient higher order ambisonic coefficient corresponds. The method also comprising obtaining, from the data object and according to the same format, the predominant sound component, and obtaining, from the data object, a corresponding spatial component defining shape, width, and directions of the predominant sound component, and the corresponding spatial component defined in a spherical harmonic domain. The method further comprising rendering, based on the ambient higher order ambisonic coefficient, the repurposed spatial component, the predominant sound component, and the corresponding spatial component, one or more speaker feeds, and outputting, to one or more speakers, the one or more speaker feeds.

In another example, various aspects of the techniques described in this disclosure are directed to a device configured to decompress higher order ambisonic audio data representative of a soundfield, the device comprising means for obtaining, from a data object representative of a compressed version of higher order ambisonic coefficients and according to a format, an ambient higher order ambisonic coefficient descriptive of an ambient component of a soundfield, the higher order ambisonic coefficients representative of the soundfield. The device further comprising means for obtaining, from the data object, a repurposed spatial component corresponding to the ambient higher order ambisonic coefficient, the repurposed spatial component indicative of one or more of an order and sub-order of a spherical basis function to which the ambient higher order ambisonic coefficient corresponds, and means for obtaining, from the data object and according to the same format, the predominant sound component. The device also comprises means for obtaining, from the data object, a corresponding spatial component defining shape, width, and directions of the predominant sound component, and the corresponding spatial component defined in a spherical harmonic domain, means for rendering, based on the ambient higher order ambisonic coefficient, the repurposed spatial component, the predominant sound component, and the corresponding spatial component, one or more speaker feeds, and means for outputting, to one or more speakers, the one or more speaker feeds.

In another example, various aspects of the techniques described in this disclosure are directed to a non-transitory computer-readable storage medium having stored thereon instructions that, when executed, cause one or more processors to obtain, from a data object representative of a compressed version of higher order ambisonic coefficients and according to a format, an ambient higher order ambisonic coefficient descriptive of an ambient component of a soundfield, the higher order ambisonic coefficients representative of the soundfield, obtain, from the data object, a repurposed spatial component corresponding to the ambient higher order ambisonic coefficient, the repurposed spatial component indicative of one or more of an order and sub-order of a spherical basis function to which the ambient higher order ambisonic coefficient corresponds, obtain, from the data object and according to the same format, the predominant sound component, obtain, from the data object, a corresponding spatial component defining shape, width, and directions of the predominant sound component, and the corresponding spatial component defined in a spherical harmonic domain, render, based on the ambient higher order ambisonic coefficient, the repurposed spatial component, the predominant sound component, and the corresponding spatial component, one or more speaker feeds; and output, to one or more speakers, the one or more speaker feeds.

The details of one or more aspects of the techniques are set forth in the accompanying drawings and the description below. Other features, objects, and advantages of these techniques will be apparent from the description and drawings, and from the claims.

DETAILED DESCRIPTION

Figure 1:
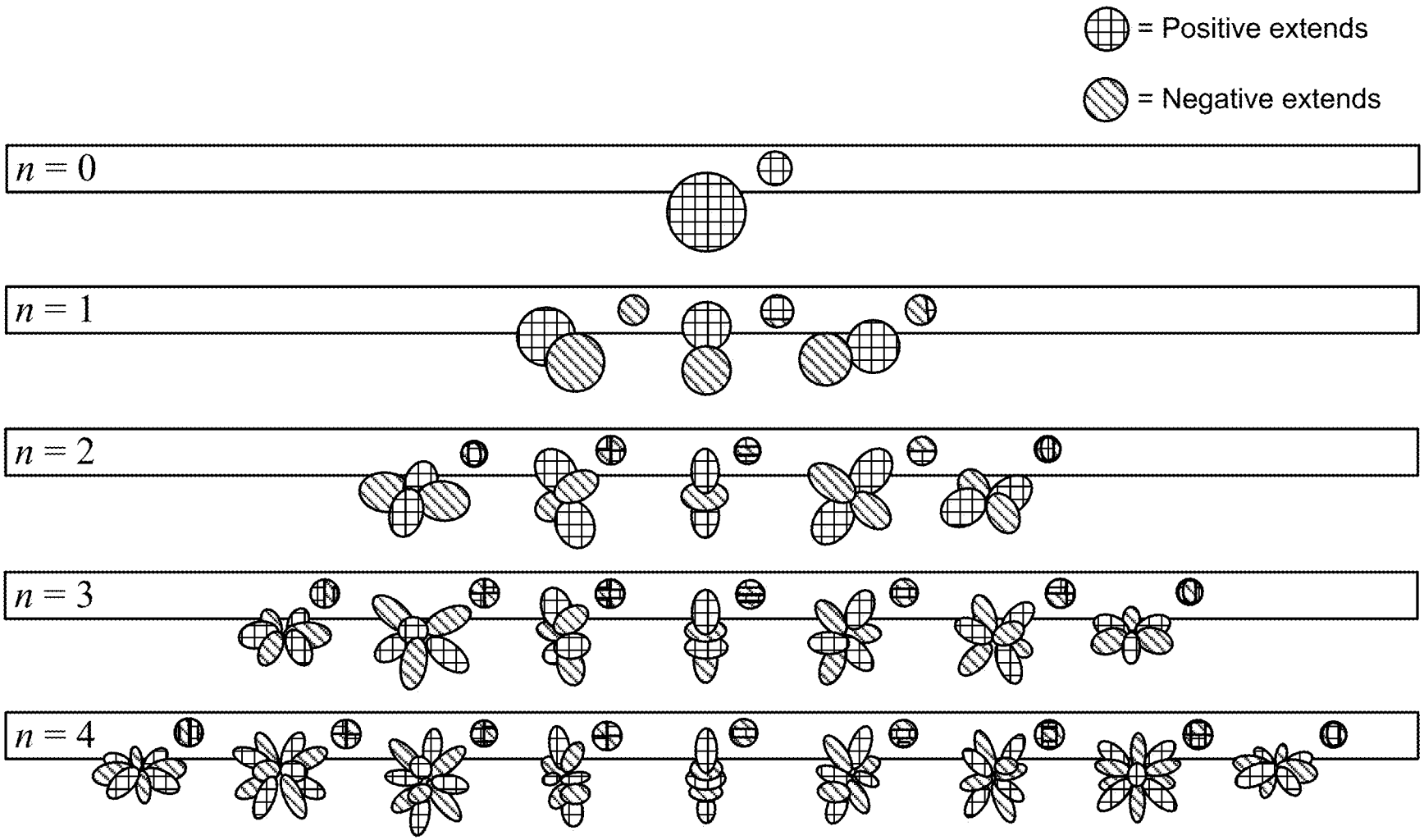
FIG. 1 is a diagram illustrating spherical harmonic basis functions of various orders and sub-orders.

There are various 'surround-sound' channel-based formats in the market. They range, for example, from the 5.1 home theatre system (which has been the most successful in terms of making inroads into living rooms beyond stereo) to the 22.2 system developed by NHK (Nippon Hoso Kyokai or Japan Broadcasting Corporation). Content creators (e.g., Hollywood studios, which may also be referred to as content providers) would like to produce the soundtrack for a movie once, and not spend effort to remix it for each speaker configuration. The Moving Pictures Expert Group (MPEG) has released a standard allowing for soundfields to be represented using a hierarchical set of elements (e.g., Higher-Order Ambisonic—HOA—coefficients) that can be rendered to speaker feeds for most speaker configurations, including 5.1 and 22.2 configuration whether in location defined by various standards or in non-uniform locations.

MPEG released the standard as MPEG-H 3D Audio standard, formally entitled "Information technology—High efficiency coding and media delivery in heterogeneous environments—Part 3: 3D audio," set forth by ISO/IEC JTC 1/SC 29, with document identifier ISO/IEC DIS 23008-3, and dated Jul. 25, 2014. MPEG also released a second edition of the 3D Audio standard, entitled "Information technology—High efficiency coding and media delivery in heterogeneous environments—Part 3: 3D audio, set forth by ISO/IEC JTC 1/SC 29, with document identifier ISO/IEC 23008-3:201x(E), and dated Oct. 12, 2016. Reference to the "3D Audio standard" in this disclosure may refer to one or both of the above standards.

As noted above, one example of a hierarchical set of elements is a set of spherical harmonic coefficients (SHC). The following expression demonstrates a description or representation of a soundfield using SHC:

$$p_i(t, r_r, \theta_r, \varphi_r) = \sum_{\omega=0}^{\infty}\left[4\pi\sum_{n=0}^{\infty} j_n(kr_r)\sum_{m=-n}^{n} A_n^m(k)Y_n^m(\theta_r, \varphi_r)\right]e^{j\omega t},$$

The expression shows that the pressure $p_i$ at any point $\{r_r, \theta_r, \varphi_r\}$ of the soundfield, at time t, can be represented uniquely by the SHC, $A_n^m(k)$. Here, $$k = \frac{\omega}{c},$$

c is the speed of sound (~343 m/s), $\{r_r, \theta_r, \varphi_r\}$ is a point of reference (or observation point), $j_n(\cdot)$ is the spherical Bessel function of order n, and $Y_n^m(\theta_r, \phi_r)$ are the spherical harmonic basis functions (which may also be referred to as a spherical basis function) of order n and suborder m. It can be recognized that the term in square brackets is a frequency-domain representation of the signal (i.e., $S(\omega, r_r, \theta_r, \varphi_r)$) which can be approximated by various time-frequency transformations, such as the discrete Fourier transform (DFT), the discrete cosine transform (DCT), or a wavelet transform. Other examples of hierarchical sets include sets of wavelet transform coefficients and other sets of coefficients of multiresolution basis functions.

FIG. 1 is a diagram illustrating spherical harmonic basis functions from the zero order (n=0) to the fourth order (n=4). As can be seen, for each order, there is an expansion of suborders m which are shown but not explicitly noted in the example of FIG. 1 for ease of illustration purposes.

The SHC $A_n^m(k)$ can either be physically acquired (e.g., recorded) by various microphone array configurations or, alternatively, they can be derived from channel-based or object-based descriptions of the soundfield. The SHC (which also may be referred to as higher order ambisonic—HOA—coefficients) represent scene-based audio, where the SHC may be input to an audio encoder to obtain encoded SHC that may promote more efficient transmission or storage. For example, a fourth-order representation involving $(1+4)^2$ (25, and hence fourth order) coefficients may be used.

As noted above, the SHC may be derived from a microphone recording using a microphone array. Various examples of how SHC may be derived from microphone arrays are described in Poletti, M., "Three-Dimensional Surround Sound Systems Based on Spherical Harmonics," J. Audio Eng. Soc., Vol. 53, No. 11, 2005 November, pp. 1004-1025.

To illustrate how the SHCs may be derived from an object-based description, consider the following equation. The coefficients $A_n^m(k)$ for the soundfield corresponding to an individual audio object may be expressed as:

$$A_n^m(k)=g(\omega)(-4\pi ik)h_n^2)(kr_s)Y_n^{m*}(\theta_s,\varphi_s),$$

where i is $\sqrt{-1}$, $h_n^{(2)}(\cdot)$ is the spherical Hankel function (of the second kind) of order n, and $\{r_s, \theta_s, \varphi_s\}$ is the location of the object. Knowing the object source energy $g(\omega)$ as a function of frequency (e.g., using time-frequency analysis techniques, such as performing a fast Fourier transform on the PCM stream) allows us to convert each PCM object and the corresponding location into the SHC $A_n^m(k)$. Further, it can be shown (since the above is a linear and orthogonal decomposition) that the $A_n^m(k)$ coefficients for each object are additive. In this manner, a number of PCM objects can be represented by the $A_n^m(k)$ coefficients (e.g., as a sum of the coefficient vectors for the individual objects). Essentially, the coefficients contain information about the soundfield (the pressure as a function of 3D coordinates), and the above represents the transformation from individual objects to a representation of the overall soundfield, in the vicinity of the observation point $\{r_r, \theta_r, \varphi_r\}$. The remaining figures are described below in the context of SHC-based audio coding.

Figure 2:
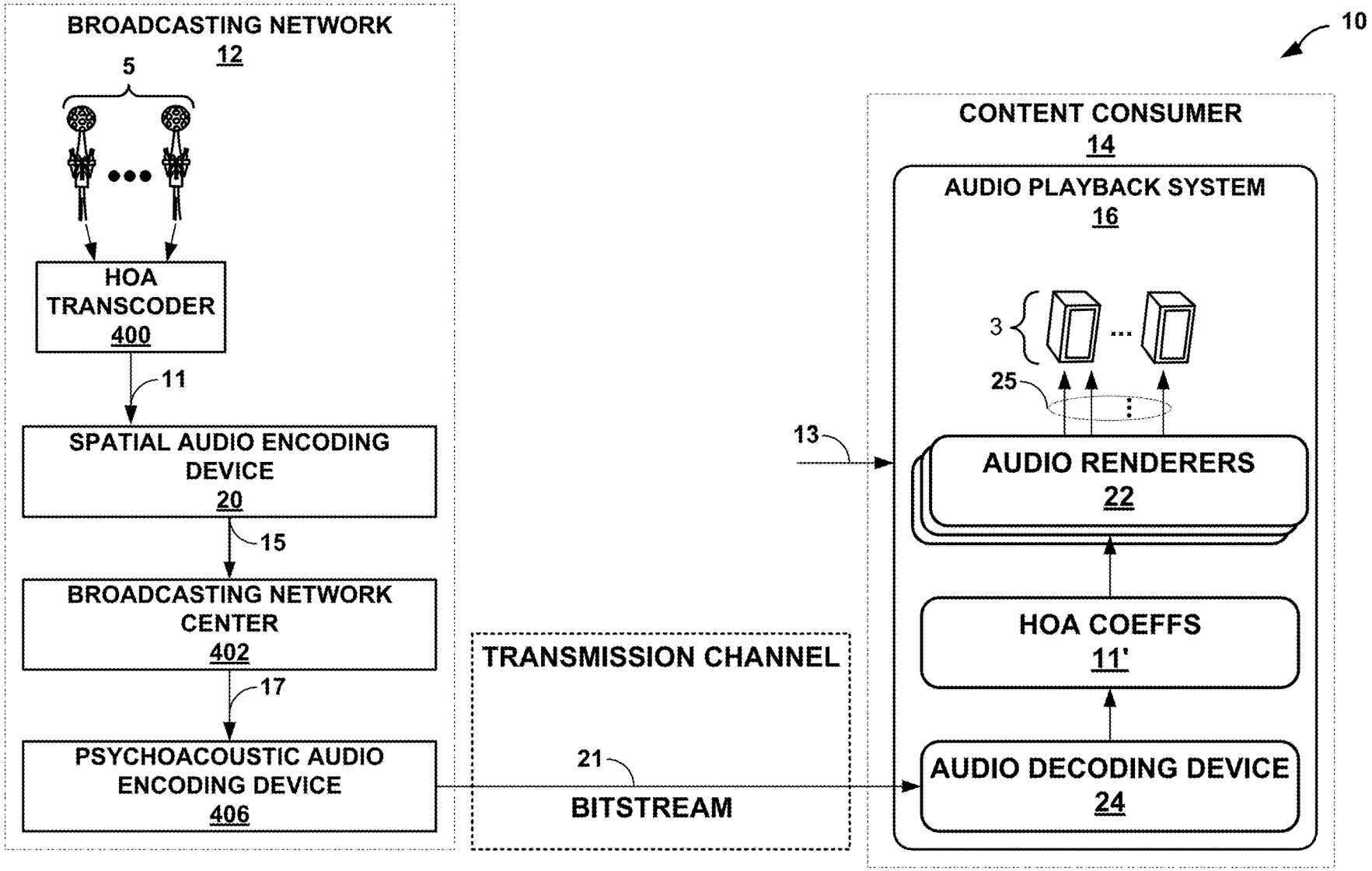
FIG. 2 is a diagram illustrating a system, including a psychoacoustic audio encoding device, that may perform various aspects of the techniques described in this disclosure.

FIG. 2 is a diagram illustrating a system 10 that may perform various aspects of the techniques described in this disclosure. As shown in the example of FIG. 2, the system 10 includes a broadcasting network 12 and a content consumer 14. While described in the context of the broadcasting network 12 and the content consumer 14, the techniques may be implemented in any context in which SHCs (which may also be referred to as HOA coefficients) or any other hierarchical representation of a soundfield are encoded to form a bitstream representative of the audio data. Moreover, the broadcasting network 12 may represent a system comprising one or more of any form of computing devices capable of implementing the techniques described in this disclosure, including a handset (or cellular phone, including a so-called "smart phone"), a tablet computer, a laptop computer, a desktop computer, or dedicated hardware to provide a few examples. Likewise, the content consumer 14 may represent any form of computing device capable of implementing the techniques described in this disclosure, including a handset (or cellular phone, including a so-called "smart phone"), a tablet computer, a television, a set-top box, a laptop computer, a gaming system or console, or a desktop computer to provide a few examples.

The broadcasting network 12 may represent any entity that may generate multi-channel audio content and possibly video content for consumption by content consumers, such as the content consumer 14. The broadcasting network 12 may represent one example of a content provider. The broadcasting network 12 may capture live audio data at events, such as sporting events, while also inserting various other types of additional audio data, such as commentary audio data, commercial audio data, intro or exit audio data and the like, into the live audio content.

The content consumer 14 represents an individual that owns or has access to an audio playback system, which may refer to any form of audio playback system capable of rendering higher order ambisonic audio data (which includes higher order audio coefficients that, again, may also be referred to as spherical harmonic coefficients) for play back as multi-channel audio content. The higher-order ambisonic audio data may be defined in the spherical harmonic domain and rendered or otherwise transformed form the spherical harmonic domain to a spatial domain, resulting in the multi-channel audio content. In the example of FIG. 2, the content consumer 14 includes an audio playback sy stem 16.

The broadcasting network 12 includes microphones 5 that record or otherwise obtain live recordings in various formats (including directly as HOA coefficients) and audio objects. When the microphone array 5 (which may also be referred to as "microphones 5") obtains live audio directly as HOA coefficients, the microphones 5 may include an HOA transcoder, such as an HOA transcoder 400 shown in the example of FIG. 2. In other words, although shown as separate from the microphones 5, a separate instance of the HOA transcoder 400 may be included within each of the microphones 5 so as to naturally transcode the captured feeds into the HOA coefficients 11. However, when not included within the microphones 5, the HOA transcoder 400 may transcode the live feeds output from the microphones 5 into the HOA coefficients 11. In this respect, the HOA transcoder 400 may represent a unit configured to transcode microphone feeds and/or audio objects into the HOA coefficients 11. The broadcasting network 12 therefore includes the HOA transcoder 400 as integrated with the microphones 5, as an HOA transcoder separate from the microphones 5 or some combination thereof.

The broadcasting network 12 may also include a spatial audio encoding device 20, a broadcasting network center 402 (which may also be referred to as a "network operations center"—NOC—402) and a psychoacoustic audio encoding device 406. The spatial audio encoding device 20 may represent a device capable of performing the mezzanine compression techniques described in this disclosure with respect to the HOA coefficients 11 to obtain intermediately formatted audio data 15 (which may also be referred to as "mezzanine formatted audio data 15"). Intermediately formatted audio data 15 may represent audio data that conforms with an intermediate audio format (such as a mezzanine audio format). As such, the mezzanine compression techniques may also be referred to as intermediate compression techniques.

The spatial audio encoding device 20 may be configured to perform this intermediate compression (which may also be referred to as "mezzanine compression") with respect to the HOA coefficients 11 by performing, at least in part, a decomposition (such as a linear decomposition, including a singular value decomposition, eigenvalue decomposition, KLT, etc.) with respect to the HOA coefficients 11. Furthermore, the spatial audio encoding device 20 may perform the spatial encoding aspects (excluding the psychoacoustic encoding aspects) to generate a bitstream conforming to the above referenced MPEG-H 3D audio coding standard. In some examples, the spatial audio encoding device 20 may perform the vector-based aspects of the MPEG-H 3D audio coding standard.

Although described in this disclosure with respect to a bitstream, such as a bitstream having multiple, or in other words, a plurality of transport channels, the techniques may be performed with respect to any type of data object. A data object may refer to any type of formatted data, including the aforementioned bitstream as well as files having multiple tracks, or other types of data objects.

The spatial audio encoding device 20 may be configured to encode the HOA coefficients 11 using a decomposition involving application of a linear invertible transform (LIT). One example of the linear invertible transform is referred to as a "singular value decomposition" (or "SVD"), which may represent one form of a linear decomposition. In this example, the spatial audio encoding device 20 may apply SVD to the HOA coefficients 11 to determine a decomposed version of the HOA coefficients 11.

The decomposed version of the HOA coefficients 11 may include one or more sound components (which may refer to, as one example, an audio object defined in a spatial domain) and/or one or more corresponding spatial components. The sound components having corresponding spatial components may also be referred to as predominant audio signals, or predominant sound components. The sound components may also refer to ambisonic audio coefficients selected from the HOA coefficients 11. While the predominant sound components may be defined in the spatial domain, the spatial component may be defined in the spherical harmonic domain. The spatial component may represent a weighted summation of two or more directional vectors defining shapes, width, and directions of the associated predominant audio signals (which may be referred to in the MPEG-H 3D audio coding standard as a "V-vector").

The spatial audio encoding device 20 may then analyze the decomposed version of the HOA coefficients 11 to identify various parameters, which may facilitate reordering of the decomposed version of the HOA coefficients 11. The spatial audio encoding device 20 may reorder the decomposed version of the HOA coefficients 11 based on the identified parameters, where such reordering, as described in further detail below, may improve coding efficiency given that the transformation may reorder the HOA coefficients across frames of the HOA coefficients (where a frame commonly includes M samples of the HOA coefficients 11 and M is, in some examples, set to 1024).

After reordering the decomposed version of the HOA coefficients 11, the spatial audio encoding device 20 may select those of the decomposed version of the HOA coefficients 11 representative of foreground (or, in other words, distinct, predominant or salient) components of the soundfield. The spatial audio encoding device 20 may specify the decomposed version of the HOA coefficients 11 representative of the foreground components as an audio object (which may also be referred to as a "predominant sound signal," or a "predominant sound component") and associated spatial information (which may also be referred to as a spatial component).

The spatial audio encoding device 20 may next perform a soundfield analysis with respect to the HOA coefficients 11 in order to, at least in part, identify the HOA coefficients 11 representative of one or more background (or, in other words, ambient) components of the soundfield. The spatial audio encoding device 20 may perform energy compensation with respect to the background components given that, in some examples, the background components may only include a subset of any given sample of the HOA coefficients 11 (e.g., such as those corresponding to zero and first order spherical basis functions and not those corresponding to second or higher order spherical basis functions). When order-reduction is performed, in other words, the spatial audio encoding device 20 may augment (e.g., add/subtract energy to/from) the remaining background HOA coefficients of the HOA coefficients 11 to compensate for the change in overall energy that results from performing the order reduction.

The spatial audio encoding device 20 may perform a form of interpolation with respect to the foreground directional information (which again may be another way to refer to the spatial components) and then perform an order reduction with respect to the interpolated foreground directional information to generate order reduced foreground directional information. The spatial audio encoding device 20 may further perform, in some examples, a quantization with respect to the order reduced foreground directional information, outputting coded foreground directional information. In some instances, this quantization may comprise a scalar/entropy quantization.

The spatial audio encoding device 20 may then output the mezzanine formatted audio data 15 as the background components, the foreground audio objects, and the quantized directional information. Each of the background components and the foreground audio objects may be specified in the bitstream as separate pulse code modulated (PCM) transport channels in some examples. Each of the quantized directional information corresponding to each of the foreground audio objects may be specified in the bitstream as sideband information (which may not, in some examples, undergo subsequent psychoacoustic audio encoding/compression to preserve the spatial information). The mezzanine formatted audio data 15 may represent one example of a data object (in the form, in this instance, of a bitstream), and as such may be referred to as a mezzanine formatted data object 15 or mezzanine formatted bitstream 15.

The spatial audio encoding device 20 may then transmit or otherwise output the mezzanine formatted audio data 15 to the broadcasting network center 402. Although not shown in the example of FIG. 2, further processing of the mezzanine formatted audio data 15 may be performed to accommodate transmission from the spatial audio encoding device 20 to the broadcasting network center 402 (such as encryption, satellite compression schemes, fiber compression schemes, etc.).

Mezzanine formatted audio data 15 may represent audio data that conforms to a so-called mezzanine format, which is typically a lightly compressed (relative to end-user compression provided through application of psychoacoustic audio encoding to audio data, such as MPEG surround, MPEG-AAC, MPEG-USAC or other known forms of psychoacoustic encoding) version of the audio data. Given that broadcasters prefer dedicated equipment that provides low latency mixing, editing, and other audio and/or video functions, broadcasters are reluctant to upgrade the equipment given the cost of such dedicated equipment.

To accommodate the increasing bitrates of video and/or audio and provide interoperability with older or, in other words, legacy equipment that may not be adapted to work on high definition video content or 3D audio content, broadcasters have employed this intermediate compression scheme, which is generally referred to as "mezzanine compression," to reduce file sizes and thereby facilitate transfer times (such as over a network or between devices) and improved processing (especially for older legacy equipment). In other words, this mezzanine compression may provide a more lightweight version of the content which may be used to facilitate editing times, reduce latency and potentially improve the overall broadcasting process.

The broadcasting network center 402 may therefore represent a system responsible for editing and otherwise processing audio and/or video content using an intermediate compression scheme to improve the work flow in terms of latency. The broadcasting network center 402 may, in some examples, include a collection of mobile devices. In the context of processing audio data, the broadcasting network center 402 may, in some examples, insert intermediately formatted additional audio data into the live audio content represented by the mezzanine formatted audio data 15. This additional audio data may comprise commercial audio data representative of commercial audio content (including audio content for television commercials), television studio show audio data representative of television studio audio content, intro audio data representative of intro audio content, exit audio data representative of exit audio content, emergency audio data representative of emergency audio content (e.g., weather warnings, national emergencies, local emergencies, etc.) or any other type of audio data that may be inserted into mezzanine formatted audio data 15.

In some examples, the broadcasting network center 402 includes legacy audio equipment capable of processing up to 16 audio channels. In the context of 3D audio data that relies on HOA coefficients, such as the HOA coefficients 11, the HOA coefficients 11 may have more than 16 audio channels (e.g., a $4^{th}$ order representation of the 3D soundfield would require $(4+1)^2$ or 25 HOA coefficients per sample, which is equivalent to 25 audio channels). This limitation in legacy broadcasting equipment may slow adoption of 3D HOA-based audio formats, such as that set forth in the ISO/IEC DIS 23008-3:201x(E) document, entitled "Information technology—High efficiency coding and media delivery in heterogeneous environments—Part 3: 3D audio," by ISO/IEC JTC 1/SC 29/WG 11, dated 2016 Oct. 12 (which may be referred to herein as the "3D Audio Coding Standard" or the "MPEG-H 3D Audio Coding Standard").

As such, the mezzanine compression allows for obtaining the mezzanine formatted audio data 15 from the HOA coefficients 11 in a manner that overcomes the channel-based limitations of legacy audio equipment. That is, the spatial audio encoding device 20 may be configured to obtain the mezzanine audio data 15 having 16 or fewer audio channels (and possibly as few as 6 audio channels given that legacy audio equipment may, in some examples, allow for processing 5.1 audio content, where the '0.1' represents the sixth audio channel).

The broadcasting network center 402 may output updated mezzanine formatted audio data 17. The updated mezzanine formatted audio data 17 may include the mezzanine formatted audio data 15 and any additional audio data inserted into the mezzanine formatted audio data 15 by the broadcasting network center 404. Prior to distribution, the broadcasting network 12 may further compress the updated mezzanine formatted audio data 17. As shown in the example of FIG. 2, the psychoacoustic audio encoding device 406 may perform psychoacoustic audio encoding (e.g., any one of the examples described above) with respect to the updated mezzanine formatted audio data 17 to generate a bitstream 21. The broadcasting network 12 may then transmit the bitstream 21 via a transmission channel to the content consumer 14.

In some examples, the psychoacoustic audio encoding device 406 may represent multiple instances of a psychoacoustic audio coder, each of which is used to encode a different audio object or HOA channel of each of updated mezzanine formatted audio data 17. In some instances, this psychoacoustic audio encoding device 406 may represent one or more instances of an advanced audio coding (AAC) encoding unit. Often, the psychoacoustic audio coder unit 40 may invoke an instance of an AAC encoding unit for each channel of the updated mezzanine formatted audio data 17.

More information regarding how the background spherical harmonic coefficients may be encoded using an AAC encoding unit can be found in a convention paper by Eric Hellerud, et al., entitled "Encoding Higher Order Ambisonics with AAC," presented at the 124$^{th}$ Convention, 2008 May 17-20 and available at: http://ro.uow.edu.au/cgi/viewcontent.cgi?article=8025&context=engpapers. In some instances, the psychoacoustic audio encoding device 406 may audio encode various channels (e.g., background channels) of the updated mezzanine formatted audio data 17 using a lower target bitrate than that used to encode other channels (e.g., foreground channels) of the updated mezzanine formatted audio data 17.

While shown in FIG. 2 as being directly transmitted to the content consumer 14, the broadcasting network 12 may output the bitstream 21 to an intermediate device positioned between the broadcasting network 12 and the content consumer 14. The intermediate device may store the bitstream 21 for later delivery to the content consumer 14, which may request this bitstream. The intermediate device may comprise a file server, a web server, a desktop computer, a laptop computer, a tablet computer, a mobile phone, a smart phone, or any other device capable of storing the bitstream 21 for later retrieval by an audio decoder. The intermediate device may reside in a content delivery network capable of streaming the bitstream 21 (and possibly in conjunction with transmitting a corresponding video data bitstream) to subscribers, such as the content consumer 14, requesting the bitstream 21. Alternately, the intermediate device may reside within broadcasting network 12.

Alternatively, the broadcasting network 12 may store the bitstream 21 to a storage medium as a file, such as a compact disc, a digital video disc, a high definition video disc or other storage media, most of which are capable of being read by a computer and therefore may be referred to as computer-readable storage media or non-transitory computer-readable storage media. In this context, the transmission channel may refer to those channels by which content stored to these mediums are transmitted (and may include retail stores and other store-based delivery mechanism). In any event, the techniques of this disclosure should not therefore be limited in this respect to the example of FIG. 2. As a file, the transport channels to which various aspects of the decomposed version of the HOA coefficients 11 are stored may be referred to as tracks.

As further shown in the example of FIG. 2, the content consumer 14 includes the audio playback system 16. The audio playback system 16 may represent any audio playback system capable of playing back multi-channel audio data. The audio playback system 16 may include a number of different audio renderers 22. The audio renderers 22 may each provide for a different form of rendering, where the different forms of rendering may include one or more of the various ways of performing vector-base amplitude panning (VBAP), and/or one or more of the various ways of performing soundfield synthesis.

The audio playback system 16 may further include an audio decoding device 24. The audio decoding device 24 may represent a device configured to decode HOA coefficients 11' from the bitstream 21, where the HOA coefficients 11' may be similar to the HOA coefficients 11 but differ due to lossy operations (e.g., quantization) and/or transmission via the transmission channel.

That is, the audio decoding device 24 may dequantize the foreground directional information specified in the bitstream 21, while also performing psychoacoustic decoding with respect to the foreground audio objects specified in the bitstream 21 and the encoded HOA coefficients representative of background components. The audio decoding device 24 may further perform interpolation with respect to the decoded foreground directional information and then determine the HOA coefficients representative of the foreground components based on the decoded foreground audio objects and the interpolated foreground directional information. The audio decoding device 24 may then determine the HOA coefficients 11' based on the determined HOA coefficients representative of the foreground components and the decoded HOA coefficients representative of the background components.

The audio playback system 16 may, after decoding the bitstream 21 to obtain the HOA coefficients 11', render the HOA coefficients 11' to output loudspeaker feeds 25. The audio playback system 15 may output loudspeaker feeds 25 to one or more of loudspeakers 3. The loudspeaker feeds 25 may drive one or more loudspeakers 3.

To select the appropriate renderer or, in some instances, generate an appropriate renderer, the audio playback system 16 may obtain loudspeaker information 13 indicative of a number of the loudspeakers 3 and/or a spatial geometry of the loudspeakers 3. In some instances, the audio playback system 16 may obtain the loudspeaker information 13 using a reference microphone and drive the loudspeakers 3 in such a manner as to dynamically determine the loudspeaker information 13. In other instances or in conjunction with the dynamic determination of the loudspeaker information 13, the audio playback system 16 may prompt a user to interface with the audio playback system 16 and input the loudspeaker information 13.

The audio playback system 16 may select one of the audio renderers 22 based on the loudspeaker information 13. In some instances, the audio playback system 16 may, when none of the audio renderers 22 are within some threshold similarity measure (in terms of the loudspeaker geometry) to that specified in the loudspeaker information 13, generate the one of audio renderers 22 based on the loudspeaker information 13. The audio playback system 16 may, in some instances, generate the one of audio renderers 22 based on the loudspeaker information 13 without first attempting to select an existing one of the audio renderers 22.

While described with respect to loudspeaker feeds 25, the audio playback system 16 may render headphone feeds from either the loudspeaker feeds 25 or directly from the HOA coefficients 11', outputting the headphone feeds to headphone speakers. The headphone feeds may represent binaural audio speaker feeds, which the audio playback system 15 renders using a binaural audio renderer.

As noted above, the spatial audio encoding device 20 may analyze the soundfield to select a number of HOA coefficients (such as those corresponding to spherical basis functions having an order of one or less) to represent am ambient component of the soundfield. The spatial audio encoding device 20 may also, based on this or another analysis, select a number of predominant audio signals and corresponding spatial components to represent various aspects of a foreground component of the soundfield, discarding any remaining predominant audio signals and corresponding spatial components.

The spatial audio encoding device 20 may specify these various components of the soundfield in separate transport channels (or, in the example of files, tracks) of the bitstream (or, in the example of tracks, files). The psychoacoustic audio encoding device 406 may then further reduce the number of transport channels (or tracks) when forming bitstream 21 (which may also be illustrative of files, and as such may be referred to as "files 21" or, more generally, "data object 21," which may refer to both bitstreams and/or files). The psychoacoustic audio encoding device 406 may reduce the number of transport channels to generate bitstream 21 that achieves a specified target bitrate. The target bitrate may be mandated by broadcasting network 12, determined through analysis of transmission channel 21, requested by audio playback system 16, or obtained through any other mechanism employed to determine a target bitrate.

The psychoacoustic audio encoding device 406 may implement any number of different processes by which to select the non-zero subset of the transport channels of the mezzanine formatted audio data 15 (which is included in updated mezzanine formatted audio data 15). Reference to a "subset" in this disclosure is intended to refer to a "non-zero subset" having less data than the total number of elements in the larger set unless explicitly noted otherwise, and not the strict mathematical definition of a subset that would include zero or more elements of the larger set up to total elements of the larger set. However, the psychoacoustic audio encoding device 406 may not have sufficient time (e.g., when live broadcasting) or computational capacity to perform detailed analysis that enable accurate identification of which transport channels of the larger set of transport channels set forth in the mezzanine formatted audio data 15 are to be specified in the bitstream 21 while still preserving adequate audio quality (and limiting injection of audio artifacts that decrease perceived audio quality).

Furthermore, as noted above, the spatial audio encoding device 20 may specify the background components (or, in other words, the ambient HOA coefficients) to transport channels of bitstream 15, while specifying foreground components (or, in other words, the predominant sound components) and the corresponding spatial components to transport channels of bitstream 15 and sideband information, respectively. Having to specify the background components in a manner differently than foreground components (in that the foreground components also include the corresponding spatial components) may result in bandwidth inefficiencies, due to having to signal separate transport channel formats to identify which of the transport channels specify a background component and which of the transport channels specify a foreground component.

The signaling of transport format results in memory, storage, and/or bandwidth inefficiencies as the transport format is signaled on a per transport channel basis for every frame, resulting in increased bitstream size (as bitstreams may include thousands, hundreds of thousands, millions, and possible tens of millions of frames), leading to potentially larger memory and/or storage space consumption, slower retrieval of the bitstream from memory and/or storage space, increased internal memory bus bandwidth consumption, increased network bandwidth consumption, etc. These memory, storage, and/or bandwidth inefficiencies may impact operation of the underlying computing devices themselves.

In accordance with the techniques described in this disclosure, the spatial audio encoding device 20 may determine, based on one or more of the sound component and the corresponding spatial component, priority information indicative of a priority of the sound component relative to other sound components of the soundfield represented by the HOA coefficients 11. As noted above, the term "sound component" may refer to both a predominant sound component (e.g., an audio object defined in a spatial domain), and an ambient HOA coefficient (which is defined in the spherical harmonic domain). The corresponding spatial component may refer to the above noted V-vector, which defines shape, width, and directions of the predominant sound component, and is also defined in a spherical harmonic domain.

The spatial audio encoding device 20 may determine the priority information in a number of different ways. For example, the spatial audio encoding device 20 may determine an energy of the sound component or of an HOA representation of the sound component. To determine the energy of the HOA representation of the sound component, the spatial audio encoding device 20 may multiply the sound component by the corresponding spatial component (or, in some instances, a transpose of the corresponding spatial component) to obtain the HOA representation of the sound component, and then determine the energy of the HOA representation of the sound component.

The spatial audio encoding device 20 may next determine, based on the determined energy, the priority information. In some examples, the spatial audio encoding device 20 may determine the energy for each sound component decomposed from the HOA coefficients 11 (or the HOA representation of each sound component). The spatial audio encoding device 20 may determine a highest priority for the sound component having the highest energy (where the highest priority may be denoted by a lowest priority value or a highest priority value relative to the other priority values), a second highest priority for the sound component having the second highest energy, etc.

Although described with respect to energy, the spatial audio encoding device 20 may determine a loudness measure of the sound component or the HOA representation of the sound component. The spatial audio encoding device 20 may determine, based on the loudness measure, the priority information. Moreover, in some examples, the spatial audio encoding device 20 may determine both an energy and a loudness measure of the sound component, and next determine, based on one or more of the energy and the loudness measure, the priority information.

In this and other examples, the spatial audio encoding device 20 may, to determine the energy or the loudness measure, render the HOA representation of the sound component to one or more speaker feeds. The spatial audio encoding device 20 may render the HOA representation of the sound component to, as one example, the one or more speakers feeds suited for speakers arranged in a regular geometry (such as the speaker geometry defined for 5.1, 7.1, 10.2, 22.2, and other uniform surround sound formats, including those introducing speakers on multiple heights, such as 5.1.2, 5.1.4, etc. where the third numeral (e.g., the 2 in 5.1.2 or 4 in 5.1.4) indicates the number of speakers on the higher horizontal plane). The spatial audio encoding device 20 may then determine, based on the one or more speaker feeds, the energy and/or the loudness measure.

In this and other examples, the spatial audio encoding device 20 may determine, based on the spatial component, a spatial weighting indicative of a relevance of the sound component to the soundfield. To illustrate, the spatial audio encoding device 20 may determine a spatial weighting indicating that the corresponding current sound component is located in the soundfield at approximately head-height, directly in front of the listener, which indicates that the current sound component is likely to be of relatively more importance in comparison to other sound components located in the soundfield to the right, left, above, or below the current sound component.

The spatial audio encoding device 20 may determine, based on the spatial component and as another illustration, that the current sound component is higher in the soundfield, which may be indicative of the current sound component being of relatively more importance than those below head-height, as the human auditory system is more sensitive to sound arriving from above the head than sounds arriving from below the head. Likewise, the spatial audio encoding device 20 may determine a spatial weighting indicating that the sound component is in front of the listener's head and potentially of more importance than other sound components located behind the listener's head as the human auditory system is more sensitive to sound arriving from in front of the listener's head relative to sounds arriving at the listener's head from behind. The spatial audio encoding device 20 may determine, as yet another example, based on one or more of the energy, the loudness measure, and the spatial weighting, the priority information.

In these and other examples, the spatial audio encoding device 20 may determine a continuity indication indicative of whether a current portion (e.g., a current frame in the case of a transport channel in the bitstream 15 or a current track in the case of a file) defines the same sound component as a previous portion (e.g., a previous frame of the same transport channel in the bitstream 15 or a previous track in the case of a file). Based on the continuity indication, the spatial audio encoding device 20 may determine the priority information. The spatial audio encoding device 20 may assign sound components having positive continuity indications across portions a higher priority than sound components having negative continuity indications as continuity in audio scenes is generally more important (in terms of a positive listening experience in terms of quality and noticeable artifacts) relative to failures to inject new sound components at the correct time.

In these and other examples, the spatial audio encoding device 20 may perform signal classification with respect to the sound component, the higher order ambisonic representation of the sound component and/or the one or more rendered speaker feeds to determine a class to which the sound component corresponds. As one example, the spatial audio encoding device 20 may perform signal classification to identify whether the sound component belongs to a speech class or a non-speech class, where the speech class indicates that the sound component is primarily speech content, while the non-speech class indicates that the sound component is primarily non-speech content.

The spatial audio encoding device 20 may then determine, based on the class, the priority information. The spatial audio encoding device 20 may assign sound components associated with the speech class with a higher priority compared to sound components associated with the non-speech class, as speech content is generally more important to a given audio scene than non-speech content.

As yet another example, the spatial audio encoding device 20 may obtain, from the content provider providing the HOA audio data (which may refer to the HOA coefficients 11 among other metadata or audio data), a preferred priority of the sound component relative to other sound components of the soundfield. That is, the content provider may indicate which locations in the 3D soundfield have a higher priority (or, in other words, a preferred priority) than other locations in the soundfield. The spatial audio encoding device 20 may determine, based on the preferred priority, the priority information.

Although described above as determining the priority information based on various combinations of different types of data, the spatial audio encoding device 20 may determine the priority information based on one or more of the energy, the loudness measure, the spatial weighting, the continuity indication, the preferred priority, and the class, as a few examples. A number of detailed examples of different combination are described below with respect to FIGS. 8A-8F.

The spatial audio encoding device 20 may specify, in the bitstream 15 representative of a compressed version of the HOA coefficients 11, the sound component and the priority information. In some examples, the spatial audio encoding device 20 may specify a plurality of sound components and priority information indicative of a priority of each of the plurality of sound components relative to remaining ones of the sound components.

The psychoacoustic audio encoding device 406 may obtain, from the bitstream 15 (embedded in the bitstream 17), the plurality of sound components and the priority information indicative of the priority of each of the plurality of sound components relative to remaining ones of the sound components. The psychoacoustic audio encoding device 406 may select, based on the priority information, a non-zero subset of the plurality of sound components.

As noted above, the psychoacoustic audio encoding device 406 may have different channel or track constraints than the spatial audio encoding device 20 had when formulating the bitstream 15, where the psychoacoustic audio encoding device 406 may have a reduced number of channels or tracks by which to specify the sound components relative to the spatial audio encoding device 20. Using the priority information, the psychoacoustic audio encoding device 406 may more efficiently identify the more important sound components that should undergo psychoacoustic encoding, and thereby result in a better quality representation of the HOA coefficients 11.

The efficiencies gained by using the priority information come as a result of reducing the computational operations performed by the psychoacoustic audio encoding device 406 (and reducing memory consumption resulting from performing increased computation operations), while also improving the speed with which the psychoacoustic audio encoding device 406 may encode the bitstream 21. Furthermore, the foregoing aspects of the techniques may reduce energy consumption and prolong potential operating times (e.g., for devices reliant on batteries or other forms of mobile power supply), which impact operation of the psychoacoustic audio encoding device 406 itself.

Additionally, the above aspects of the techniques may solve a problem rooted in technology itself given the nature of the computer broadcasting given that the psychoacoustic audio encoding device 406 may not have sufficient time (e.g., when live broadcasting) or computational capacity to perform detailed analysis that enables accurate identification of which transport channels of the larger set of transport channels set forth in the mezzanine formatted audio data 15 are to be specified in the bitstream 21 while still preserving adequate audio quality (and limiting injection of audio artifacts that decrease perceived audio quality). The above noted techniques solve this problem by allowing the spatial audio encoding device 20 (which already performs many if not all of the determinations related to energy, loudness, continuity, class, etc. of sound components for purposes of compression) to leverage the functionality used for compression to identify the priority information that may allow the psychoacoustic audio encoding device 406 to rapidly select the transport channels that should be specified in the bitstream 21.

In addition to specifying the sound components, the psychoacoustic audio encoding device 406 may also obtain a spatial component corresponding to each of the plurality of sound components, and specify, in the bitstream 21, a non-zero subset of the spatial components corresponding to the non-zero subset of the plurality of sound components. After specifying the various sound components and corresponding spatial components, the psychoacoustic audio encoding device 406 may perform psychoacoustic audio encoding to obtain the bitstream 21.

In addition or as an alternative to the above described aspects of the techniques, the spatial audio encoding device 20 may specify both types of sound components (e.g., the ambient HOA coefficients and the predominant sound components) using a unified format that results in associating a repurposed spatial component to each of the ambient HOA coefficients. The repurposed spatial component may be indicative of one or more of an order and a sub-order of a spherical basis function to which the ambient higher order ambisonic coefficient corresponds.

The format is unified in the sense that both types of the sound components are specified with a corresponding spatial component having a same number of elements. In the case of the repurposed spatial component, the spatial audio encoder device 20 may utilize a spatial component having a same number of elements as the spatial components corresponding to the predominant sound components, but repurpose the spatial component to specify a value of one for a single one of the elements that indicates the order and/or the sub-order of the spherical basis function to which the ambient HOA coefficient corresponds.

That is, the repurposed spatial component comprises a vector having a number of elements equal to a maximum order (N) plus one squared $(N+1)^2$, where the maximum order is defined as a maximum order of the spherical basis functions to which the HOA coefficients 11 corresponds. The vector identifies the order and the sub-order by having a value of one for one of the elements and a value of zero for the remaining elements of the vector. The spatial audio encoding device 20 may specify, in the data object and according to the same format, the ambient higher order ambisonic coefficient and the corresponding repurposed spatial component without specifying, in the data object, the order and the sub-order of the ambient higher order ambisonic coefficient.

To identify the correct order and/or suborder, the spatial audio encoder device 20 may obtain a harmonic coefficient ordering format indicator indicative of either a symmetric harmonic coefficient ordering format or a linear harmonic coefficient ordering format for the HOA coefficients. More information regarding the harmonic coefficient ordering format indicator, the symmetric harmonic coefficient, and the linear harmonic coefficient ordering format can be found in U.S. Patent Publication No. US 2015/0243292, entitled "ORDER FORMAT SIGNALING FOR HIGHER_ORDER AMBISONIC AUDIO DATA," by Morrell, M. et. al, published on Aug. 27, 2015. The spatial audio encoder device 20 may obtain, based on the harmonic coefficient ordering format indicator, the repurposed vector. The element of the vector set to a value of one indicates the order and/or the suborder of the spherical basis function to which the corresponding ambient HOA coefficient corresponds by identifying which of the spherical basis functions the ambient HOA coefficient corresponds to when the spherical basis function are ordered according to the indicated ordering format (either symmetric or linear).

The spatial audio encoder device 20 may then specify, in the bitstream 15 and according to a format (e.g., a transport format or a track format), the predominant sound component and the corresponding spatial component. The spatial audio encoder device 20 may also specify, in the bitstream 15 and according to the same format, the ambient higher order ambisonic coefficient and the corresponding repurposed spatial component.

The foregoing unified format aspects of the techniques may avoid repeated signaling of the transport format for each transport channel, replacing the signaling of the transport format for each transport channel with the repurposed spatial component, which can be potentially predicted from previous frames, thereby resulting in various efficiencies similar to those described above that result in improvements in the device itself (in terms of decreasing storage consumption, processing cycles—or, in other words, performance of computation operations—bandwidth consumption, etc.).

The audio decoding device 24 may receive the bitstream 21 having the transport channels specified according to the unified format. The audio decoding device 24 may obtain, from the bitstream 21 (which again is one example of a data object) and according to a format, an ambient higher order ambisonic coefficient descriptive of an ambient component of the soundfield. The audio decoding device 24 may also, obtain, from the bitstream 21, a repurposed spatial component corresponding to the ambient higher order ambisonic coefficient. The audio decoding device 24 may further obtain, from the bitstream 21 and according to the same format, the predominant sound component, while also obtaining, from the bitstream 21, the corresponding spatial component. Prior to obtaining the various components noted above, the audio decoding device 24 may perform psychoacoustic audio decoding with respect to the bitstream 21 in a manner reciprocal to the psychoacoustic audio encoding performed by psychoacoustic audio encoding device 406 to obtain a bandwidth decompressed version of the bitstream 21.

The audio decoding device 24 may then operate in the manner described above to reconstruct and then output the reconstructed HOA coefficients 11' or in the manner set forth in Annex G of the second edition of the MPEG-H 3D Audio Coding Standard referenced above to render, based on the ambient higher order ambisonic coefficient, the repurposed spatial component, the predominant sound component, and the corresponding spatial component, one or more speaker feeds 25 (which in the latter case effectively incorporates audio renderers 22 into audio decoding device 24). Audio playback system 16 may next output, to one or more speakers 3, the one or more speaker feeds 25.

The audio decoding device 24 may obtain, from the bitstream 21, a harmonic coefficient ordering format indicator, and determine, based on the harmonic coefficient ordering format indicator, the repurposed vector, and in a manner reciprocal to that described above with respect to the spatial audio encoding device 20, the order and the sub-order of the spherical basis function to which the higher order ambisonic coefficient corresponds. The audio decoding device 24 may associate, prior to rendering the one or more speaker feeds 25, the ambient higher order ambisonic coefficient with the spherical basis function having the determined order and sub-order.

Although the audio playback system 16 is not shown relative to a larger location, a television, an automobile, headphones, or a headset including the headphones may include the audio playback system 16 in which the one or more speakers 3 are included as integrated speakers 3. When integrated into headphones or a headset including the headphones, the audio playback system 16 may render the speaker feeds 25 as one or more binaural audio headphone feeds.

Figure 5A:
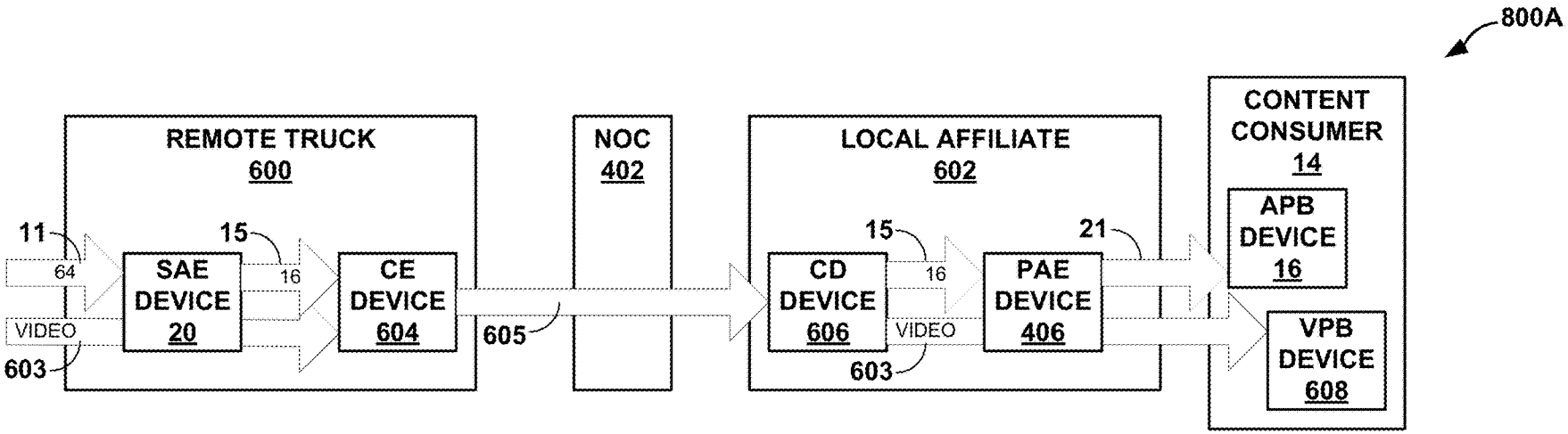
FIGS. 5A and 5B are block diagrams illustrating examples of the system of FIG. 2 in more detail.
Figure 5B:
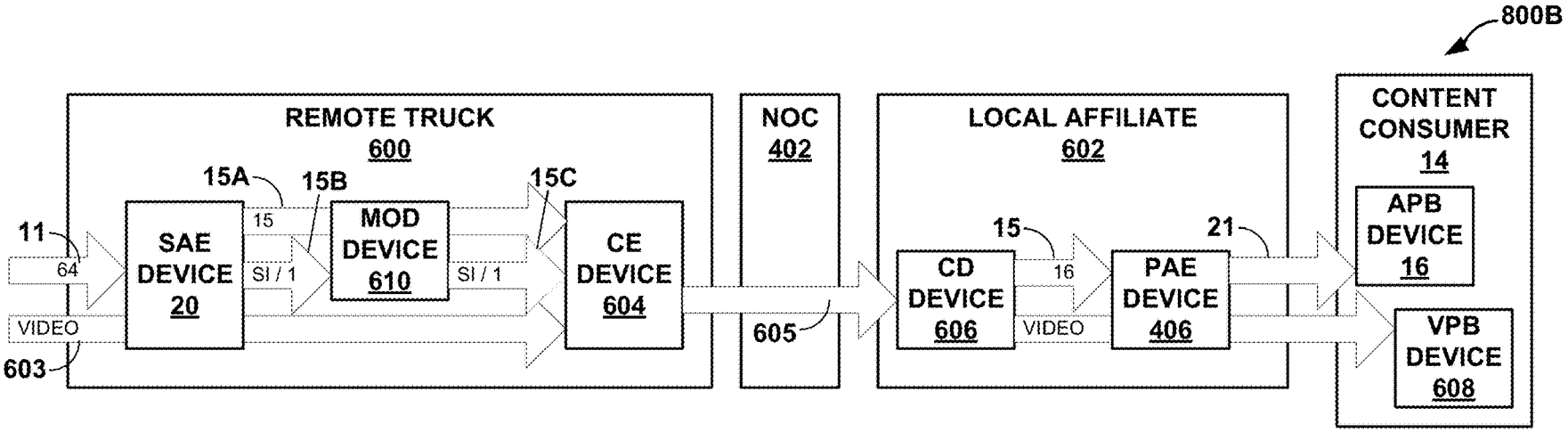

FIGS. 5A and 5B are block diagrams illustrating examples of the system 10 of FIG. 2 in more detail. As shown in the example of FIG. 5A, system 800A is an example of system 10, where system 800A includes a remote truck 600, the network operations center (NOC) 402, a local affiliate 602, and the content consumer 14. The remote truck 600 includes the spatial audio encoding device 20 (shown as "SAE device 20" in the example of FIG. 5A) and a contribution encoder device 604 (shown as "CE device 604" in the example of FIG. 5A).

The SAE device 20 operates in the manner described above with respect to the spatial audio encoding device 20 described above with respect to the example of FIG. 2. The SAE device 20, as shown in the example of FIG. 5A, receives 64 HOA coefficients 11 and generates the intermediately formatted bitstream 15 including 16 channels—15 channels of predominant audio signals and ambient HOA coefficients, and 1 channel of sideband information defining the spatial components corresponding to the predominant audio signals and adaptive gain control (AGC) information among other sideband information.

The CE device 604 operates with respect to the intermediately formatted bitstream 15 and video data 603 to generate mixed-media bitstream 605. The CE device 604 may perform lightweight compression with respect to intermediately formatted audio data 15 and video data 603 (e.g., captured concurrent to the capture of the HOA coefficients 11). The CE device 604 may multiplex frames of the compressed intermediately formatted audio bitstream 15 and the compressed video data 603 to generate the mixed-media bitstream 605. The CE device 604 may transmit the mixed-media bitstream 605 to NOC 402 for further processing as described above.

The local affiliate 602 may represent a local broadcasting affiliate, which broadcasts the content represented by the mixed-media bitstream 605 locally. The local affiliate 602 may include a contribution decoder device 606 (shown as "CD device 606" in the example of FIG. 5A) and a psychoacoustic audio encoding device 406 (shown as "PAE device 406" in the example of FIG. 5A). The CD device 606 may operate in a manner that is reciprocal to operation of the CE device 604. As such, the CD device 606 may demultiplex the compressed versions of the intermediately formatted audio bitstream 15 and the video data 603 and decompress both the compressed versions of the intermediately formatted audio bitstream 15 and the video data 603 to recover the intermediately formatted bitstream 15 and the video data 603. The PAE device 406 may operate in the manner described above with respect to the psychoacoustic audio encoder device 406 shown in FIG. 2 to output the bitstream 21. The PAE device 406 may be referred to, in the context of broadcasting systems, as an "emission encoder 406."

The emission encoder 406 may transcode the bitstream 15, updating the hoaIndependencyFlag syntax element depending on whether the emission encoder 406 utilized prediction between audio frames or not, while also potentially changing the value of the number of predominant sound components syntax element when selecting the non-zero subset of the transport channels according to the priority information, and the value of the number of ambient HOA coefficients syntax element. The emission encoder 406 may change the hoaIndependentFlag syntax element, the number of predominant sound components syntax element and the number of ambient HOA coefficients syntax element to achieve a target bitrate.

Although not shown in the example of FIG. 5A, the local affiliate 602 may include further devices to compress the video data 603. Moreover, although described as being distinct devices (e.g., the SAE device 20, the CE device 604, the CD device 606, the PAE device 406, the APB device 16, and a VPB device 608 described below in more detail, etc.), the various devices may be implemented as distinct units or hardware within one or more devices.

The content consumer 14 shown in the example of FIG. 5A includes the audio playback device 16 described above with respect to the example of FIG. 2 (shown as "APB device 16" in the example of FIG. 5A) and a video playback (VPB) device 608. The APB device 16 may operate as described above with respect to FIG. 2 to generate multichannel audio data 25 that are output to speakers 3 (which may refer to loudspeakers or speakers integrated into headphones, earbuds, headsets—which include headphones but also may include transducers to detect spoken or other audio signals, etc.). The VPB device 608 may represent a device configured to playback video data 603, and may include video decoders, frame buffers, displays, and other components configured to playback video data 603.

System 800B shown in the example of FIG. 5B is similar to the system 800A of FIG. 5B except that the remote truck 600 includes an additional device 610 configured to perform modulation with respect to the sideband information (SI) 15B of the bitstream 15 (where the other 15 channels are denoted as "channels 15A" or "transport channels 15A"). The additional device 610 is shown in the example of FIG. 5B as "mod device 610." The modulation device 610 may perform modulation of sideband information 610 to potentially reduce clipping of the sideband information and thereby reduce signal loss.

Figure 3A:
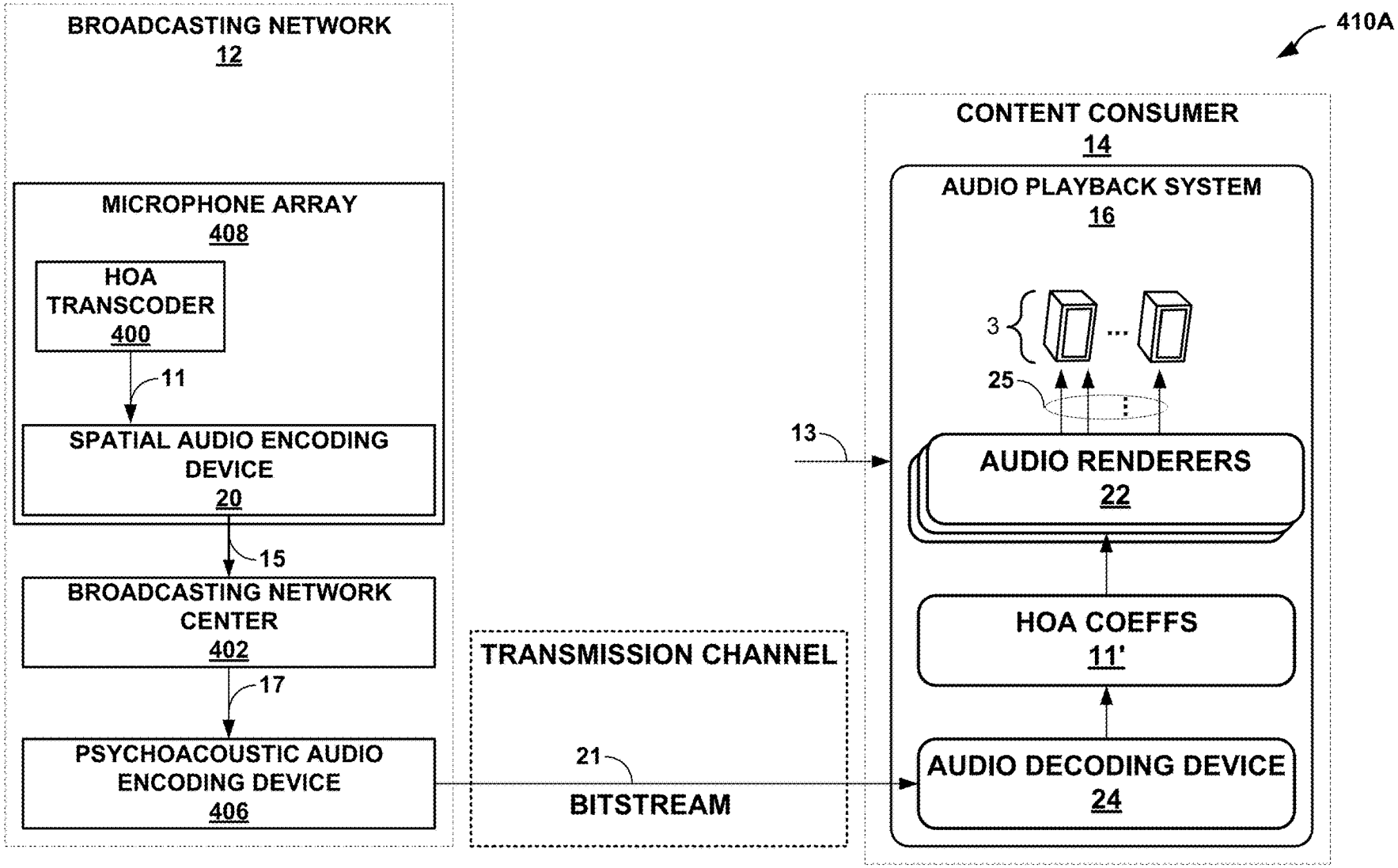
FIGS. 3A-3D are diagrams illustrating different examples of the system shown in the example of FIG. 2.

FIGS. 3A-3D are block diagrams illustrating different examples of a system that may be configured to perform various aspects of the techniques described in this disclosure. The system 410A shown in FIG. 3A is similar to the system 10 of FIG. 2, except that the microphone array 5 of the system 10 is replaced with a microphone array 408. The microphone array 408 shown in the example of FIG. 3A includes the HOA transcoder 400 and the spatial audio encoding device 20. As such, the microphone array 408 generates the spatially compressed HOA audio data 15, which is then compressed using the bitrate allocation in accordance with various aspects of the techniques set forth in this disclosure.

Figure 3B:
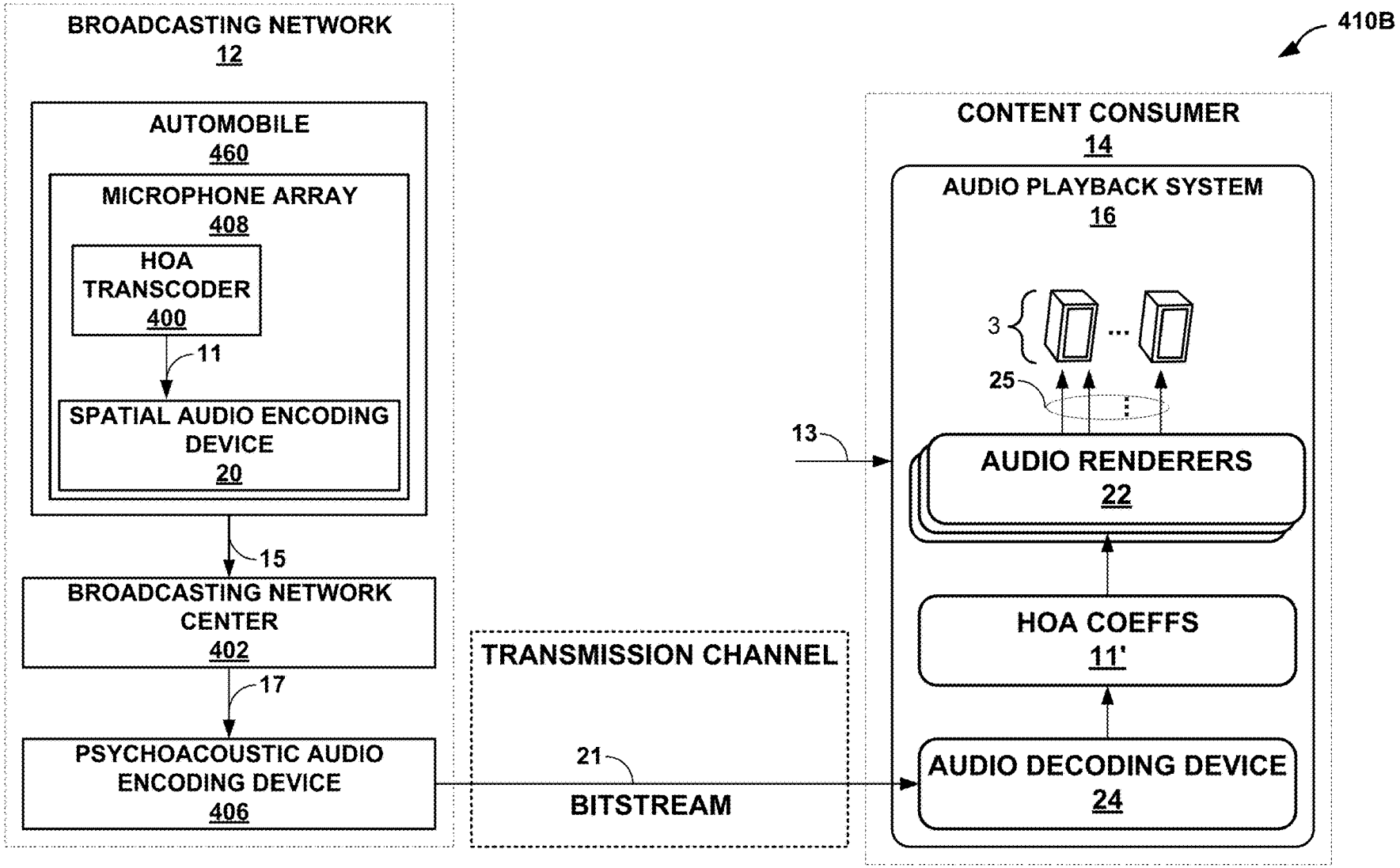

The system 410B shown in FIG. 3B is similar to the system 410A shown in FIG. 3A except that an automobile 460 includes the microphone array 408. As such, the techniques set forth in this disclosure may be performed in the context of automobiles.

Figure 3C:
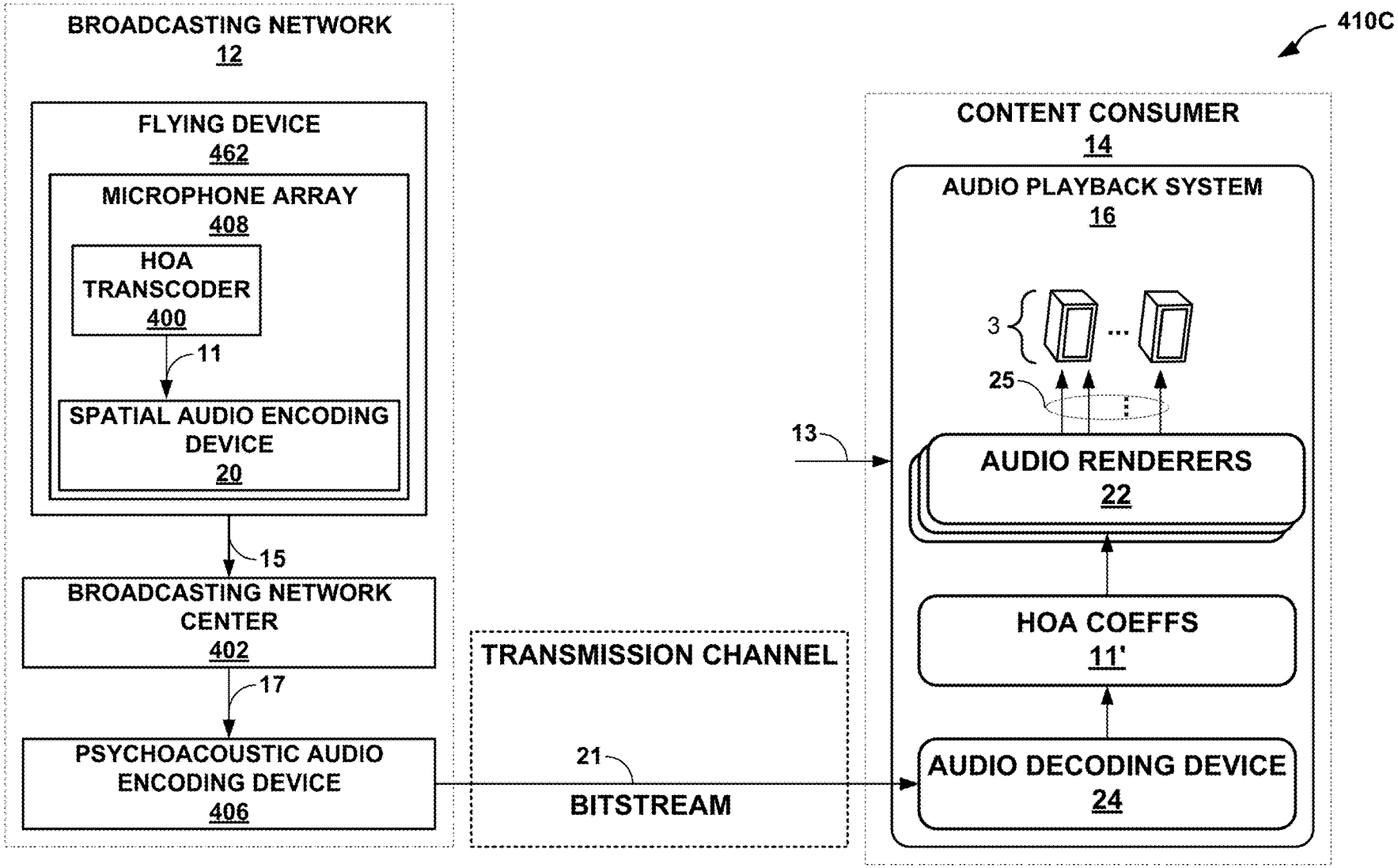

The system 410C shown in FIG. 3C is similar to the system 410A shown in FIG. 3A except that a remotely-piloted and/or autonomous controlled flying device 462 includes the microphone array 408. The flying device 462 may for example represent a quadcopter, a helicopter, or any other type of drone. As such, the techniques set forth in this disclosure may be performed in the context of drones.

Figure 3D:
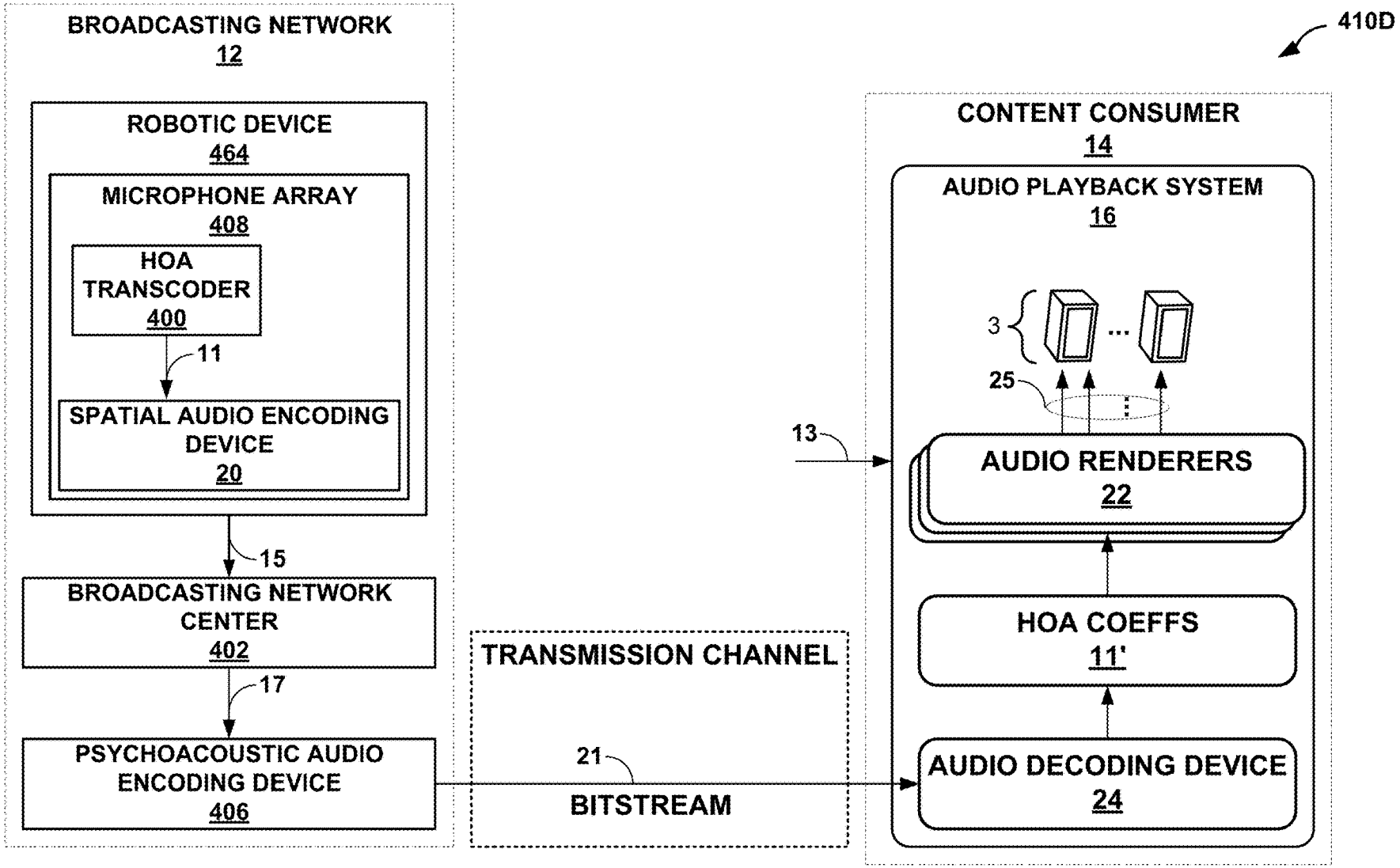

The system 410D shown in FIG. 3D is similar to the system 410A shown in FIG. 3A except that a robotic device 464 includes the microphone array 408. The robotic device 464 may for example represent a device that operates using artificial intelligence, or other types of robots. In some examples, the robotic device 464 may represent a flying device, such as a drone. In other examples, the robotic device 464 may represent other types of devices, including those that do not necessarily fly. As such, the techniques set forth in this disclosure may be performed in the context of robots.

Figure 4:
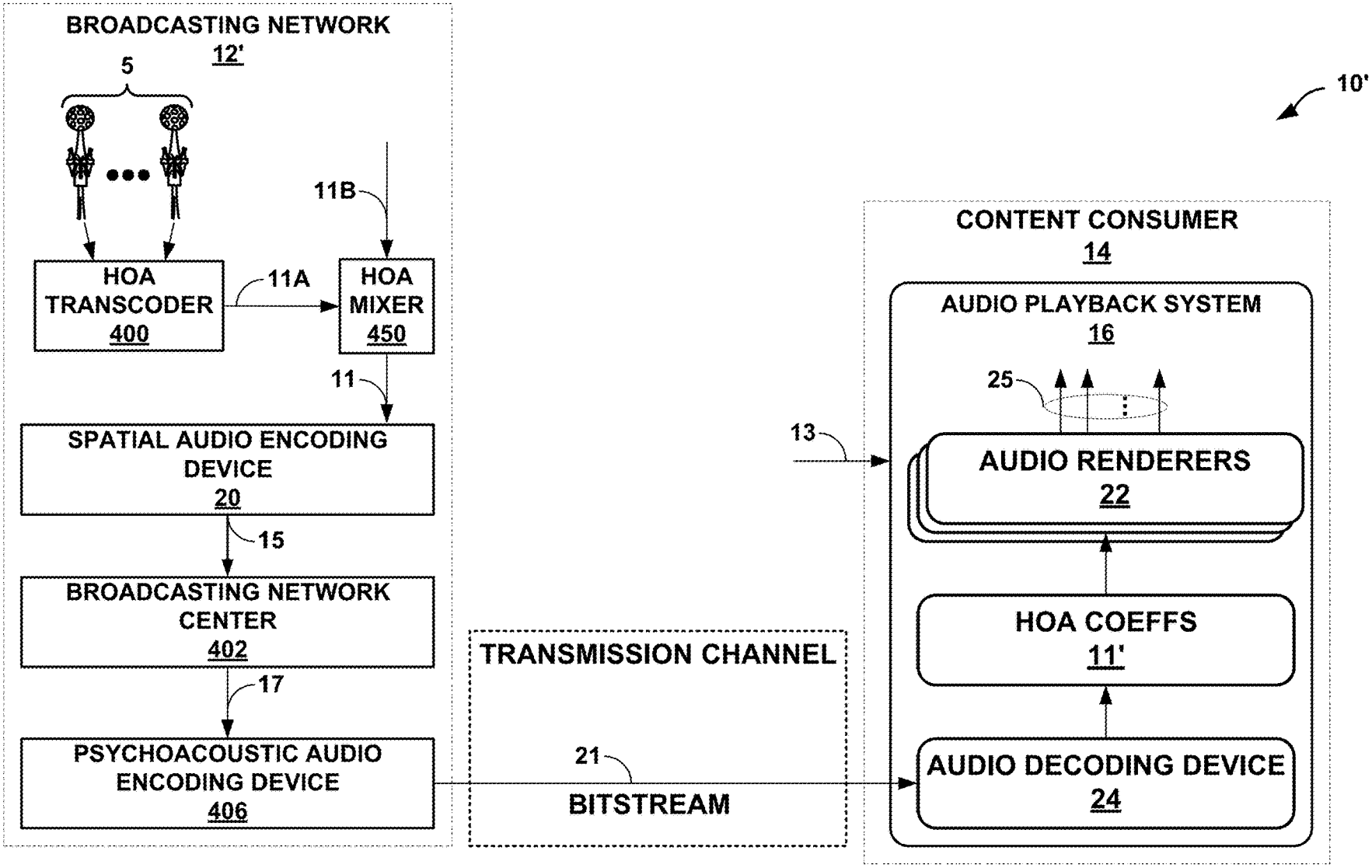
FIG. 4 is a block diagram illustrating another example of the system shown in the example of FIG. 2.

FIG. 4 is a block diagram illustrating another example of a system that may be configured to perform various aspects of the techniques described in this disclosure. The system shown in FIG. 4 is similar to the system 10 of FIG. 2 except that the broadcasting network 12 includes an additional HOA mixer 450. As such, the system shown in FIG. 4 is denoted as system 10' and the broadcast network of FIG. 4 is denoted as broadcast network 12'. The HOA transcoder 400 may output the live feed HOA coefficients as HOA coefficients 11A to the HOA mixer 450. The HOA mixer represents a device or unit configured to mix HOA audio data. HOA mixer 450 may receive other HOA audio data 11B (which may be representative of any other type of audio data, including audio data captured with spot microphones or non-3D microphones and converted to the spherical harmonic domain, special effects specified in the HOA domain, etc.) and mix this HOA audio data 11B with HOA audio data 11A to obtain HOA coefficients 11.

Figure 6:
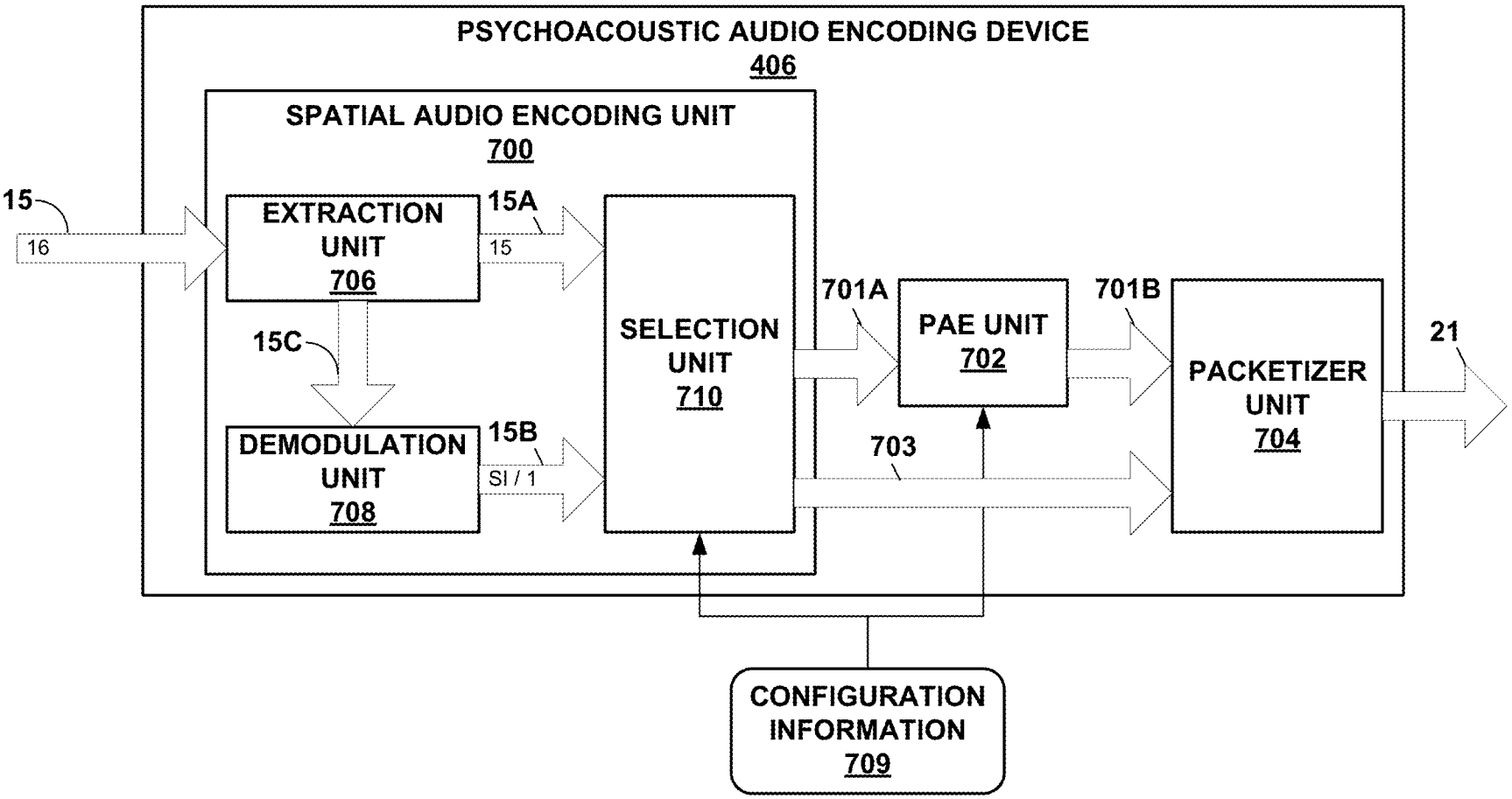
FIG. 6 is a block diagram illustrating an example of the psychoacoustic audio encoding device shown in the examples of FIGS. 2-5B.

FIG. 6 is a diagram illustrating an example of the psychoacoustic audio encoding device 406 shown in the examples of FIGS. 2-5B. As shown in the example of FIG. 6, the psychoacoustic audio encoding device 406 may include a spatial audio encoding unit 700, a psychoacoustic audio encoding unit 702, and a packetizer unit 704.

The spatial audio encoding unit 700 may represent a unit configured to perform further spatial audio encoding with respect to the intermediately formatted audio data 15. The spatial audio encoding unit 700 may include an extraction unit 706, a demodulation unit 708 and a selection unit 710.

The extraction unit 706 may represent a unit configured to extract the transport channels 15A and the modulated sideband information 15B from the intermediately formatted bitstream 15. The extraction unit 706 may output the transport channels 15A to the selection unit 710, and the modulated sideband information 15B to the demodulation unit 708.

The demodulation unit 708 may represent a unit configured to demodulate the modulated sideband information 15B to recover the original sideband information 15B. The demodulation unit 708 may operate in a manner reciprocal to the operation of the modulation device 610 described above with respect to system 800B shown in the example of FIG. 5B. When modulation is not performed with respect to the sideband information 15B, the extraction unit 706 may extract the sideband information 15B directly from the intermediately formatted bitstream 15 and output the sideband information 15B directly to the selection unit 710 (or the demodulation unit 708 may pass through the sideband information 15B to the selection unit 710 without performing demodulation).

The selection unit 710 may represent a unit configured to select, based on configuration information 709—which may represent an example of the above noted preferred priority, target bitrate, the above described independency flag (which may be denoted by an hoaIndependencyFlag syntax element), and/or other types of data externally defined—and the priority information, subsets of the transport channels 15A and the sideband information 15B.

The selection unit 710 may output the selected ambient HOA coefficients and predominant audio signals to the PAE unit 702 as transport channels 701A. The selection unit 710 may output the selected spatial components to the packetizer unit 704 as spatial components 703. The techniques enable the selection unit 710 to select various combinations of the transport channels 15A and the sideband information 15B suitable to achieve, as one example, the target bitrate and independency set forth by the configuration information 709 by virtue of the spatial audio encoding device 20 providing the transport channels 15A and the sideband information 15B along with the priority information.

The PAE unit 702 may represent a unit configured to perform psychoacoustic audio encoding with respect to the transport channels 701A to generate encoded transport channels 701B. The PAE unit 702 may output the encoded transport channels 701B to the packetizer unit 704. The packetizer unit 704 may represent a unit configured to generate, based on the encoded transport channels 701B and the sideband information 703, the bitstream 21 as a series of packets for delivery to the content consumer 14.

Figure 7:
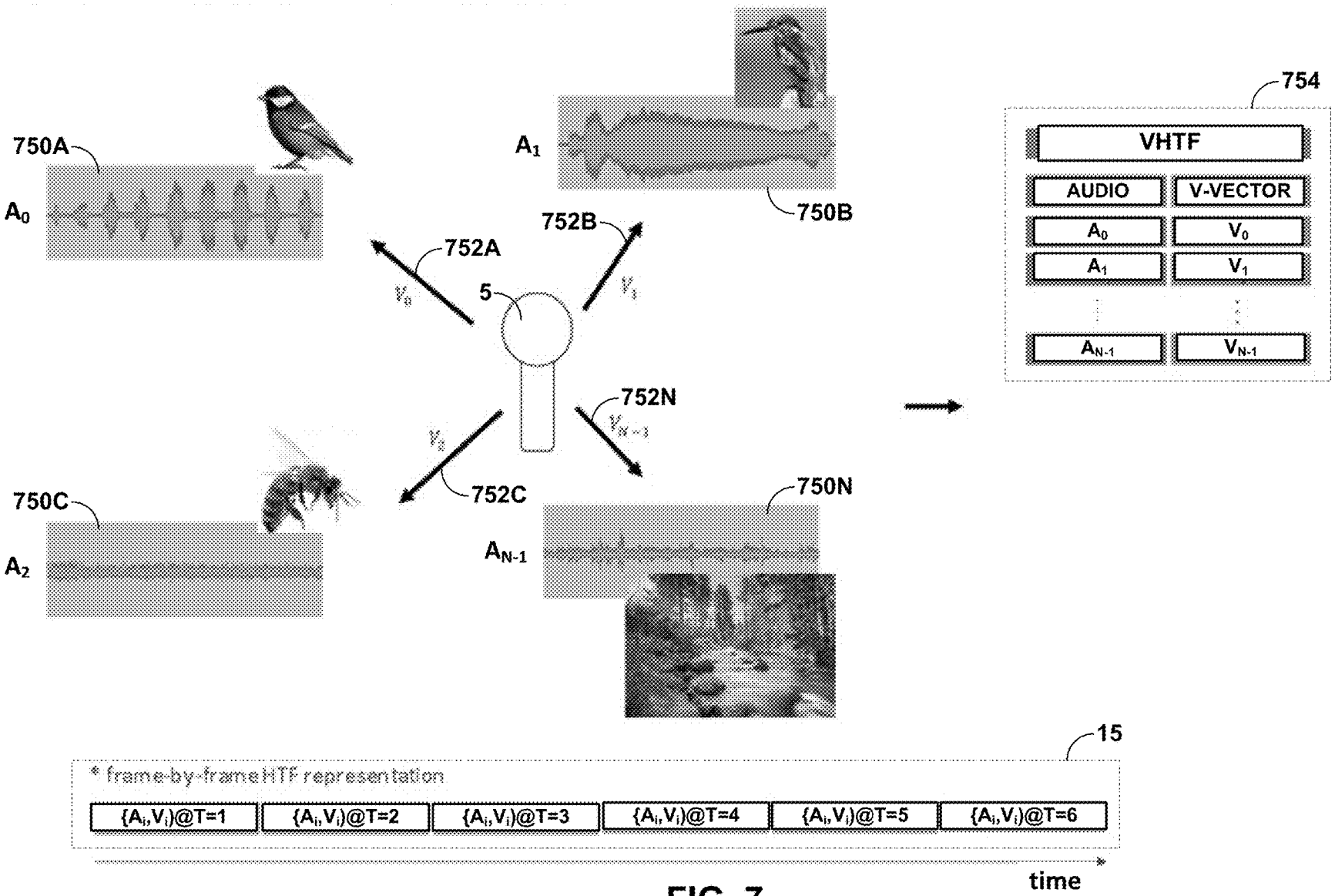
FIG. 7 is a diagram illustrating various aspects of the spatial audio encoding device of FIGS. 2-4 in perform various aspects of the techniques described in this disclosure.

FIG. 7 is a diagram illustrating various aspects of the spatial audio encoding device of FIGS. 2-4 in perform various aspects of the techniques described in this disclosure. In the example of FIG. 7, microphone 5 captures audio signals representative of HOA audio data, which the spatial audio encoder device 20 reduces to a number of different sound components 750A-750N ("sound components 750") and corresponding spatial components 752A-752N ("spatial components 752"), where the spatial components may generally refer to both the spatial components corresponding to predominant sound components and the corresponding repurposed sound components.

As shown in a table 754, the unified data object format, which may be referred to as a "V-vector based HOA transport format" (VHTF) or "vector based HOA transport format" in the case bitstreams, may include an audio object (which again is another way to refer to a sound component), and a corresponding spatial component (which may be referred to as a "vector"). The audio object (shown as "audio" in the example of FIG. 7) may be denoted by the variable $A_i$, where i denotes the i-th audio object. The vector (shown as "V-vector" in the example of FIG. 7) is denoted by the variable $V_i$, where i denotes the i-th vector. $A_i$ is an L×1 column matrix (with L being the number of samples in the frame), and $V_i$ is a Mx1 column matrix (with M being the number of elements in the vector).

The reconstructed HOA coefficients 11' may be denoted as $\tilde{H}$. The reconstructed HOA coefficients 11' may be determined according to the following equation:

$$\tilde{H} = \sum_{i=0}^{N-1} A_i V_i^T$$

According to the above equation, N denotes a total number of sound components in the selected non-zero subset of the plurality of spatial components. The reconstructed HOA coefficients 11' ($\tilde{H}$) may be determined as a summation of each iterative (up to N−1 starting at zero) multiplication the audio object ($A_i$) by the transpose of the vector ($V_i^T$). The spatial audio encoding device 20 may specify the bitstream 15 as shown at the bottom of FIG. 7, where the audio objects 750 are specified along with corresponding spatial components 752 in each frame (denoted by T=1 for the first frame, T=2 for the second frame, etc.).

Figure 8A:
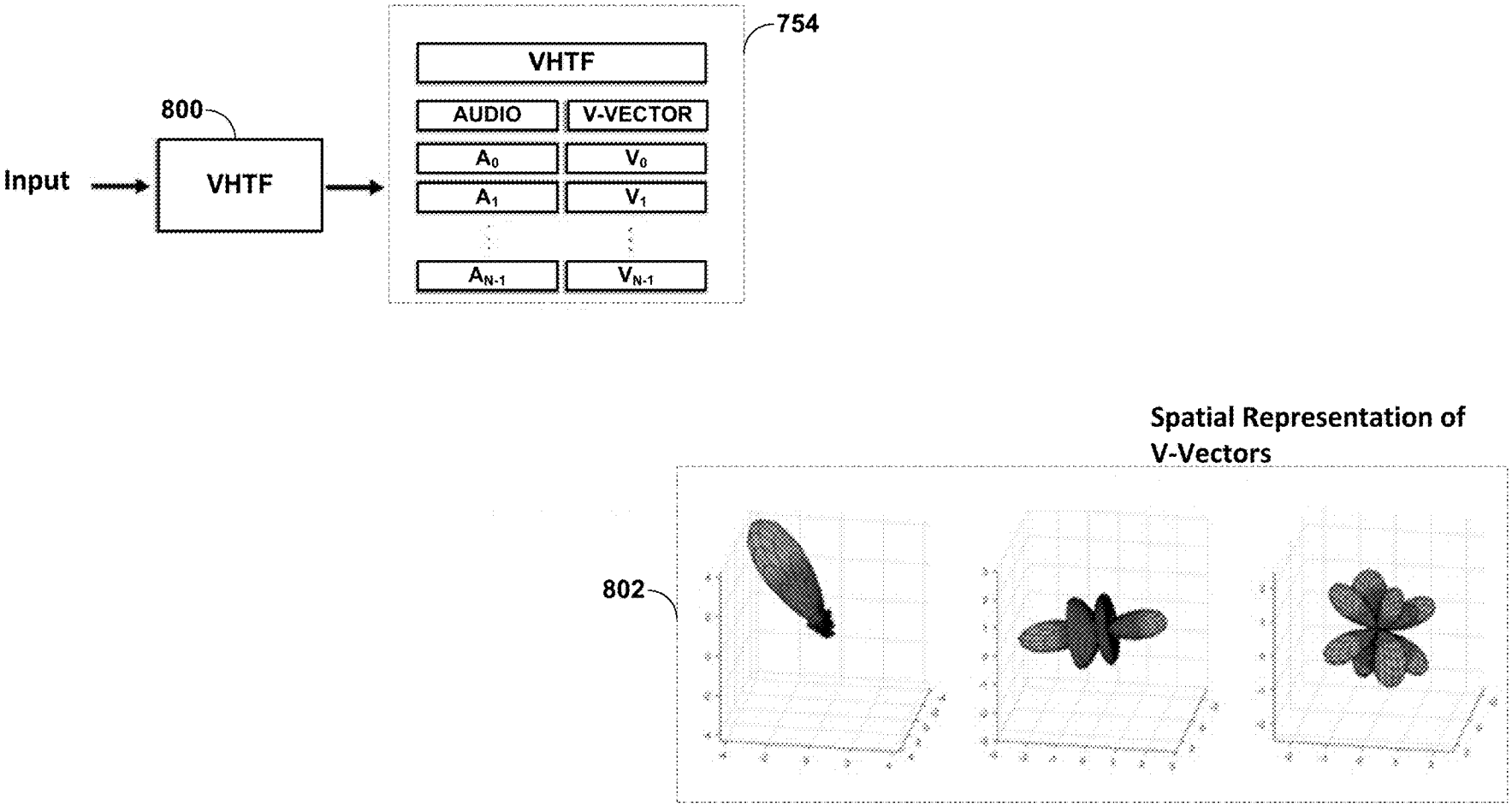
FIGS. 8A-8C are diagrams illustrating different representations within the bitstream according to various aspects of the unified data object format techniques described in this disclosure.
Figure 8B:
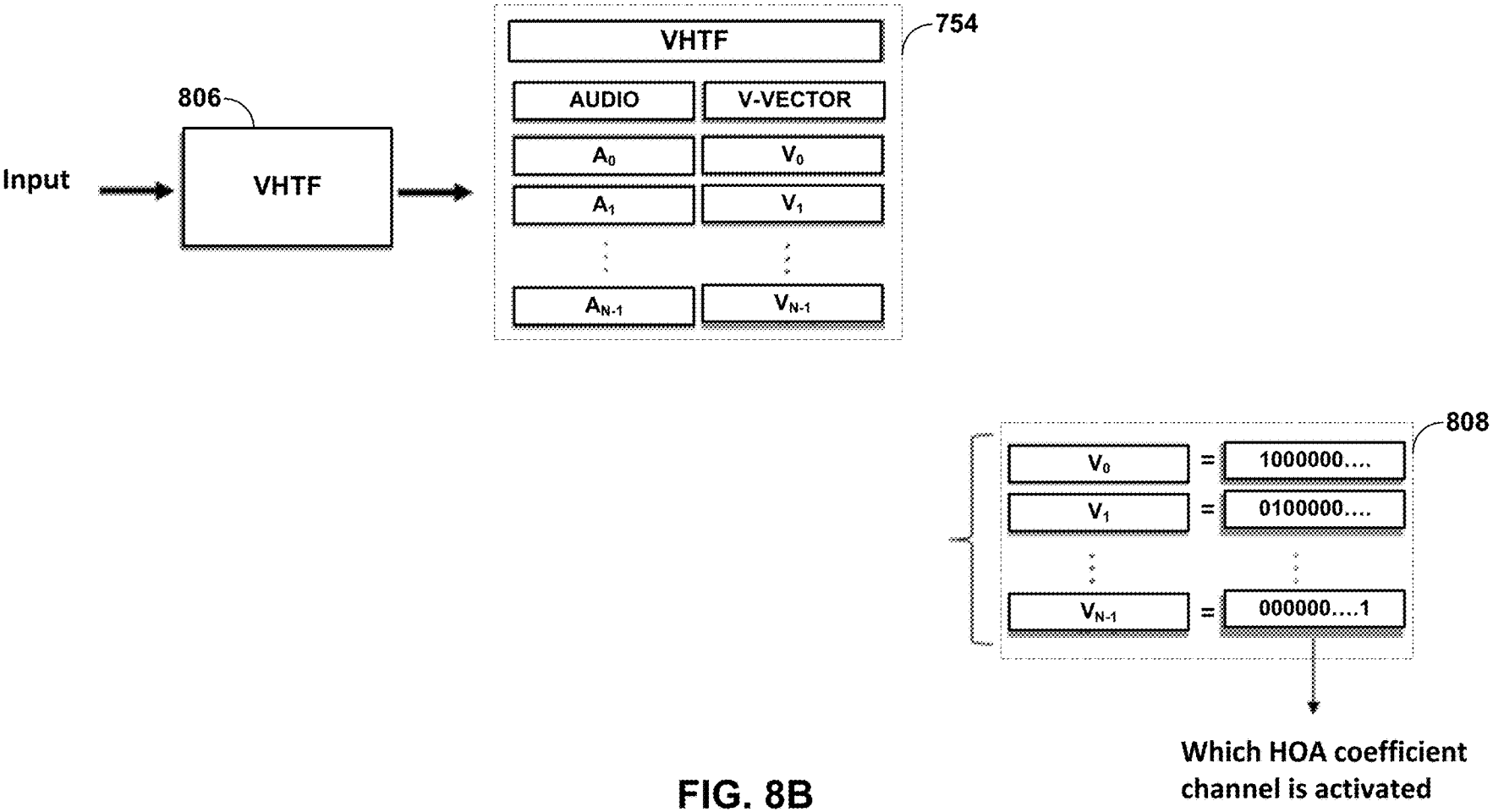
Figure 8C:
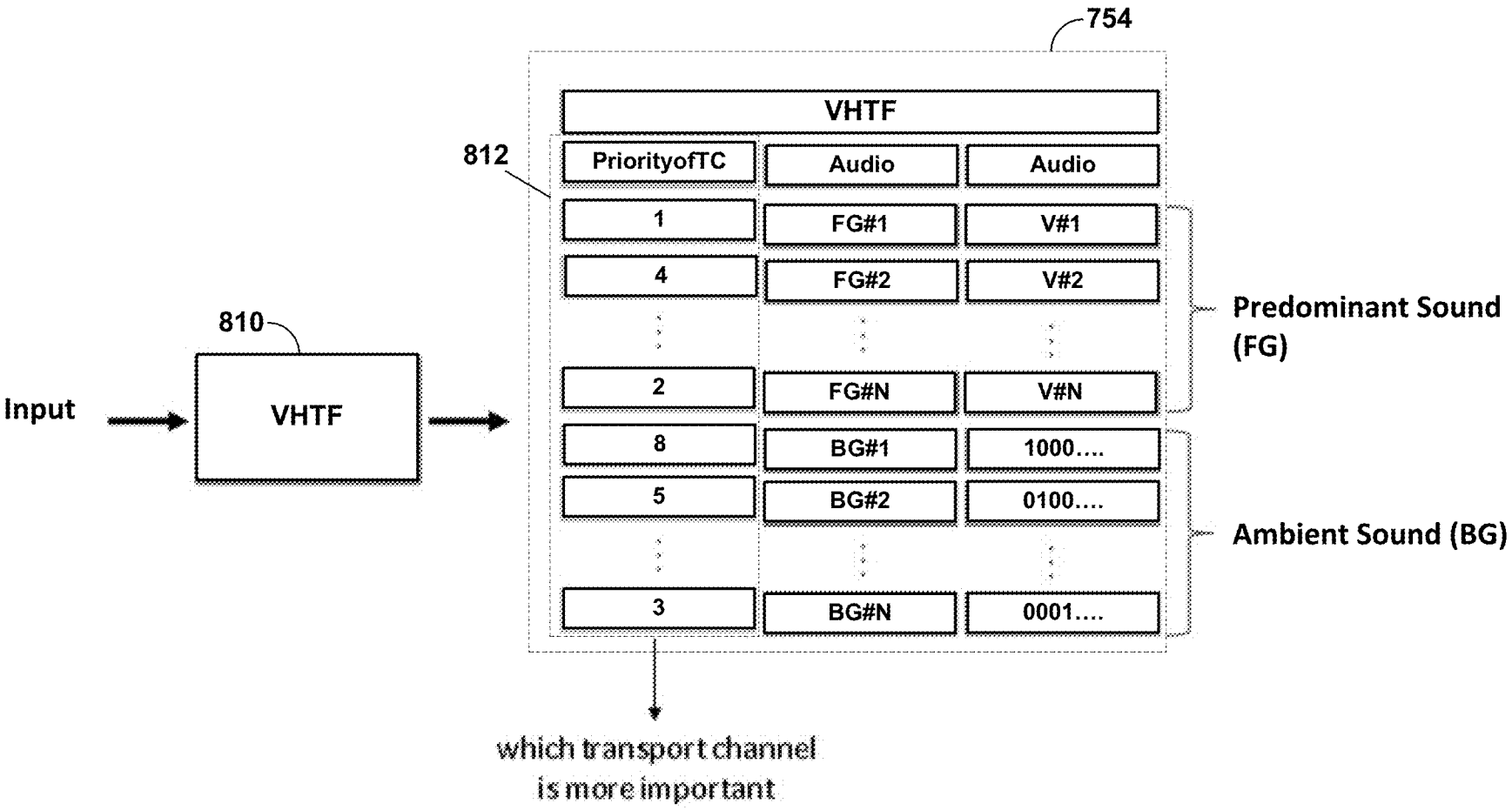

FIGS. 8A-8C are diagrams illustrating different representations within the bitstream according to various aspects of the unified data object format techniques described in this disclosure. In the example of FIG. 8A, the HOA coefficients 11 are shown as "input", which the spatial audio encoding device 20 shown in the example of FIG. 2 may transform into a VHTF representation 800 as described above. The VHTF representation 800 in the example of FIG. 8A represents the predominant sound (or foreground—FG—sound) representation. The table 754 is further shown to illustrate the VHTF representation 800 in more detail. In the example of FIG. 8A, there is also spatial representations 802 of the different V-vectors to illustrate how the spatial component defines shape, widths, and directions of the corresponding spatial component.

In the example of FIG. 8B, the HOA coefficients 11 are shown as "input", which the spatial audio encoding device 20 shown in the example of FIG. 2 may transform into a VHTF representation 806 as described above. The VHTF representation 806 in the example of FIG. 8B represents the ambient sound (or background—BG—sound) representation. The table 754 is further shown to illustrate the VHTF representation 806 in more detail, where both the VHTF representation 800 and the VHTF representation 806 have the same format. In the example of FIG. 8B, there is also examples 808 of the different repurposed V-vectors to illustrate how the repurposed V-vectors may include a single element with a value of one with every other element being set to a value of zero so as to, as described above, identify the order and sub-order of the spherical basis function to which the ambient HOA coefficient corresponds.

In the example of FIG. 8C, the HOA coefficients 11 are shown as "input", which the spatial audio encoding device 20 shown in the example of FIG. 2 may transform into a VHTF representation 810 as described above. The VHTF representation 810 in the example of FIG. 8C represents the sound components, but also includes the priority information 812 (shown as "PriorityOfTC," which refers to a priority of transport channels). The table 754 is updated in FIG. 8C to further illustrate the VHTF representation 810 in more detail, where both the VHTF representation 800 and the VHTF representation 806 have the same format and VHTF representation 810 includes the priority information 812.

In each instance, the spatial audio encoding device 20 may specify the unified transport type (or, in other words, the VHTF) by setting the HoaTransportType syntax element in the following table to 3.

| Syntax | No. of bits | Mnemonic |
|---|---|---|
| HOATransportConfig( ) | | |
| { | | |
| HoaTransportType; | 3 | uimsbf |
| if (HoaTransportType == 0) { | | |

-continued

| Syntax | No. of bits | Mnemonic |
|---|---|---|
| InputSamplingFrequency; | 3 | uimsbf |
| HoaOrder; | 3 | uimsbf |
| NumOfHoaCoeffs = ( HoaOrder + 1 )^2; | | |
| HoaNormalization; | 2 | uimsbf |
| HoaCoeffOrdering; | 2 | uimsbf |
| IsScreenRelative; | 1 | bslbf |
| if (IsScreenRelative) { | | |
| hasNonStandardScreenSize; | 1 | bslbf |
| if (hasNonStandardScreenSize) { | | |
| bsScreenSizeAz; | 9 | uimsbf |
| bsScreenSizeTopEl; | 9 | uimsbf |
| bsScreenSizeBottomEl; | 9 | uimsbf |
| } | | |
| } | | |
| } else if (HoaTransportType == 1) { | | |
| HoaNormalization = 1; | | |
| HoaCoeffOrdering = 0; | | |
| HOAConfig( ); | | |
| } else if (HoaTransportType == 2) { | | |
| HoaNormalization = 0; | | |
| HoaCoeffOrdering = 0; | | |
| HOAConfig_SN3D( ); | | |
| } else if (HoaTransportType == 3) { | | |
| InputSamplingFrequency; | 3 | uimsbf |
| HoaFrameLength; | 3 | uimsbf |
| HoaOrder; | 3 | uimsbf |
| NumOfHoaCoeffs = ( HoaOrder + 1 )^2; | | |
| HoaNormalization = 0; | | |
| HoaCoeffOrdering = 0; | | |
| IsScreenRelative; | 1 | bslbf |
| if (IsScreenRelative) { | | |
| hasNonStandardScreenSize; | 1 | bslbf |
| if (hasNonStandardScreenSize) { | | |
| bsScreenSizeAz; | 9 | uimsbf |
| bsScreenSizeTopEl; | 9 | uimsbf |
| bsScreenSizeBottomEl; | 9 | uimsbf |
| } | | |
| } | | |
| NumOfTransportChannels = CodedNumOfTransportChannels + 1; | 4 | uimsbf |
| } | | |
| } | | |

As noted in the below table, the HoaTransportType indicates the HOA transport mode, and when set to a value of three (3) signals that the transport type is VHTF.

| | |
|---|---|
| HoaTransportType | This element contains information about HOA transport mode.<br>0: HOA coefficients (as defined in this clause)<br>1: ISO/IEC 23008-3-based HOA Transport Format<br>2: Modified ISO/IEC 23008-3-based HOA Transport Format for SN3D normalization<br>3: V-vector based HOA Transport Format (VHTF) as defined below<br>4-7: reserved |

Regarding the VHTF (HoaTransportType=3), FIGS. 7 and 8A-8C may illustrate how VHTF is composed of audio signals, $\{A_i\}$, and the associated V-vectors, $\{V_i\}$, where an input HOA signal, H, can be approximated by $$\tilde{H} = \sum_{i=0}^{N-1} A_i V_i^T$$

where an i-th V-vector, $V_{ti}$, is the spatial representation of the i-th audio signal, $A_i$. N is the number of transport channels. The dynamic range of each $V_i$ is bound by [−1, 1]. Examples of V-vector based spatial representation 802 are shown in FIG. 8A.

VHTF can also represent an original input HOA, which means $\tilde{H}$=H, in the following conditions:

if $V_i$ has all zero elements but one at an i-th element $[0\ 0\ .\ .\ .\ 1\ .\ .\ .\ 0]^T$ and if $A_i$ is the i-th HOA coefficients.

Thus, VHTF can represent both pre-dominant and ambient sound fields. As shown in Table 15, the HOAFrame_VvecTransportFormat( ) holds the information that is required to decode the L samples (HoaFrameLength in Table 1) of an HOA frame.

Syntax of HOAFrame_VvecTransportFormat( )

| Syntax | No. of bits | Mnemonic |
|---|---|---|
| HOAFrame_VvecTransportFormat( ) | | |
| { | | |
| VvectorBits = codedVvectorBitDepth*2+1; | 3 | uimsbf |
| PriorityBits = ceil(log2(NumOfTransportChannels)); | | |
| for (i=0;i<NumOfTransportChannels;i++) { | | |
| priorityOfTC[i]; | PriorityBits | uimsbf |
| for (j=0;j<NumOfHoaCoeffs; j++) { | | |
| Vvector[i][j]; | VvectorBits | uimsbf |
| } | | |
| } | | |
| } | | |
| } | | |

| | |
|---|---|
| NumOfTransportChannels | This element contains information about the number of transport channels defined in Table 1. |
| codedVvectorBitDepth | This element contains information about the coded bit depth of a V-vector. |
| NumOfHoaCoeffs | This element contains information about the number of HOA coefficients defined in Table 1. |
| VvectorBits | This element contains information about the bit depth of a V-vector. |
| PriorityBits | This element contains information about the bit depth of HOA transport channel priority. |
| priorityOfTC[i] | This element contains information about the priority of an i-th transport channel (the channel with a lower priority value is more important, thus the channel with priorityOfTC[i] = 0 is the channel with the highest priority). |
| Vvector[i][j] | This element contains information about a vector element representing spatial information. Its value is bounded by [−1, 1]. |

In the foregoing syntax tables, Vvector[i][j] refers to the spatial component, where i identifies which transport channel, and j identifies which coefficient (by way of the order and sub-order of the spherical basis function to which the ambient HOA coefficient corresponds in the case when Vvector represents the repurposed spatial component).

The audio decoding device 24 (shown in the example of FIG. 2) may receive the bitstream 21 and obtain the HoaTransportType syntax element from the bitstream 21. Based on the HoaTransportType syntax element, the audio decoding device 24 may extract the various sound components and corresponding spatial components to render the speaker feeds in the manner described above in more detail.

Figures 9A, 9B:
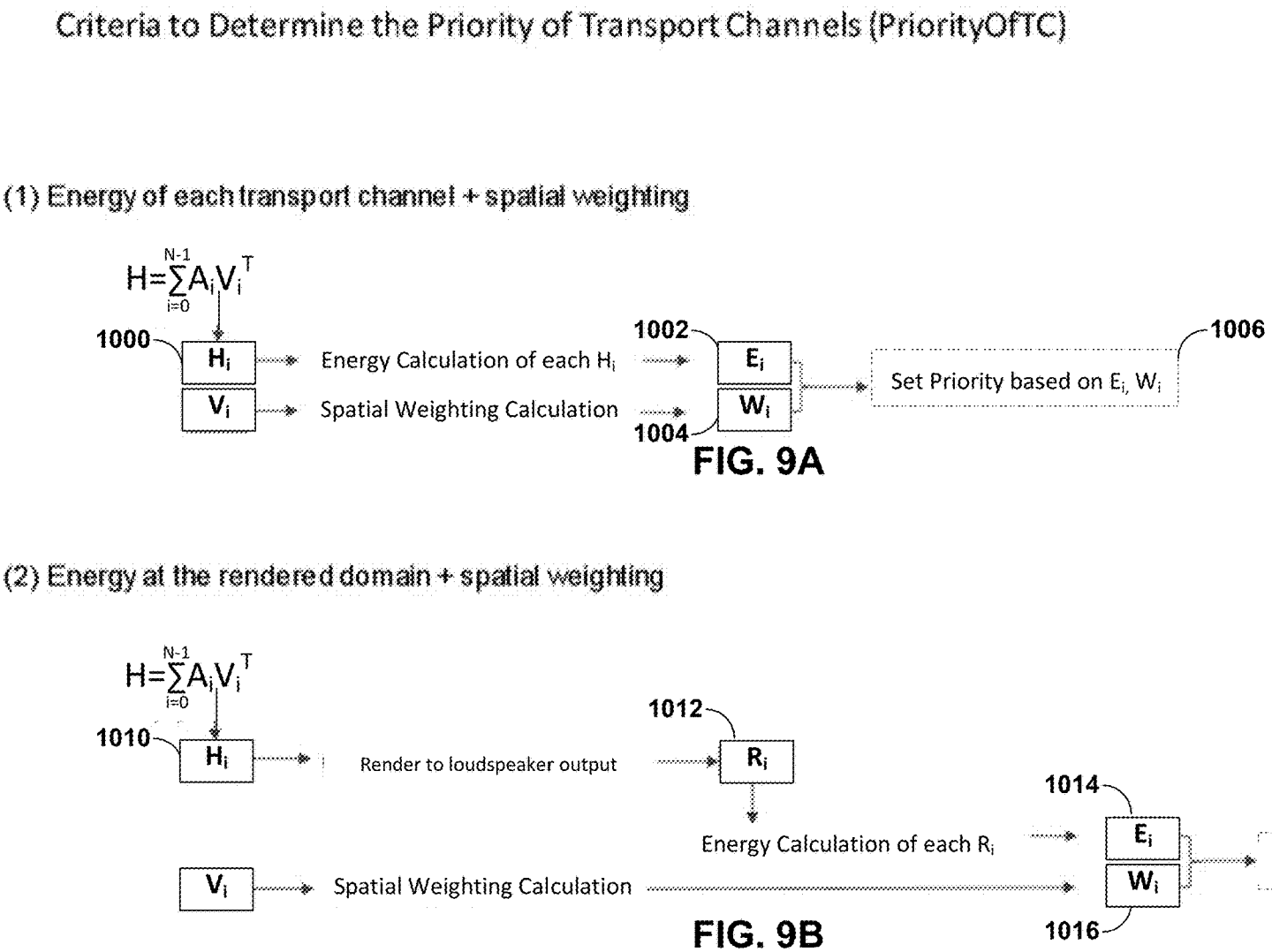
FIGS. 9A-9F are diagrams illustrating various ways by which the spatial audio encoding device of FIGS. 2-4 may determine the priority information in accordance with various aspects of the techniques described in this disclosure.

FIGS. 9A-9F are diagrams illustrating various ways by which the spatial audio encoding device of FIGS. 2-4 may determine the priority information in accordance with various aspects of the techniques described in this disclosure. In the example of FIG. 9A, the spatial audio encoding device 20 may determine an HOA representation of the sound component (which is denoted as $H_i$) in the manner described above (1000). The spatial audio encoding device 20 may next determine an energy (denoted by the variable $E_i$) of HOA representation of the sound component (1002). The spatial audio encoding device 20 may also determine, based on the spatial component (denoted by the variable $V_i$), a spatial weighting (denoted by the variable $W_i$) (1004). The spatial audio encoding device 20 may obtain, based on the energy and the spatial weighting, the priority information (1006).

In the example of FIG. 9B, the spatial audio encoding device 20 may determine an HOA representation of the sound component (which is denoted as $H_i$) in the manner described above (1010). The spatial audio encoding device 20 may next render the HOA representation of the sound component to one or more speaker feeds (which may refer to, as one example, the shown "loudspeaker output") (1012). The spatial audio encoding device 20 may determine an energy (denoted by the variable $E_i$) of one or more speaker feeds (1014). The spatial audio encoding device 20 may also determine, based on the spatial component (denoted by the variable $V_i$), a spatial weighting (denoted by the variable $W_i$) (1016). The spatial audio encoding device 20 may obtain, based on the energy and the spatial weighting, the priority information (1018).

Figure 9C:
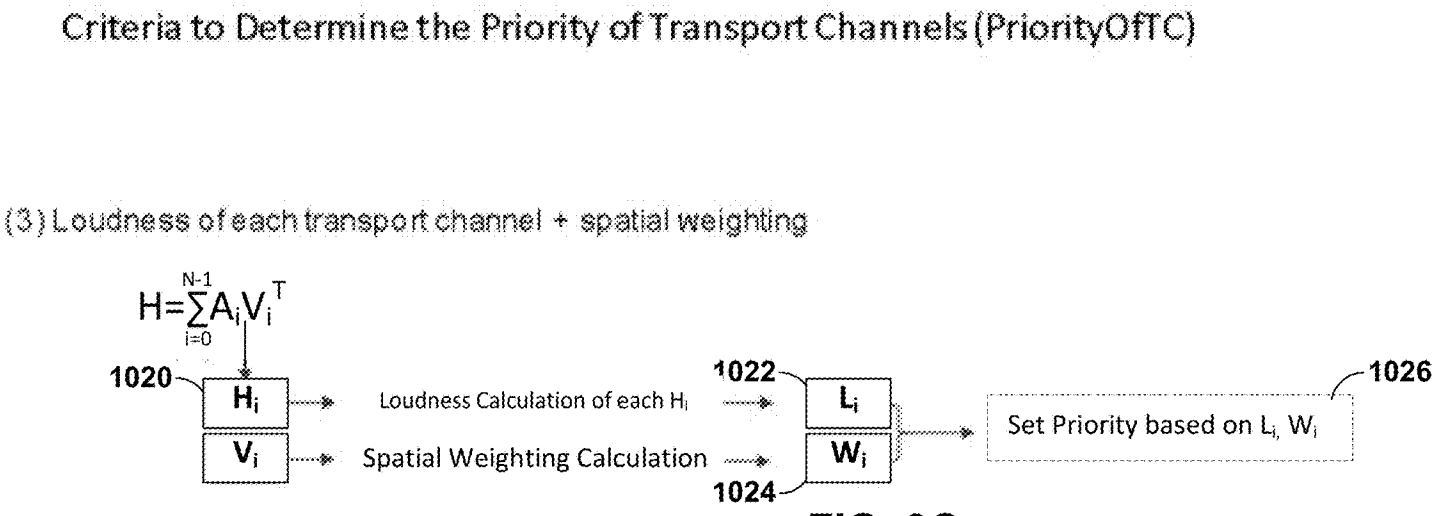

In the example of FIG. 9C, the spatial audio encoding device 20 may determine an HOA representation of the sound component (which is denoted as $H_i$) in the manner described above (1020). The spatial audio encoding device 20 may next determine a loudness measure (denoted by the variable $L_i$) of HOA representation of the sound component (1022). The spatial audio encoding device 20 may also determine, based on the spatial component (denoted by the variable $V_i$), a spatial weighting (denoted by the variable $W_i$) (1024). The spatial audio encoding device 20 may obtain, based on the loudness measure and the spatial weighting, the priority information (1026).

Figure 9D:
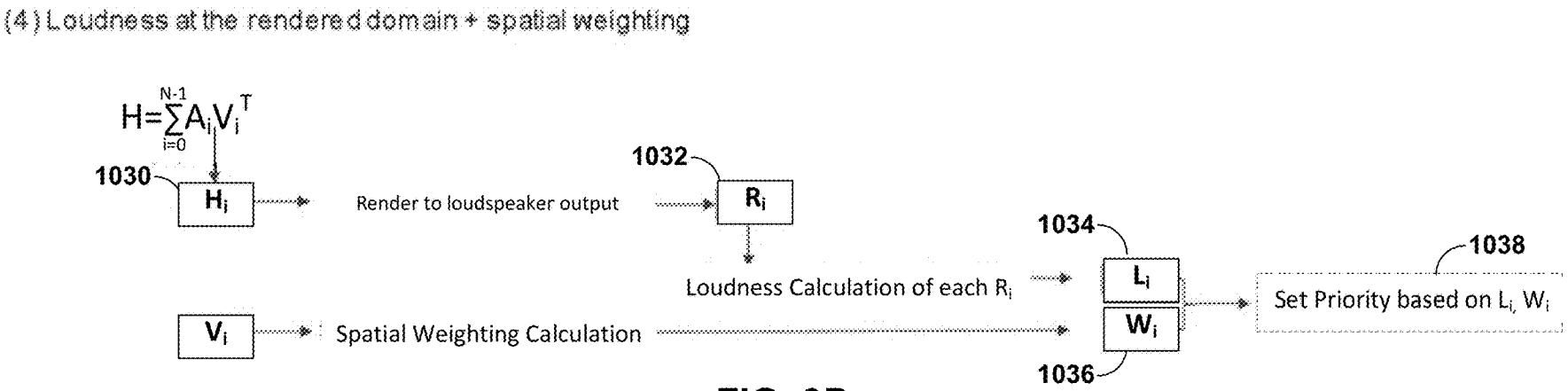

In the example of FIG. 9D, the spatial audio encoding device 20 may determine an HOA representation of the sound component (which is denoted as $H_i$) in the manner described above (1030). The spatial audio encoding device 20 may next render the HOA representation of the sound component to one or more speaker feeds (which may refer to, as one examples, the shown "loudspeaker output") (1032). The spatial audio encoding device 20 may determine a loudness measure (denoted by the variable $L_i$) of one or more speaker feeds (1034). The spatial audio encoding device 20 may also determine, based on the spatial component (denoted by the variable $V_i$), a spatial weighting (denoted by the variable $W_i$) (1036). The spatial audio encoding device 20 may obtain, based on the loudness measure and the spatial weighting, the priority information (1038).

Figure 9E:
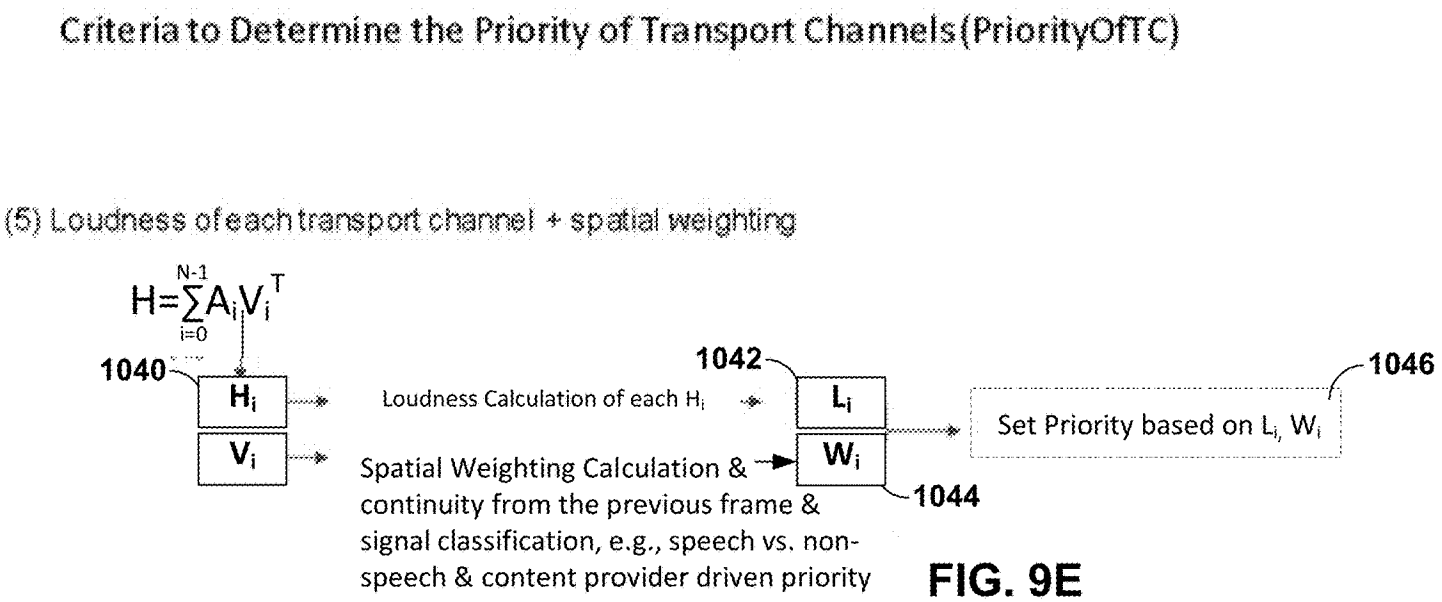

In the example of FIG. 9E, the spatial audio encoding device 20 may determine an HOA representation of the sound component (which is denoted as $H_i$) in the manner described above (1040). The spatial audio encoding device 20 may next determine a loudness measure (denoted by the variable $L_i$) of the HOA representation of the sound component (1042). The spatial audio encoding device 20 may also determine, based on the spatial component (denoted by the variable $V_i$), a spatial weighting. The spatial audio encoding device 20 may also determine the above noted continuity indication, the class resulting from signal classification, and the content provider preferred priority (which is shown as "content provider driven priority"), integrating the above noted continuity indication, the class resulting from signal classification, and the content provider preferred priority into the spatial weighting (denoted by the variable $W_i$) (1044). The spatial audio encoding device 20 may obtain, based on the loudness measure and the spatial weighting, the priority information (1046).

Figure 9F:
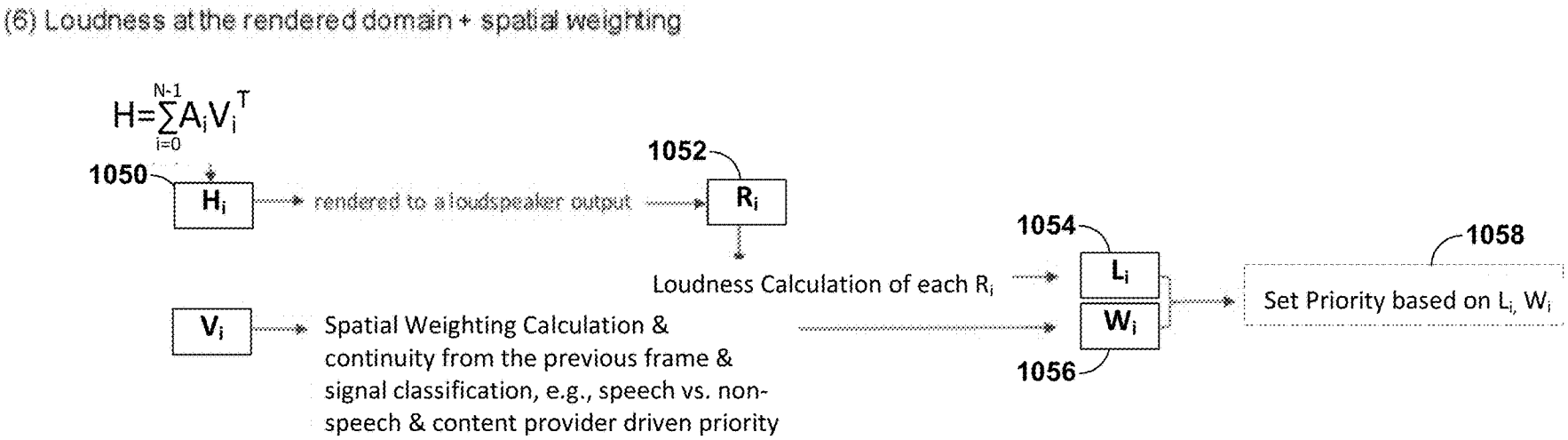

In the example of FIG. 9F, the spatial audio encoding device 20 may determine an HOA representation of the sound component (which is denoted as $H_i$) in the manner described above (1050). The spatial audio encoding device 20 may next render the HOA representation of the sound component to one or more speaker feeds (which may refer to, as one example, the shown "loudspeaker output") (1052). The spatial audio encoding device 20 may determine a loudness measure (denoted by the variable $L_i$) of one or more speaker feeds (1054). The spatial audio encoding device 20 may also determine, based on the spatial component (denoted by the variable $V_i$), a spatial weighting. The spatial audio encoding device 20 may also determine the above noted continuity indication, the class resulting from signal classification, and the content provider preferred priority (which is shown as "content provider driven priority"), integrating the above noted continuity indication, the class resulting from signal classification, and the content provider preferred priority into the spatial weighting (denoted by the variable $W_i$) (1056). The spatial audio encoding device 20 may obtain, based on the loudness measure and the spatial weighting, the priority information (1058).

Figure 10:
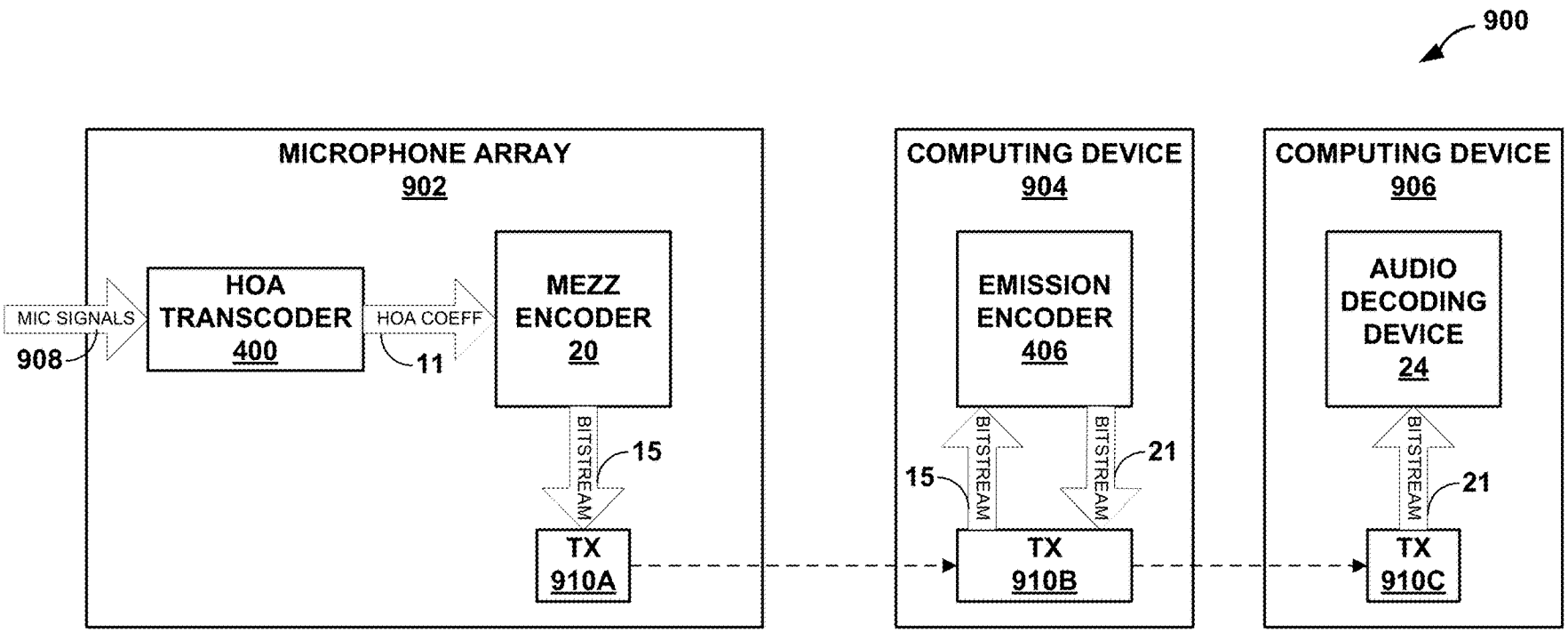
FIG. 10 is a block diagram illustrating a different system configured to perform various aspects of the techniques described in this disclosure.

FIG. 10 is a block diagram illustrating a different system configured to perform various aspects of the techniques described in this disclosure. In the example of FIG. 10, a system 900 includes a microphone array 902 and computing devices 904 and 906. The microphone array 902 may be similar, if not substantially similar, to the microphone array 5 described above with respect to the example of FIG. 2. The microphone array 902 includes the HOA transcoder 400 and the mezzanine encoder 20 discussed in more detail above.

The computing devices 904 and 906 may each represent one or more of a cellular phone (which may be interchangeably be referred to as a "mobile phone," or "mobile cellular handset" and where such cellular phone may including so-called "smart phones"), a tablet, a laptop, a personal digital assistant, a wearable computing headset, a watch (including a so-called "smart watch"), a gaming console, a portable gaming console, a desktop computer, a workstation, a server, or any other type of computing device. For purposes of illustration, each of the computing devices 904 and 906 is referred to a respective mobile phone 904 and 906. In any event, the mobile phone 904 may include the emission encoder 406, while the mobile phone 906 may include the audio decoding device 24.

The microphone array 902 may capture audio data in the form of microphone signals 908. The HOA transcoder 400 of the microphone array 902 may transcode the microphone signals 908 into the HOA coefficients 11, which the mezzanine encoder 20 (shown as "mezz encoder 20") may encode (or, in other words, compress) to form the bitstream 15 in the manner described above. The microphone array 902 may be coupled (either wirelessly or via a wired connection) to the mobile phone 904 such that the microphone array 902 may communicate the bitstream 15 via a transmitter and/or receiver (which may also be referred to as a transceiver, and abbreviated as "TX") 910A to the emission encoder 406 of the mobile phone 904. The microphone array 902 may include the transceiver 910A, which may represent hardware or a combination of hardware and software (such as firmware) configured to transmit data to another transceiver.

The emission encoder 406 may operate in the manner described above to generate the bitstream 21 conforming to the 3D Audio Coding Standard from the bitstream 15. The emission encoder 406 may include a transceiver 910B (which is similar to if not substantially similar to transceiver 910A) configured to receive the bitstream 15. The emission encoder 406 may select the target bitrate, hoaIndependencyFlag syntax element, and the number of transport channels when generating the bitstream 21 from the received bitstream 15 (selecting the number of transport channels as the subset of transport channels according to the priority information). The emission encoder 406 may communicate (although not necessarily directly, meaning that such communication may have intervening devices, such as servers, or by way of dedicated non-transitory storage media, etc.) the bitstream 21 via the transceiver 910B to the mobile phone 906.

The mobile phone 906 may include transceiver 910C (which is similar to if not substantially similar to transceivers 910A and 910B) configured to receive the bitstream 21, whereupon the mobile phone 906 may invoke audio decoding device 24 to decode the bitstream 21 so as to recover the HOA coefficients 11'. Although not shown in FIG. 10 for ease of illustration purposes, the mobile phone 906 may render the HOA coefficients 11' to speaker feeds, and reproduce the soundfield via a speaker (e.g., a loudspeaker integrated into the mobile phone 906, a loudspeaker wirelessly coupled to the mobile pohone 906, a loudspeaker coupled by wire to the mobile phone 906, or a headphone speaker coupled either wirelessly or via wired connection to the mobile phone 906) based on the speaker feeds. For reproducing the soundfield by way of headphone speakers (which again may be standalone headphones or headphones integrated into a headset), the mobile phone 906 may render binaural audio speaker feeds from either the loudspeaker feeds or directly from the HOA coefficients 11'.

Figure 11:
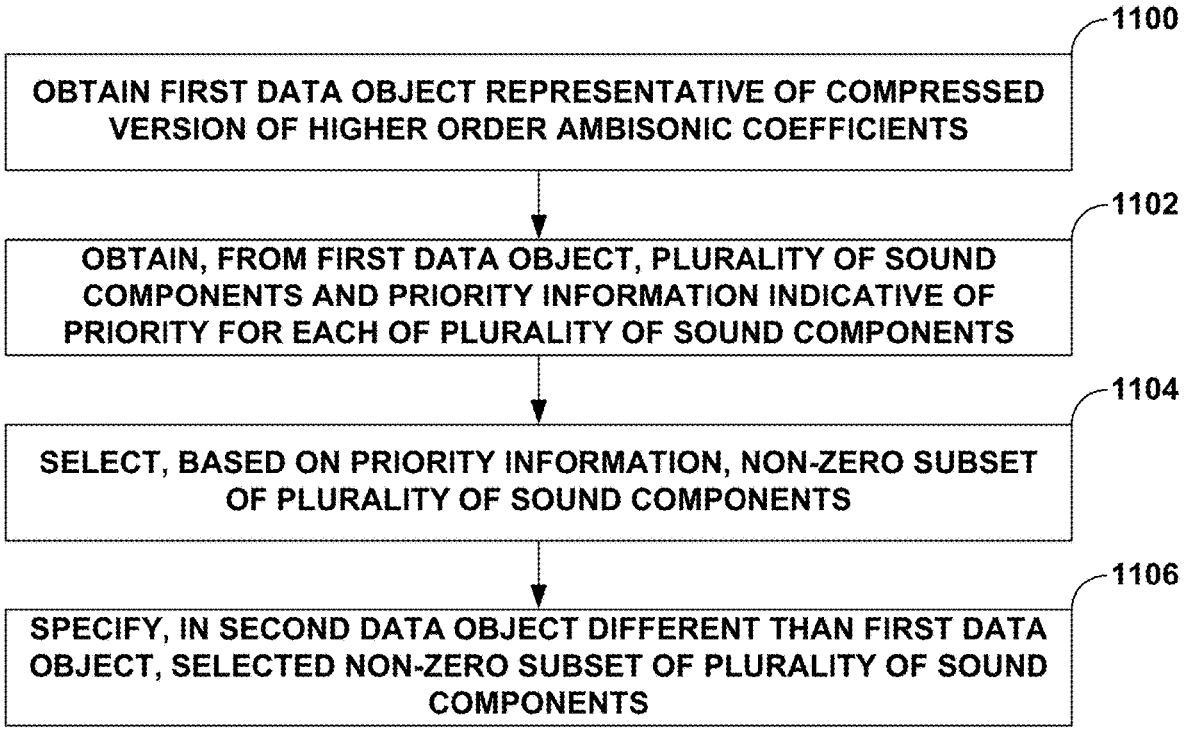
FIG. 11 is a flowchart illustrating example operation of the psychoacoustic audio encoding device of FIG. 2-6 in performing various aspects of the techniques described in this disclosure.

FIG. 11 is a flowchart illustrating example operation of the psychoacoustic audio encoding device of FIG. 2-6 in performing various aspects of the techniques described in this disclosure. The psychoacoustic audio encoding device 406 may first obtain a first data object 17 representative of a compressed version of higher order ambisonic coefficients (1100). The psychoacoustic audio encoding device 406 may obtain, from the first data object 17, a plurality of sound components 750 (shown in the example of FIG. 7) and priority information 812 (shown in the example of FIG. 8C)

indicative of a priority of each of the plurality of sound components relative to remaining ones of the sound components (1102).

The psychoacoustic audio encoding device 406 may select, based on the priority information 812, a non-zero subset of the plurality of sound components (1104). In some examples, the psychoacoustic audio encoding device 406 may select the non-zero subset of the plurality of sound components to achieve a target bitrate. The psychoacoustic audio encoding device 406 may next specify, in a second data object 21 different that the first data object 17, the selected non-zero subset of the plurality of sound components (1106).

In some examples, the first data object 17 comprises a first bitstream 17, where the first bitstream 17 comprises a first plurality of transport channels. The second data object 21 may comprise a second bitstream 21, where the second bitstream 21 comprises a second plurality of transport channels. In this and other examples, the priority information 812 comprises priority channel information 812, and the psychoacoustic audio encoding device 406 may obtain, from the first plurality of transport channels, the plurality of sound components, and specify, in each of the second plurality of transport channels, a respective one of the selected non-zero subset of the plurality of sound components.

In some examples, the first data object 17 comprises a first file 17, where the first file 17 comprises a first plurality of tracks. The second data object 21 may comprise a second file 21, where the second file 21 comprises a second plurality of tracks. In this and other examples, the priority information 812 comprises priority track information 812, and the psychoacoustic audio encoding device 406 may obtain, from the first plurality of tracks, the plurality of sound components, and specify, in each of the second plurality of tracks, a respective one of the selected non-zero subset of the plurality of sound components.

In some examples, the first data object 17 comprises a bitstream 17, and the second data object 21 comprises a file 21. In other examples, the first data object 17 comprises a file 17, and the second data object 21 comprises a bitstream 21. That is, various aspects of the techniques may allow for conversion between different types of data objects.

Figure 12:
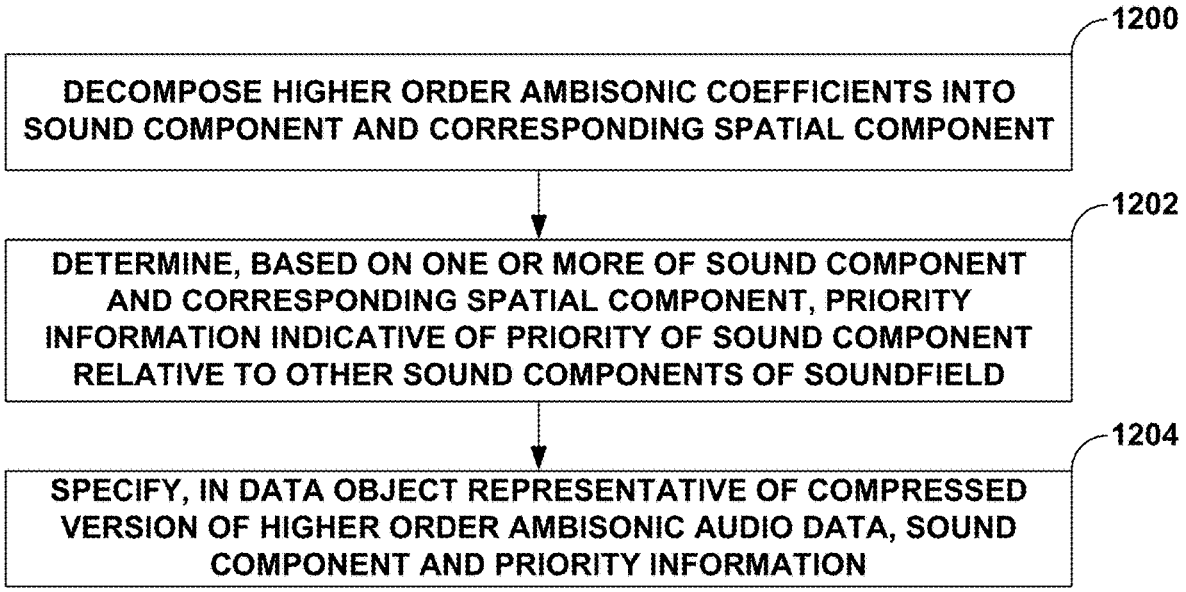
FIG. 12 is a flowchart illustrating example operation of the spatial audio encoding device of FIG. 2-5 in performing various aspects of the techniques described in this disclosure.

FIG. 12 is a flowchart illustrating example operation of the spatial audio encoding device of FIG. 2-5 in performing various aspects of the techniques described in this disclosure. As shown in the example of FIG. 12, the spatial audio encoding device 20 (shown in the example of FIG. 2) may, as described above, decompose the HOA coefficients 11 into a sound component and a corresponding spatial component (1200). The spatial audio encoding device 20 may next determine, based on one or more of the sound component and the corresponding spatial component, priority information indicative of a priority of the sound component relative to other sound components of the soundfield represented by the HOA coefficients 11, as described above in more detail (1202). The spatial audio encoding device 20 may specify, in the data object (e.g., bitstream 15) representative of a compressed version of the HOA coefficients 11, the sound component and the priority information (1204). In some examples, the spatial audio encoding device 20 may specify a plurality of sound components and priority information indicative of a priority of each of the plurality of sound components relative to remaining ones of the sound components.

In this manner, higher Order Ambisonics (HOA) signals are able to deliver a significantly enhanced immersive sound compared to conventional stereo or 5.1 channel audio signals. However, there are some use cases where HOA signals cannot be transported because of the large number of HOA input channels.

One use case is mobile devices as shown in FIG. 1 (*a*), where the number of input channels can be limited by 8 Pulse-Code Modulation (PCM) channels, and thus only a maximum of 1st order HOA (requiring 4 PCM channels) can be transported.

Another use case is a typical broadcast workflow. Here, a contribution encoder can transmit 16 PCM channels from the remote truck to the network operation centre (NOC) or local affiliate(s). However, the use of single High-Definition Serial Digital Interface (HD-SDI) link has a limitation of being able to transport only 16 PCM channels. This restricts the transport to a maximum of 3rd order HOA signals (requiring 16 PCM channels). If additional audio elements are to be transported, only a maximum of 2nd order HOA (requiring 9 PCM channels) can be transported.

The above described techniques may address these use cases in various ways as discussed in more detail above.

In addition, the foregoing techniques may be performed with respect to any number of different contexts and audio ecosystems and should not be limited to any of the contexts or audio ecosystems described above. A number of example contexts are described below, although the techniques should be limited to the example contexts. One example audio ecosystem may include audio content, movie studios, music studios, gaming audio studios, channel based audio content, coding engines, game audio stems, game audio coding/rendering engines, and delivery systems.

The movie studios, the music studios, and the gaming audio studios may receive audio content. In some examples, the audio content may represent the output of an acquisition. The movie studios may output channel based audio content (e.g., in 2.0, 5.1, and 7.1) such as by using a digital audio workstation (DAW). The music studios may output channel based audio content (e.g., in 2.0, and 5.1) such as by using a DAW. In either case, the coding engines may receive and encode the channel based audio content based one or more codecs (e.g., AAC, AC3, Dolby True HD, Dolby Digital Plus, and DTS Master Audio) for output by the delivery systems. The gaming audio studios may output one or more game audio stems, such as by using a DAW. The game audio coding/rendering engines may code and or render the audio stems into channel based audio content for output by the delivery systems. Another example context in which the techniques may be performed comprises an audio ecosystem that may include broadcast recording audio objects, professional audio systems, consumer on-device capture, HOA audio format, on-device rendering, consumer audio, TV, and accessories, and car audio systems.

The broadcast recording audio objects, the professional audio systems, and the consumer on-device capture may all code their output using HOA audio format. In this way, the audio content may be coded using the HOA audio format into a single representation that may be played back using the on-device rendering, the consumer audio, TV, and accessories, and the car audio systems. In other words, the single representation of the audio content may be played back at a generic audio playback system (i.e., as opposed to requiring a particular configuration such as 5.1, 7.1, etc.), such as audio playback system 16.

Other examples of context in which the techniques may be performed include an audio ecosystem that may include acquisition elements, and playback elements. The acquisition elements may include wired and/or wireless acquisition devices (e.g., Eigen microphones), on-device surround sound capture, and mobile devices (e.g., smartphones and tablets). In some examples, wired and/or wireless acquisition devices may be coupled to mobile device via wired and/or wireless communication channel(s).

In accordance with one or more techniques of this disclosure, the mobile device (such as a mobile communication handset) may be used to acquire a soundfield. For instance, the mobile device may acquire a soundfield via the wired and/or wireless acquisition devices and/or the on-device surround sound capture (e.g., a plurality of microphones integrated into the mobile device). The mobile device may then code the acquired soundfield into the HOA coefficients for playback by one or more of the playback elements. For instance, a user of the mobile device may record (acquire a soundfield of) a live event (e.g., a meeting, a conference, a play, a concert, etc.), and code the recording into HOA coefficients.

The mobile device may also utilize one or more of the playback elements to playback the HOA coded soundfield. For instance, the mobile device may decode the HOA coded soundfield and output a signal to one or more of the playback elements that causes the one or more of the playback elements to recreate the soundfield. As one example, the mobile device may utilize the wireless and/or wireless communication channels to output the signal to one or more speakers (e.g., speaker arrays, sound bars, etc.). As another example, the mobile device may utilize docking solutions to output the signal to one or more docking stations and/or one or more docked speakers (e.g., sound systems in smart cars and/or homes). As another example, the mobile device may utilize headphone rendering to output the signal to a set of headphones, e.g., to create realistic binaural sound.

In some examples, a particular mobile device may both acquire a 3D soundfield and playback the same 3D soundfield at a later time. In some examples, the mobile device may acquire a 3D soundfield, encode the 3D soundfield into HOA, and transmit the encoded 3D soundfield to one or more other devices (e.g., other mobile devices and/or other non-mobile devices) for playback.

Yet another context in which the techniques may be performed includes an audio ecosystem that may include audio content, game studios, coded audio content, rendering engines, and delivery systems. In some examples, the game studios may include one or more DAWs which may support editing of HOA signals. For instance, the one or more DAWs may include HOA plugins and/or tools which may be configured to operate with (e.g., work with) one or more game audio systems. In some examples, the game studios may output new stem formats that support HOA. In any case, the game studios may output coded audio content to the rendering engines which may render a soundfield for playback by the delivery systems.

The techniques may also be performed with respect to exemplary audio acquisition devices. For example, the techniques may be performed with respect to an Eigen microphone which may include a plurality of microphones that are collectively configured to record a 3D soundfield. In some examples, the plurality of microphones of an Eigen microphone may be located on the surface of a substantially spherical ball with a radius of approximately 4 cm. In some examples, the audio encoding device 20 may be integrated into the Eigen microphone so as to output a bitstream 21 directly from the microphone.

Another exemplary audio acquisition context may include a production truck which may be configured to receive a signal from one or more microphones, such as one or more Eigen microphones. The production truck may also include an audio encoder, such as audio encoder 20 of FIG. 5.

The mobile device may also, in some instances, include a plurality of microphones that are collectively configured to record a 3D soundfield. In other words, the plurality of microphones may have X, Y, Z diversity. In some examples, the mobile device may include a microphone which may be rotated to provide X, Y, Z diversity with respect to one or more other microphones of the mobile device. The mobile device may also include an audio encoder, such as audio encoder 20 of FIG. 5.

A ruggedized video capture device may further be configured to record a 3D soundfield. In some examples, the ruggedized video capture device may be attached to a helmet of a user engaged in an activity. For instance, the ruggedized video capture device may be attached to a helmet of a user whitewater rafting. In this way, the ruggedized video capture device may capture a 3D soundfield that represents the action all around the user (e.g., water crashing behind the user, another rafter speaking in front of the user, etc. . . . ).

The techniques may also be performed with respect to an accessory enhanced mobile device, which may be configured to record a 3D soundfield. In some examples, the mobile device may be similar to the mobile devices discussed above, with the addition of one or more accessories. For instance, an Eigen microphone may be attached to the above noted mobile device to form an accessory enhanced mobile device. In this way, the accessory enhanced mobile device may capture a higher quality version of the 3D soundfield than just using sound capture components integral to the accessory enhanced mobile device.

Example audio playback devices that may perform various aspects of the techniques described in this disclosure are further discussed below. In accordance with one or more techniques of this disclosure, speakers and/or sound bars may be arranged in any arbitrary configuration while still playing back a 3D soundfield. Moreover, in some examples, headphone playback devices may be coupled to a decoder 24 via either a wired or a wireless connection. In accordance with one or more techniques of this disclosure, a single generic representation of a soundfield may be utilized to render the soundfield on any combination of the speakers, the sound bars, and the headphone playback devices.

A number of different example audio playback environments may also be suitable for performing various aspects of the techniques described in this disclosure. For instance, a 5.1 speaker playback environment, a 2.0 (e.g., stereo) speaker playback environment, a 9.1 speaker playback environment with full height front loudspeakers, a 22.2 speaker playback environment, a 16.0 speaker playback environment, an automotive speaker playback environment, and a mobile device with ear bud playback environment may be suitable environments for performing various aspects of the techniques described in this disclosure.

In accordance with one or more techniques of this disclosure, a single generic representation of a soundfield may be utilized to render the soundfield on any of the foregoing playback environments. Additionally, the techniques of this disclosure enable a rendered to render a soundfield from a generic representation for playback on the playback environments other than that described above. For instance, if design considerations prohibit proper placement of speakers according to a 7.1 speaker playback environment (e.g., if it is not possible to place a right surround speaker), the techniques of this disclosure enable a render to compensate with the other 6 speakers such that playback may be achieved on a 6.1 speaker playback environment.

Moreover, a user may watch a sports game while wearing headphones. In accordance with one or more techniques of this disclosure, the 3D soundfield of the sports game may be acquired (e.g., one or more Eigen microphones may be placed in and/or around the baseball stadium), HOA coefficients corresponding to the 3D soundfield may be obtained and transmitted to a decoder, the decoder may reconstruct the 3D soundfield based on the HOA coefficients and output the reconstructed 3D soundfield to a renderer, and the renderer may obtain an indication as to the type of playback environment (e.g., headphones), and render the reconstructed 3D soundfield into signals that cause the headphones to output a representation of the 3D soundfield of the sports game.

In each of the various instances described above, it should be understood that the audio encoding device 20 may perform a method or otherwise comprise means to perform each step of the method for which the audio encoding device 20 is configured to perform In some instances, the means may comprise one or more processors, e.g., formed by fixed-function processing circuitry, programmable processing circuitry or a combination thereof. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio encoding device 20 has been configured to perform.

In one or more examples, the functions described may be implemented in hardware, software, firmware, or any combination thereof. If implemented in software, the functions may be stored on or transmitted over as one or more instructions or code on a computer-readable medium and executed by a hardware-based processing unit. Computer-readable media may include computer-readable storage media, which corresponds to a tangible medium such as data storage media. Data storage media may be any available media that can be accessed by one or more computers or one or more processors to retrieve instructions, code and/or data structures for implementation of the techniques described in this disclosure. A computer program product may include a computer-readable medium.

Likewise, in each of the various instances described above, it should be understood that the audio decoding device 24 may perform a method or otherwise comprise means to perform each step of the method for which the audio decoding device 24 is configured to perform. In some instances, the means may comprise one or more processors, e.g., formed by fixed-function processing circuitry, programmable processing circuitry or a combination thereof. In some instances, the one or more processors may represent a special purpose processor configured by way of instructions stored to a non-transitory computer-readable storage medium. In other words, various aspects of the techniques in each of the sets of encoding examples may provide for a non-transitory computer-readable storage medium having stored thereon instructions that, when executed, cause the one or more processors to perform the method for which the audio decoding device 24 has been configured to perform.

Various examples of the techniques performed by audio encoding device 20 and/or audio decoding device 24 may be set forth with respect to the following clauses.

Clause 1G. A device configured to compress higher order ambisonic audio data representative of a soundfield, the device comprising: a memory configured to store, at least in part, a first data object representative of a compressed version of higher order ambisonic coefficients, the higher order ambisonic coefficients representative of a soundfield; and one or more processors configured to: obtain, from the first data object, a plurality of sound components and priority information indicative of a priority of each of the plurality of sound components relative to remaining ones of the sound components; select, based on the priority information, a non-zero subset of the plurality of sound components; and specify, in a second data object different from the first data object, the selected non-zero subset of the plurality of sound components.

Clause 2G. The device of clause 1G, wherein the one or more processors are further configured to: obtain, from the first data object, a spatial component corresponding to each of the plurality of sound components; and specify, in the second data object, a non-zero subset of the spatial components corresponding to the non-zero subset of the plurality of sound components.

Clause 3G. The device of clause 2G, wherein the corresponding spatial component defines shape, width, and directions of the sound component, and wherein the corresponding spatial component is defined in a spherical harmonic domain.

Clause 4G. The device of any combination of clauses 1G-3G, wherein the sound component is defined in the spatial domain.

Clause 5G. The device of any combination of clauses 1G-4G, wherein the one or more processors are further configured to perform psychoacoustic audio encoding with respect to the data object to obtain a compressed data object.

Clause 6G. The device of any combination of clauses 1G-5G, wherein the first data object comprises a bitstream, and wherein the second data object comprises a file.

Clause 7G. The device of any combination of clauses 1G-5G, wherein the first data object comprises a file, and wherein the second data object comprises a bitstream.

Clause 8G. The device of any combination of clauses 1G-5G, wherein the first data object comprises a first bitstream, the first bitstream comprising a first plurality of transport channels, wherein the second data object comprises a second bitstream, the second bitstream comprising a second plurality of transport channels, wherein the priority information comprises priority channel information, and wherein the one or more processors are configured to: obtain, from the first plurality of transport channels, the plurality of sound components; and specify, in each of the second plurality of transport channels, a respective one of the selected non-zero subset of the plurality of sound components.

Clause 9G. The device of any combination of clauses 1G-5G, wherein the first data object comprises a first file, the first file comprising a first plurality of tracks, wherein the second data object comprises a second file, the second file comprising a second plurality of tracks, wherein the priority information comprises priority track information, and wherein the one or more processors are configured to: obtain, from the first plurality of tracks, the plurality of sound components; and specify, in each of the second plurality of tracks, a respective one of the selected non-zero subset of the plurality of sound components.

Clause 10G. A method of compressing higher order ambisonic audio data representative of a soundfield, the method comprising: obtaining, from a first data object representative of a compressed version of higher order ambisonic coefficients, a plurality of sound components and priority information indicative of a priority of each of the plurality of sound components relative to remaining ones of the sound components, the higher order ambisonic coefficients representative of a sound field; selecting, based on the priority information, a non-zero subset of the plurality of sound components; and specifying, in a second data object different from the first data object, the selected non-zero subset of the plurality of sound components.

Clause 11G. The method of clause 10G, further comprising: obtaining, from the first data object, a spatial component corresponding to each of the plurality of sound components; and specifying, in the second data object, a non-zero subset of the spatial components corresponding to the non-zero subset of the plurality of sound components.

Clause 12G. The method of clause 11G, wherein the corresponding spatial component defines shape, width, and directions of the sound component, and wherein the corresponding spatial component is defined in a spherical harmonic domain.

Clause 13G. The method of any combination of clauses 10G-12G, wherein the sound component is defined in the spatial domain.

Clause 14G. The method of any combination of clauses 10G-13G, further comprising performing psychoacoustic audio encoding with respect to the data object to obtain a compressed data object.

Clause 15G. The method of any combination of clauses 10G-14G, wherein the first data object comprises a bitstream, and wherein the second data object comprises a file.

Clause 16G. The method of any combination of clauses 10G-14G, wherein the first data object comprises a file, and wherein the second data object comprises a bitstream.

Clause 17G. The method of any combination of clauses 10G-14G, wherein the first data object comprises a first bitstream, the first bitstream comprising a first plurality of transport channels, wherein the second data object comprises a second bitstream, the second bitstream comprising a second plurality of transport channels, wherein the priority information comprises priority channel information, wherein obtaining the plurality of sound components comprises: obtaining, from the first plurality of transport channels, the plurality of sound components, and wherein specifying the respective one of the selected non-zero subset of the plurality of sound components comprises specifying, in each of the second plurality of transport channels, a respective one of the selected non-zero subset of the plurality of sound components.

Clause 18G. The method of any combination of clauses 10G-14G, wherein the first data object comprises a first file, the first file comprising a first plurality of tracks, wherein the second data object comprises a second file, the second file comprising a second plurality of tracks, wherein the priority information comprises priority track information, wherein obtaining the plurality of sound components comprises obtaining, from the first plurality of tracks, the plurality of sound components, and wherein specifying the respective one of the selected non-zero subset of the plurality of sound components comprises specifying, in each of the second plurality of tracks, a respective one of the selected non-zero subset of the plurality of sound components.

Clause 19G. A device configured to compress higher order ambisonic audio data representative of a soundfield, the device comprising: means for obtaining, from a first data object representative of a compressed version of higher order ambisonic coefficients, a plurality of sound components and priority information indicative of a priority of each of the plurality of sound components relative to remaining ones of the sound components, the higher order ambisonic coefficients representative of a sound field; means for selecting, based on the priority information, a non-zero subset of the plurality of sound components; and means for specifying, in a second data object different from the first data object, the selected non-zero subset of the plurality of sound components.

20G. The device of clause 19G, further comprising: means for obtaining, from the first data object, a spatial component corresponding to each of the plurality of sound components; and means for specifying, in the second data object, a non-zero subset of the spatial components corresponding to the non-zero subset of the plurality of sound components.

Clause 21G. The device of clause 20G, wherein the corresponding spatial component defines shape, width, and directions of the sound component, and wherein the corresponding spatial component is defined in a spherical harmonic domain.

Clause 22G. The device of any combination of clauses 19G-21G, wherein the sound component is defined in the spatial domain.

Clause 23G. The device of any combination of clauses 19G-22G, further comprising means for performing psychoacoustic audio encoding with respect to the data object to obtain a compressed data object.

Clause 24G. The device of any combination of clauses 19G-23G, wherein the first data object comprises a bitstream, and wherein the second data object comprises a file.

Clause 25G. The device of any combination of clauses 19G-23G, wherein the first data object comprises a file, and wherein the second data object comprises a bitstream.

Clause 26G. The device of any combination of clauses 19G-23G, wherein the first data object comprises a first bitstream, the first bitstream comprising a first plurality of transport channels, wherein the second data object comprises a second bitstream, the second bitstream comprising a second plurality of transport channels, wherein the priority information comprises priority channel information, wherein the means for obtaining the plurality of sound components comprises means for obtaining, from the first plurality of transport channels, the plurality of sound components, and wherein the means for specifying the respective one of the selected non-zero subset of the plurality of sound components comprises means for specifying, in each of the second plurality of transport channels, a respective one of the selected non-zero subset of the plurality of sound components.

Clause 27G. The device of any combination of clauses 19G-23G, wherein the first data object comprises a first file, the first file comprising a first plurality of tracks, wherein the second data object comprises a second file, the second file comprising a second plurality of tracks, wherein the priority information comprises priority track information, wherein the means for obtaining the plurality of sound components comprises means for obtaining, from the first plurality of tracks, the plurality of sound components, and wherein the means for specifying the respective one of the selected non-zero subset of the plurality of sound components comprises means for specifying, in each of the second plurality of tracks, a respective one of the selected non-zero subset of the plurality of sound components.

Clause 28G. A non-transitory computer-readable storage medium having stored thereon instructions that, when executed, cause one or more processors to: obtain, from a first data object representative of a compressed version of higher order ambisonic coefficients, a plurality of sound components and priority information indicative of a priority of each of the plurality of sound components relative to remaining ones of the sound components, the higher order ambisonic coefficients representative of a sound field; select, based on the priority information, a non-zero subset of the plurality of sound components; and specify, in a second data object different from the first data object, the selected non-zero subset of the plurality of sound components.

Clause 29G. The non-transitory computer-readable storage medium of clause 28G, further comprising instructions that, when executed, cause the one or more processors to perform the steps of the method recited by any combination of clauses 10G-18G.

1H. A device configured to compress higher order ambisonic audio data representative of a soundfield, the device comprising: a memory configured to store higher order ambisonic coefficients of the higher order ambisonic audio data, the higher order ambisonic coefficients representative of a soundfield; and one or more processors configured to: decompose the higher order ambisonic coefficients into a predominant sound component and a corresponding spatial component, the corresponding spatial component defining shape, width, and directions of the predominant sound component, and the corresponding spatial component defined in a spherical harmonic domain; obtain, from the higher order ambisonic coefficients, an ambient higher order ambisonic coefficient descriptive of an ambient component of the soundfield; obtain a repurposed spatial component corresponding to the ambient higher order ambisonic coefficient, the repurposed spatial component indicative of one or more of an order and an sub-order of a spherical basis function to which the ambient higher order ambisonic coefficient corresponds; specify, in a data object representative of a compressed version of the higher order ambisonic audio data and according to a format, the predominant sound component and the corresponding spatial component; and specify, in the data object and according to the same format, the ambient higher order ambisonic coefficient and the corresponding repurposed spatial component.

Clause 2H. The device of clause 1H, wherein the one or more processors are configured to: obtain a harmonic coefficient ordering format indicator indicative of either a symmetric harmonic coefficient ordering format or a linear harmonic coefficient ordering format for the HOA coefficients; and obtain, based on the harmonic coefficient ordering format indicator, the repurposed vector.

Clause 3H. The device of clause 1H, wherein the repurposed spatial component comprises a vector having a number of elements equal to a maximum order (N) plus one squared (N+1)2, the maximum order defined as a maximum order of the spherical basis functions to which the higher order ambisonic coefficients correspond, and wherein the vector identifies the order and the sub-order by having a value of one for one of the elements.

Clause 4H. The device of clause 1H, wherein the repurposed spatial component comprises a vector having a number of elements equal to a maximum order (N) plus one squared (N+1)2, the maximum order defined as a maximum order of the spherical basis functions to which the higher order ambisonic coefficients correspond, and wherein the vector identifies the order and the sub-order by having a value of one for one of the elements, and a value of zero for the remaining elements of the vector.

Clause 5H. The device of clause 1H, wherein the one or more processors are configured to specify, in the data object and according to the same format, the ambient higher order ambisonic coefficient and the corresponding repurposed spatial component without specifying, in the data object, the order and the sub-order of the ambient higher order ambisonic coefficient.

Clause 6H. The device of any combination of clauses 1H-5H, wherein the one or more processors are further configured to perform psychoacoustic audio encoding with respect to the data object to obtain a compressed data object.

Clause 7H. The device of any combination of clauses 1H-6H, wherein the data object comprises a bitstream, wherein the format comprises a transport format, and wherein the one or more processors are configured to: specify, in a first transport channel of the bitstream and using the transport format, the predominant sound component; and specify, in a second transport channel of the bitstream and using the same transport format, the ambient higher order ambisonic coefficient.

Clause 8H. The device of any combination of clauses 1H-6H, wherein the data object comprises a file, wherein the format comprises a track format, and wherein the one or more processors are configured to: specify, in a first track of the file and using the track format, the predominant sound component; and specify, in a second track of the file and using the same track format, the ambient higher order ambisonic coefficient.

Clause 9H. The device of any combination of clauses 1H-8H, wherein the one or more processors are configured to: receive the higher order ambisonic audio data; and output the data object to an emission encoder, the emission encoder configured to transcode the bitstream based on a target bitrate.

Clause 10H. The device of any combination of clauses 1H-9H, further comprising a microphone configured to capture spatial audio data representative of the higher order ambisonic audio data, and convert the spatial audio data to the higher order ambisonic audio data.

Clause 11H. The device of any combination of clauses 1H-10H, wherein the device comprises a robotic device.

Clause 12H. The device of any combination of clauses 1H-10H, wherein the device comprises a flying device.

Clause 13H. A method of compressing higher order ambisonic audio data representative of a soundfield, the method comprising: decomposing higher order ambisonic coefficients into a predominant sound component and a corresponding spatial component, the higher order ambisonic coefficients representative of a soundfield, the corresponding spatial component defining shape, width, and directions of the predominant sound component, and the corresponding spatial component defined in a spherical harmonic domain; obtaining, from the higher order ambisonic coefficients, an ambient higher order ambisonic coefficient descriptive of an ambient component of the soundfield; obtaining a repurposed spatial component corresponding to the ambient higher order ambisonic coefficient, the repurposed spatial component indicative of one or more of an order and an sub-order of a spherical basis function to which the ambient higher order ambisonic coefficient corresponds; specifying, in a data object representative of a compressed version of the higher order ambisonic audio data and according to a format, the predominant sound component and the corresponding spatial component; and specifying, in the data object and according to the same format, the ambient higher order ambisonic coefficient and the corresponding repurposed spatial component.

14H. The method of clause 13H, further comprising obtaining a harmonic coefficient ordering format indicator indicative of either a symmetric harmonic coefficient ordering format or a linear harmonic coefficient ordering format for the HOA coefficients, wherein obtaining the repurposed vector comprises obtaining, based on the harmonic coefficient ordering format indicator, the repurposed vector.

Clause 15H. The method of clause 13H, wherein the repurposed spatial component comprises a vector having a number of elements equal to a maximum order (N) plus one squared (N+13)14, the maximum order defined as a maximum order of the spherical basis functions to which the higher order ambisonic coefficients correspond, and wherein the vector identifies the order and the sub-order by having a value of one for one of the elements.

Clause 16H. The method of clause 13H, wherein the repurposed spatial component comprises a vector having a number of elements equal to a maximum order (N) plus one squared (N+13)14, the maximum order defined as a maximum order of the spherical basis functions to which the higher order ambisonic coefficients correspond, and wherein the vector identifies the order and the sub-order by having a value of one for one of the elements, and a value of zero for the remaining elements of the vector.

Clause 17H. The method of clause 13H, wherein specifying the ambient higher order ambisonic coefficient comprises specifying, in the data object and according to the same format, the ambient higher order ambisonic coefficient and the corresponding repurposed spatial component without specifying, in the data object, the order and the sub-order of the ambient higher order ambisonic coefficient.

Clause 18H. The method of any combination of clauses 13H-17H, further comprising performing psychoacoustic audio encoding with respect to the data object to obtain a compressed data object.

Clause 19H. The method of any combination of clauses 13H-18H, wherein the data object comprises a bitstream, wherein the format comprises a transport format, wherein specifying the predominant sound component comprises specifying, in a first transport channel of the bitstream and using the transport format, the predominant sound component, and wherein specifying the ambient higher order ambisonic coefficient comprises specifying, in a second transport channel of the bitstream and using the same transport format, the ambient higher order ambisonic coefficient.

Clause 20H. The method of any combination of clauses 13H-18H, wherein the data object comprises a file, wherein the format comprises a track format, and wherein specifying the predominant sound component comprises specifying, in a first track of the file and using the track format, the predominant sound component; and wherein specifying the ambient higher order ambisonic coefficient comprises specifying, in a second track of the file and using the same track format, the ambient higher order ambisonic coefficient.

Clause 21H. The method of any combination of clauses 13H-20H, further comprising: receiving the higher order ambisonic audio data; and outputting the data object to an emission encoder, the emission encoder configured to transcode the bitstream based on a target bitrate.

Clause 22H. The method of any combination of clauses 13H-21H, further comprising: capturing, by a microphone, spatial audio data representative of the higher order ambisonic audio data; and converting the spatial audio data to the higher order ambisonic audio data.

Clause 23H. A device configured to compress higher order ambisonic audio data representative of a soundfield, the device comprising: means for decomposing higher order ambisonic coefficients into a predominant sound component and a corresponding spatial component, the higher order ambisonic coefficients representative of a soundfield, the corresponding spatial component defining shape, width, and directions of the predominant sound component, and the corresponding spatial component defined in a spherical harmonic domain; means for obtaining, from the higher order ambisonic coefficients, an ambient higher order ambisonic coefficient descriptive of an ambient component of the soundfield; means for obtaining a repurposed spatial component corresponding to the ambient higher order ambisonic coefficient, the repurposed spatial component indicative of one or more of an order and an sub-order of a spherical basis function to which the ambient higher order ambisonic coefficient corresponds; means for specifying, in a data object representative of a compressed version of the higher order ambisonic audio data and according to a format, the predominant sound component and the corresponding spatial component; and means for specifying, in the data object and according to the same format, the ambient higher order ambisonic coefficient and the corresponding repurposed spatial component.

Clause 24H. The device of clause 23H, further comprising means for obtaining a harmonic coefficient ordering format indicator indicative of either a symmetric harmonic coefficient ordering format or a linear harmonic coefficient ordering format for the HOA coefficients, wherein the means for obtaining the repurposed vector comprises means for obtaining, based on the harmonic coefficient ordering format indicator, the repurposed vector.

Clause 25H. The device of clause 23H, wherein the repurposed spatial component comprises a vector having a number of elements equal to a maximum order (N) plus one squared (N+23)24, the maximum order defined as a maximum order of the spherical basis functions to which the higher order ambisonic coefficients correspond, and wherein the vector identifies the order and the sub-order by having a value of one for one of the elements.

Clause 26H. The device of clause 23H, wherein the repurposed spatial component comprises a vector having a number of elements equal to a maximum order (N) plus one squared (N+23)24, the maximum order defined as a maximum order of the spherical basis functions to which the higher order ambisonic coefficients correspond, and wherein the vector identifies the order and the sub-order by having a value of one for one of the elements, and a value of zero for the remaining elements of the vector.

Clause 27H. The device of clause 23H, wherein the means for specifying the ambient higher order ambisonic coefficient comprises means for specifying, in the data object and according to the same format, the ambient higher order ambisonic coefficient and the corresponding repurposed spatial component without specifying, in the data object, the order and the sub-order of the ambient higher order ambisonic coefficient.

Clause 28H. The device of any combination of clauses 23H-27H, further comprising means for performing psychoacoustic audio encoding with respect to the data object to obtain a compressed data object.

Clause 29H. The device of any combination of clauses 23H-28H, wherein the data object comprises a bitstream, wherein the format comprises a transport format, wherein the means for specifying the predominant sound component comprises means for specifying, in a first transport channel of the bitstream and using the transport format, the predominant sound component, and wherein the means for specifying the ambient higher order ambisonic coefficient comprises means for specifying, in a second transport channel of the bitstream and using the same transport format, the ambient higher order ambisonic coefficient.

Clause 30H. The device of any combination of clauses 23H-28H, wherein the data object comprises a file, wherein the format comprises a track format, and wherein the means for specifying the predominant sound component comprises means for specifying, in a first track of the file and using the track format, the predominant sound component; and wherein the means for specifying the ambient higher order ambisonic coefficient comprises means for specifying, in a second track of the file and using the same track format, the ambient higher order ambisonic coefficient.

Clause 31H. The device of any combination of clauses 23H-30H, further comprising: means for receiving the higher order ambisonic audio data; and means for outputting the data object to an emission encoder, the emission encoder configured to transcode the bitstream based on a target bitrate.

Clause 32H. The device of any combination of clauses 23H-31H, further comprising: means for capturing spatial audio data representative of the higher order ambisonic audio data; and means for converting the spatial audio data to the higher order ambisonic audio data.

Clause 33H. A non-transitory computer-readable storage medium having stored thereon instructions that, when executed, cause one or more processors to: decompose higher order ambisonic coefficients into a predominant sound component and a corresponding spatial component, the higher order ambisonic coefficients representative of a soundfield, the corresponding spatial component defining shape, width, and directions of the predominant sound component, and the corresponding spatial component defined in a spherical harmonic domain; obtain, from the higher order ambisonic coefficients, an ambient higher order ambisonic coefficient descriptive of an ambient component of the soundfield; obtain a repurposed spatial component corresponding to the ambient higher order ambisonic coefficient, the repurposed spatial component indicative of one or more of an order and an sub-order of a spherical basis function to which the ambient higher order ambisonic coefficient corresponds; specify, in a data object representative of a compressed version of the higher order ambisonic audio data and according to a format, the predominant sound component and the corresponding spatial component; and specify, in the data object and according to the same format, the ambient higher order ambisonic coefficient and the corresponding repurposed spatial component.

Clause 34H. The non-transitory computer-readable storage medium of clause 33H, further comprising instructions that, when executed, cause the one or more processors to perform the steps of the method recited by any combination of clauses 13H-22H.

Clause 1I. A device configured to decompress higher order ambisonic audio data representative of a soundfield, the device comprising: a memory configured to store, at least in part, a data object representative of a compressed version of higher order ambisonic coefficients, the higher order ambisonic coefficients representative of a soundfield; and one or more processors configured to: obtain, from the data object and according to a format, an ambient higher order ambisonic coefficient descriptive of an ambient component of the soundfield; obtain, from the data object, a repurposed spatial component corresponding to the ambient higher order ambisonic coefficient, the repurposed spatial component indicative of one or more of an order and sub-order of a spherical basis function to which the ambient higher order ambisonic coefficient corresponds; obtain, from the data object and according to the same format, the predominant sound component; obtain, from the data object, a corresponding spatial component defining shape, width, and directions of the predominant sound component, and the corresponding spatial component defined in a spherical harmonic domain; render, based on the ambient higher order ambisonic coefficient, the repurposed spatial component, the predominant sound component, and the corresponding spatial component, one or more speaker feeds; and output, to one or more speakers, the one or more speaker feeds.

Clause 2I. The device of clause 1I, wherein the one or more processors are further configured to: obtain, from the data object, a harmonic coefficient ordering format indicator indicative of either a symmetric harmonic coefficient ordering format or a linear harmonic coefficient ordering format for the ambient HOA coefficients; determine, based on the harmonic coefficient ordering format indicator and the repurposed vector, the order and the sub-order of the spherical basis function to which the higher order ambisonic coefficient corresponds; and associate, prior to rendering the one or more speaker feeds, the ambient higher order ambisonic coefficient with the spherical basis function having the determined order and sub-order.

Clause 3I. The device of clause 1I, wherein the repurposed spatial component comprises a vector having a number of elements equal to a maximum order (N) plus one squared (N+1)2, the maximum order defined as a maximum order of the spherical basis functions to which the higher order ambisonic coefficients correspond, and wherein the vector identifies the order and the sub-order by having a value of one for one of the elements.

Clause 4I. The device of clause 1I, wherein the repurposed spatial component comprises a vector having a number of elements equal to a maximum order (N) plus one squared (N+1)2, the maximum order defined as a maximum order of the spherical basis functions to which the higher order ambisonic coefficients correspond, and wherein the vector identifies the order and the sub-order by having a value of one for one of the elements, and a value of zero for the remaining elements of the vector.

Clause 5I. The device of clause 1I, wherein the one or more processors are configured to obtain, from the data object and according to the same format, the ambient higher order ambisonic coefficient and the corresponding repurposed spatial component without obtaining, from the data object, the order and the sub-order of the ambient higher order ambisonic coefficient.

Clause 6I. The device of any combination of clauses 1I-5I, wherein the one or more processors are further configured to perform psychoacoustic audio decoding with respect to the data object to obtain a decompressed data object.

Clause 7I. The device of any combination of clauses 1I-6I, wherein the data object comprises a bitstream, wherein the format comprises a transport format, and wherein the one or more processors are configured to: obtain, from a first transport channel of the bitstream and according to the transport format, the predominant sound component; and obtain, from a second transport channel of the bitstream and according to the same transport format, the ambient higher order ambisonic coefficient.

Clause 8I. The device of any combination of clauses 1I-6I, wherein the data object comprises a file, wherein the format comprises a track format, and wherein the one or more processors are configured to: obtain, from a first track of the file and according to the track format, the predominant sound component; and obtain, from a second track of the bitstream and according to the same track format, the ambient higher order ambisonic coefficient.

Clause 9I. The device of any combination of clauses 1I-8I, wherein the one or more processors are configured to render the one or more speaker feeds as one or more binaural audio headphone feeds, and wherein the one or more speakers comprise one or more headphone speakers.

Clause 10I. The device of clause 9I, wherein the device comprises a headset, the headset including the one or more headphone speakers as the one or more integrated headphone speakers.

Clause 11I. The device of any combination of clauses 1I-8I, wherein the device comprises an automobile, the automobile including the one or more speakers as one or more integrated speakers.

Clause 12I. A method of decompressing higher order ambisonic audio data representative of a soundfield, the method comprising: obtaining, from a data object representative of a compressed version of higher order ambisonic coefficients and according to a format, an ambient higher order ambisonic coefficient descriptive of an ambient component of a soundfield, the higher order ambisonic coefficients representative of the soundfield, obtaining, from the data object, a repurposed spatial component corresponding to the ambient higher order ambisonic coefficient, the repurposed spatial component indicative of one or more of an order and sub-order of a spherical basis function to which the ambient higher order ambisonic coefficient corresponds; obtaining, from the data object and according to the same format, the predominant sound component; obtaining, from the data object, a corresponding spatial component defining shape, width, and directions of the predominant sound component, and the corresponding spatial component defined in a spherical harmonic domain; rendering, based on the ambient higher order ambisonic coefficient, the repurposed spatial component, the predominant sound component, and the corresponding spatial component, one or more speaker feeds; and outputting, to one or more speakers, the one or more speaker feeds.

Clause 13I. The method of clause 12I, further comprising: obtaining, from the data object, a harmonic coefficient ordering format indicator indicative of either a symmetric harmonic coefficient ordering format or a linear harmonic coefficient ordering format for the ambient HOA coefficients; determining, based on the harmonic coefficient ordering format indicator and the repurposed vector, the order and the sub-order of the spherical basis function to which the higher order ambisonic coefficient corresponds; and associating, prior to rendering the one or more speaker feeds, the ambient higher order ambisonic coefficient with the spherical basis function having the determined order and sub-order.

Clause 14I. The method of clause 12I, wherein the repurposed spatial component comprises a vector having a number of elements equal to a maximum order (N) plus one squared (N+12)13, the maximum order defined as a maximum order of the spherical basis functions to which the higher order ambisonic coefficients correspond, and wherein the vector identifies the order and the sub-order by having a value of one for one of the elements.

Clause 15I. The method of clause 12I, wherein the repurposed spatial component comprises a vector having a number of elements equal to a maximum order (N) plus one squared (N+12)13, the maximum order defined as a maximum order of the spherical basis functions to which the higher order ambisonic coefficients correspond, and wherein the vector identifies the order and the sub-order by having a value of one for one of the elements, and a value of zero for the remaining elements of the vector.

Clause 16I. The method of clause 12I, wherein obtaining the ambient higher order ambisonic coefficient and the corresponding repurposed spatial component comprises obtaining, from the data object and according to the same format, the ambient higher order ambisonic coefficient and the corresponding repurposed spatial component without obtaining, from the data object, the order and the sub-order of the ambient higher order ambisonic coefficient.

Clause 17I. The method of any combination of clauses 12I-16I, further comprising performing psychoacoustic audio decoding with respect to the data object to obtain a decompressed data object.

Clause 18I. The method of any combination of clauses 12I-17I, wherein the data object comprises a bitstream, wherein the format comprises a transport format, wherein obtaining the predominant sound component comprises obtaining, from a first transport channel of the bitstream and according to the transport format, the predominant sound component, and wherein obtaining the ambient higher order ambisonic coefficient comprises obtaining, from a second transport channel of the bitstream and according to the same transport format, the ambient higher order ambisonic coefficient.

Clause 19I. The method of any combination of clauses 12I-17I, wherein the data object comprises a file, wherein the format comprises a track format, wherein obtaining the predominant sound component comprises obtaining, from a first track of the file and according to the track format, the predominant sound component, and wherein obtaining the ambient higher order ambisonic coefficient comprises obtaining, from a second track of the bitstream and according to the same track format, the ambient higher order ambisonic coefficient.

Clause 20I. The method of any combination of clauses 12I-19I, wherein rendering the one or more speaker feeds comprises rendering the one or more speaker feeds as one or more binaural audio headphone feeds, and wherein the one or more speakers comprise one or more headphone speakers.

Clause 21I. The method of clause 20I, wherein a headset performs the method, the headset including the one or more headphone speakers as the one or more integrated headphone speakers.

Clause 22I. The method of any combination of clauses 12I-19I, wherein an automobile performs the method, the automobile including the one or more speakers as one or more integrated speakers.

Clause 23I. A device configured to decompress higher order ambisonic audio data representative of a soundfield, the device comprising: means for obtaining, from a data object representative of a compressed version of higher order ambisonic coefficients and according to a format, an ambient higher order ambisonic coefficient descriptive of an ambient component of a soundfield, the higher order ambisonic coefficients representative of the soundfield, means for obtaining, from the data object, a repurposed spatial component corresponding to the ambient higher order ambisonic coefficient, the repurposed spatial component indicative of one or more of an order and sub-order of a spherical basis function to which the ambient higher order ambisonic coefficient corresponds; means for obtaining, from the data object and according to the same format, the predominant sound component; means for obtaining, from the data object, a corresponding spatial component defining shape, width, and directions of the predominant sound component, and the corresponding spatial component defined in a spherical harmonic domain; means for rendering, based on the ambient higher order ambisonic coefficient, the repurposed spatial component, the predominant sound component, and the corresponding spatial component, one or more speaker feeds; and means for outputting, to one or more speakers, the one or more speaker feeds.

Clause 24I. The device of clause 23I, further comprising: means for obtaining, from the data object, a harmonic coefficient ordering format indicator indicative of either a symmetric harmonic coefficient ordering format or a linear harmonic coefficient ordering format for the ambient HOA coefficients; means for determining, based on the harmonic coefficient ordering format indicator and the repurposed vector, the order and the sub-order of the spherical basis function to which the higher order ambisonic coefficient corresponds; and means for associating, prior to rendering the one or more speaker feeds, the ambient higher order ambisonic coefficient with the spherical basis function having the determined order and sub-order.

Clause 25I. The device of clause 23I, wherein the repurposed spatial component comprises a vector having a number of elements equal to a maximum order (N) plus one squared (N+23)24, the maximum order defined as a maximum order of the spherical basis functions to which the higher order ambisonic coefficients correspond, and wherein the vector identifies the order and the sub-order by having a value of one for one of the elements.

Clause 26I. The device of clause 23I, wherein the repurposed spatial component comprises a vector having a number of elements equal to a maximum order (N) plus one squared (N+23)24, the maximum order defined as a maximum order of the spherical basis functions to which the higher order ambisonic coefficients correspond, and wherein the vector identifies the order and the sub-order by having a value of one for one of the elements, and a value of zero for the remaining elements of the vector.

Clause 27I. The device of clause 23I, wherein the means for obtaining the ambient higher order ambisonic coefficient and the corresponding repurposed spatial component comprises means for obtaining, from the data object and according to the same format, the ambient higher order ambisonic coefficient and the corresponding repurposed spatial component without obtaining, from the data object, the order and the sub-order of the ambient higher order ambisonic coefficient.

Clause 28I. The device of any combination of clauses 23I-27I, further comprising means for performing psychoacoustic audio decoding with respect to the data object to obtain a decompressed data object.

Clause 29I. The device of any combination of clauses 23I-28I, wherein the data object comprises a bitstream, wherein the format comprises a transport format, wherein the means for obtaining the predominant sound component comprises means for obtaining, from a first transport channel of the bitstream and according to the transport format, the predominant sound component, and wherein the means for obtaining the ambient higher order ambisonic coefficient comprises means for obtaining, from a second transport channel of the bitstream and according to the same transport format, the ambient higher order ambisonic coefficient.

Clause 30I. The device of any combination of clauses 23I-28I, wherein the data object comprises a file, wherein the format comprises a track format, wherein the means for obtaining the predominant sound component comprises means for obtaining, from a first track of the file and according to the track format, the predominant sound component, and wherein the means for obtaining the ambient higher order ambisonic coefficient comprises means for obtaining, from a second track of the bitstream and according to the same track format, the ambient higher order ambisonic coefficient.

Clause 31I. The device of any combination of clauses 23I-30I, wherein the means for rendering the one or more speaker feeds comprises rendering the one or more speaker feeds as one or more binaural audio headphone feeds, and wherein the one or more speakers comprise one or more headphone speakers.

Clause 32I. The device of clause 31I, wherein the device comprises a headset, the headset including the one or more headphone speakers as the one or more integrated headphone speakers.

Clause 33I. The device of any combination of clauses 23I-30I, wherein the device comprises an automobile, the automobile including the one or more speakers as one or more integrated speakers.

Clause 34I. A non-transitory computer-readable storage medium having stored thereon instructions that, when executed, cause one or more processors to: obtain, from a data object representative of a compressed version of higher order ambisonic coefficients and according to a format, an ambient higher order ambisonic coefficient descriptive of an ambient component of a soundfield, the higher order ambisonic coefficients representative of the soundfield; obtain, from the data object, a repurposed spatial component corresponding to the ambient higher order ambisonic coefficient, the repurposed spatial component indicative of one or more of an order and sub-order of a spherical basis function to which the ambient higher order ambisonic coefficient corresponds; obtain, from the data object and according to the same format, the predominant sound component; obtain, from the data object, a corresponding spatial component defining shape, width, and directions of the predominant sound component, and the corresponding spatial component defined in a spherical harmonic domain; render, based on the ambient higher order ambisonic coefficient, the repurposed spatial component, the predominant sound component, and the corresponding spatial component, one or more speaker feeds; and output, to one or more speakers, the one or more speaker feeds.

Clause 35I. The non-transitory computer-readable storage medium of clause 34I, further comprising instructions that, when executed, cause the one or more processors to perform the steps of the method recited by any combination of clauses 12I-22I.

By way of example, and not limitation, such computer-readable storage media can comprise RAM, ROM, EEPROM, CD-ROM or other optical disk storage, magnetic disk storage, or other magnetic storage devices, flash memory, or any other medium that can be used to store desired program code in the form of instructions or data structures and that can be accessed by a computer. It should be understood, however, that computer-readable storage media and data storage media do not include connections, carrier waves, signals, or other transitory media, but are instead directed to non-transitory, tangible storage media. Disk and disc, as used herein, includes compact disc (CD), laser disc, optical disc, digital versatile disc (DVD), floppy disk and Blu-ray disc, where disks usually reproduce data magnetically, while discs reproduce data optically with lasers. Combinations of the above should also be included within the scope of computer-readable media.

Instructions may be executed by one or more processors, such as one or more digital signal processors (DSPs), general purpose microprocessors, application specific integrated circuits (ASICs), field programmable logic arrays (FPGAs), or other equivalent integrated or discrete logic circuitry. Accordingly, the term "processor," as used herein may refer to any of the foregoing structure or any other structure suitable for implementation of the techniques described herein. In addition, in some aspects, the functionality described herein may be provided within dedicated hardware and/or software modules configured for encoding and decoding, or incorporated in a combined codec. Also, the techniques could be fully implemented in one or more circuits or logic elements.

The techniques of this disclosure may be implemented in a wide variety of devices or apparatuses, including a wireless handset, an integrated circuit (IC) or a set of ICs (e.g., a chip set). Various components, modules, or units are described in this disclosure to emphasize functional aspects of devices configured to perform the disclosed techniques, but do not necessarily require realization by different hardware units. Rather, as described above, various units may be combined in a codec hardware unit or provided by a collection of interoperative hardware units, including one or more processors as described above, in conjunction with suitable software and/or firmware.

Moreover, as used herein, "A and/or B" means "A or B", or both "A and B."

Various aspects of the techniques have been described. These and other aspects of the techniques are within the scope of the following claims.

The invention claimed is:

1. A device configured to compress higher order ambisonic audio data representative of a soundfield, the device comprising:

a memory configured to store higher order ambisonic coefficients of the higher order ambisonic audio data, the higher order ambisonic coefficients representative of a soundfield; and one or more processors configured to:

decompose the higher order ambisonic coefficients into a sound component and a corresponding spatial component, the corresponding spatial component defining shape, width, and directions of the sound component in a spherical harmonic domain;

determine, based on one or more of the sound component and the corresponding spatial component, priority information indicative of a priority of the sound component relative to other sound components of the soundfield; and specify, in a data object representative of a compressed version of the higher order ambisonic audio data, the sound component and the priority information.

2. The device of claim 1, wherein the one or more processors are further configured to obtain, based on the sound component and the corresponding spatial component, a higher order ambisonic representation of the sound component, and wherein the one or more processors are configured to determine, based on one or more of the higher order ambisonic representation of the sound component and the corresponding spatial component, the priority information.

3. The device of claim 2, wherein the one or more processors are configured to:

render the higher order ambisonic representation of the sound component to one or more speaker feeds; and wherein the one or more processors are configured to determine, based on one or more of the higher order ambisonic representation of the sound component, the speaker feeds, and the corresponding spatial component, the priority information.

4. The device of claim 1, wherein the one or more processors are configured to:

determine, based on the corresponding spatial component, a spatial weighting indicative of a relevance of the sound component to the soundfield; and determine, based on one or more of the sound component, the higher order ambisonic representation of the sound component, the one or more speaker feeds, and the spatial weighting, the priority information.

5. The device of claim 1, wherein the one or more processors are configured to:

determine an energy associated with the sound component, the higher order ambisonic representation of the sound component, or the one or more speaker feeds; and determine, based on one or more of the energy and the spatial weighting, the priority information.

6. The device of claim 1, wherein the one or more processors are configured to:

determine a loudness measure associated with one of the sound component, the higher order ambisonic representation of the sound component, or the one or more speaker feeds, the loudness measure indicative of a relevance of the sound component to the soundfield;

determine, based on one or more of the loudness measure and the spatial weighting, the priority information.

7. The device of claim 1, wherein the one or more processors are configured to:

determining continuity indication indicative of whether a current portion defines the same sound component as a previous portion of the data object;

determine, based on one or more of the continuity indication and the spatial weighting, the priority information.

8. The device of claim 1, wherein the one or more processors are configured to:

perform signal classification with respect to the sound component, the higher order ambisonic representation of the sound component, or the one or more speaker feeds to determine a class to which the sound component corresponds;

determine, based on one or more of the class and the spatial weighting, the priority information.

9. The device of claim 8, wherein the one or more processors are configured to perform signal classification with respect to the sound component, the higher order ambisonic representation of the sound component, or the one or more speaker feeds to determine a speech class or a non-speech class to which the sound component corresponds.

10. The device of claim 1, wherein the data object comprises a bitstream, wherein the bitstream comprises a plurality of transport channels, wherein the priority information comprises priority channel information, and wherein the one or more processors are configured to:

specify, in a transport channel of the plurality of transport channels, the sound component; and specify, in the bitstream, the priority channel information indicative of a priority of the transport channel relative to remaining ones of the plurality of transport channels defining the other sound components.

11. The device of claim 1,
wherein the data object comprises a file,
wherein the file comprises a plurality of tracks,
wherein the priority information comprises priority track information, and
wherein the one or more processors are configured to:
specify, in a track of the plurality of tracks, the sound component; and
specify, in the bitstream, the priority track information indicative of a priority of the track relative to remaining ones of the plurality of tracks defining the other sound components.

12. The device of claim 1, wherein the one or more processors are configured to:
receive the higher order ambisonic audio data; and
output the data object to an emission encoder, the emission encoder configured to transcode the bitstream based on a target bitrate.

13. The device of claim 1, further comprising a microphone configured to capture spatial audio data representative of the higher order ambisonic audio data, and convert the spatial audio data to the higher order ambisonic audio data.

14. The device of claim 1, wherein the device comprises a robotic device.

15. The device of claim 1, wherein the device comprises a flying device.

16. A method of compressing higher order ambisonic audio data representative of a soundfield, the method comprising:
decomposing higher order ambisonic coefficients of the ambisonic higher order ambisonic audio data into a sound component and a corresponding spatial component, the higher order ambisonic audio data representative of a soundfield, the corresponding spatial component defining shape, width, and directions of the sound component, and the corresponding spatial component defined in a spherical harmonic domain;
determining, based on one or more of the sound component and the corresponding spatial component, priority information indicative of a priority of the sound component relative to other sound components of the soundfield; and
specifying, in a data object representative of a compressed version of the higher order ambisonic audio data, the sound component and the priority information.

17. The method of claim 16, wherein determining the priority information comprises:
obtaining, from a content provider providing the higher order ambisonic audio data, a preferred priority of the sound component relative to other sound components of the soundfield; and
determining, based on one or more of the preferred priority and the spatial weighting, the priority information.

18. The method of claim 16, wherein determining the priority information comprises determining, based on one or more of the energy, the continuity indication, and the spatial weighting, the priority information.

19. The method of claim 16, wherein determining the priority information comprises determining, based on one or more of the loudness measure, the continuity indication, and the spatial weighting, the priority information.

20. The method of claim 16, wherein determining the priority information comprises determining, based on one or more of the energy, the class, and the spatial weighting, the priority information.

21. The method of claim 16, wherein determining the priority information comprises determining, based on one or more of the loudness measure, the class, and the spatial weighting, the priority information.

22. The method of claim 16, wherein determining the priority information comprises determining, based on one or more of the energy, the preferred priority, and the spatial weighting, the priority information.

23. The method of claim 16, wherein determining the priority information comprises determining, based on one or more of the loudness measure, the preferred priority, and the spatial weighting, the priority information.

24. The method of claim 16, wherein determining the priority information comprises determining, based on one or more of the energy, the continuity indication, the class, the preferred priority, and the spatial weighting, the priority information.

25. The method of claim 16, wherein determining the priority information comprises determining, based on one or more of the loudness measure the continuity indication, the class, the preferred priority, and the spatial weighting, the priority information.

26. The method of claim 16,
wherein the data object comprises a bitstream,
wherein the bitstream comprises a plurality of transport channels,
wherein the priority information comprises priority channel information, and
wherein specifying the sound component comprises specifying, in a transport channel of the plurality of transport channels, the sound component; and
wherein specifying the priority information comprises specifying, in the bitstream, the priority channel information indicative of a priority of the transport channel relative to remaining ones of the plurality of transport channels defining the other sound components.

27. The method of claim 16,
wherein the data object comprises a file,
wherein the file comprises a plurality of tracks,
wherein the priority information comprises priority track information,
wherein specifying the sound component comprises specifying, in a track of the plurality of tracks, the sound component, and
wherein specifying the priority information comprises specifying, in the bitstream, the priority track information indicative of a priority of the track relative to remaining ones of the plurality of tracks defining the other sound components.

28. The method of claim 16, further comprising:
receiving the higher order ambisonic audio data; and
outputting the data object to an emission encoder, the emission encoder configured to transcode the bitstream based on a target bitrate.

29. The method of claim 16, further comprising capturing, by a microphone, spatial audio data representative of the higher order ambisonic audio data, and convert the spatial audio data to the higher order ambisonic audio data.

30. A device configured to compress higher order ambisonic audio data representative of a soundfield, the device comprising:
means for decomposing higher order ambisonic coefficients of the ambisonic higher order ambisonic audio data into a sound component and a corresponding spatial component, the higher order ambisonic audio data representative of a soundfield, the corresponding spatial component defining shape, width, and directions of the sound component, and the corresponding spatial component defined in a spherical harmonic domain;

means for determining, based on one or more of the sound component and the corresponding spatial component, priority information indicative of a priority of the sound component relative to other sound components of the soundfield; and means for specifying, in a data object representative of a compressed version of the higher order ambisonic audio data, the sound component and the priority information.

* * * * *